US008429026B1

(12) United States Patent
Kolawa et al.

(10) Patent No.: US 8,429,026 B1
(45) Date of Patent: Apr. 23, 2013

(54) SYSTEM AND METHOD FOR CREATING AND SUBMITTING ELECTRONIC SHOPPING LISTS

(75) Inventors: Adam Kolawa, Bradbury, CA (US); Marc Elroy Campbell, Monrovia, CA (US)

(73) Assignee: Dietfood Corp., Monrovia, CA (US)

( * ) Notice: Subject to any disclaimer, the term of this patent is extended or adjusted under 35 U.S.C. 154(b) by 2082 days.

(21) Appl. No.: 09/792,343

(22) Filed: Feb. 23, 2001

Related U.S. Application Data

(63) Continuation-in-part of application No. 09/556,051, filed on Apr. 21, 2000, now abandoned, which is a continuation-in-part of application No. 09/340,518, filed on Jun. 28, 1999, now Pat. No. 6,370,513.

(51) Int. Cl.
*G06Q 30/00* (2012.01)

(52) U.S. Cl.
USPC ..... 705/26.7

(58) Field of Classification Search ..... 705/26.7
See application file for complete search history.

(56) References Cited

U.S. PATENT DOCUMENTS

| | | | | |
|---|---|---|---|---|
| 4,807,169 A | | 2/1989 | Overbeck | 364/715.1 |
| 4,996,642 A | | 2/1991 | Hey | |
| 5,047,614 A | * | 9/1991 | Bianco | 235/385 |
| 5,233,520 A | | 8/1993 | Kretsch et al. | 364/413.29 |
| 5,583,763 A | | 12/1996 | Atcheson et al. | |
| 5,664,110 A | * | 9/1997 | Green et al. | 705/26 |
| 5,704,017 A | | 12/1997 | Heckerman et al. | |
| 5,724,567 A | | 3/1998 | Rose et al. | |
| 5,749,081 A | * | 5/1998 | Whiteis | 707/102 |
| 5,768,142 A | * | 6/1998 | Jacobs | 700/231 |
| 5,832,446 A | | 11/1998 | Neuhaus | 705/1 |
| 5,842,199 A | * | 11/1998 | Miller et al. | 707/2 |
| 5,884,281 A | * | 3/1999 | Smith et al. | 705/26 |
| 5,884,282 A | | 3/1999 | Robinson | |
| 5,899,502 A | | 5/1999 | Del Giorno | |

(Continued)

FOREIGN PATENT DOCUMENTS

| | | |
|---|---|---|
| EP | 0 751 471 A1 | 1/1997 |
| JP | 08 063 455 | 3/1996 |
| JP | 08 064 355 A | 3/1996 |

OTHER PUBLICATIONS

Meals for You, the best recipe site on the web, http:// www.mymenu.com, 1996.*

(Continued)

*Primary Examiner* — Yehdega Retta
(74) *Attorney, Agent, or Firm* — Christie, Parker & Hale, LLP

(57) ABSTRACT

A system and method for creating and submitting for a user an electronic shopping list. The system presents to the user a meal list and a shopping list of ingredients contained in the meal list. The meals are preferably selected based on the food preferences of the user. The user accepts the meal list and the shopping list, causing an order request with the ingredients to be automatically created and submitted to a retailer. The user may alternatively decide to manually exclude certain ingredients in the list that the user has already purchased prior to accepting the shopping list. The exclusion may also be automatic based on past purchase information contained in the user's home inventory database. The retailer fulfills the order and delivers the ingredients to the user based on a pre-determined delivery time.

20 Claims, 49 Drawing Sheets

U.S. PATENT DOCUMENTS

| | | | | | |
|---|---|---|---|---|---|
| 5,905,973 | A | * | 5/1999 | Yonezawa et al. | 705/27 |
| 5,918,223 | A | | 6/1999 | Blum et al. | |
| 5,960,440 | A | * | 9/1999 | Brenner et al. | 707/104.1 |
| 5,963,948 | A | | 10/1999 | Shilcrat | |
| 5,978,766 | A | | 11/1999 | Luciw | |
| 5,979,757 | A | | 11/1999 | Tracy et al. | |
| 5,983,200 | A | * | 11/1999 | Slotznick | 705/26 |
| 5,999,975 | A | | 12/1999 | Kittaka et al. | |
| 6,012,051 | A | | 1/2000 | Sammon et al. | |
| 6,018,738 | A | | 1/2000 | Breese et al. | |
| 6,020,883 | A | | 2/2000 | Herz et al. | |
| 6,026,377 | A | * | 2/2000 | Burke | 705/27 |
| 6,041,311 | A | * | 3/2000 | Chislenko et al. | 705/27 |
| 6,046,021 | A | | 4/2000 | Bochner | 435/34 |
| 6,049,777 | A | * | 4/2000 | Sheena et al. | 705/10 |
| 6,112,186 | A | | 8/2000 | Bergh et al. | |
| 6,236,974 | B1 | | 5/2001 | Kolawa et al. | 705/7 |
| 6,236,990 | B1 | | 5/2001 | Geller et al. | |
| 6,358,546 | B1 | * | 3/2002 | Bebiak et al. | 426/232 |
| 6,370,513 | B1 | | 4/2002 | Kolawa et al. | |
| 6,434,530 | B1 | | 8/2002 | Sloane et al. | |
| 6,513,017 | B1 | * | 1/2003 | Howard et al. | 705/28 |
| 6,618,062 | B1 | * | 9/2003 | Brown et al. | 715/822 |

OTHER PUBLICATIONS

Food Chemical News, Database Management is Key to Database Quality. Jul. 22, 1996, v.38 n22., 3 pages.

A steady stream of new applications: order processing, operations, customer services, electronic communications; The Gale Group; Jun. 9, 1996; 8 pages.

Internet Papers: http://www.iVillage.com; iVillage com The Women's Network; (downloaded May 22, 2001); 6 pp.

Internet Papers: http://www.meals.com; Meals.com Meal Planning Made Easy; (downloaded May 21, 2001); 9 pp.

Internet Papers: http://www.foodfit.com; FoodFit; (downloaded May 22, 2001); 7 pp.

Internet Papers: http://www.mealsforyou.com; Meals for You; (downloaded May 21, 2001); 4 pp.

Internet Papers: http://www.ourhouse.com; Tavolo, Inc. (downloaded May 21, 2001); 7 pp.

Internet Papers: http://www.recipezaar.com; Recipezaar; (downloaded May 22, 2001); 7 pp.

Internet Papers: http://www.ucook.com; The Ultimate Cookbook; (downloaded May 22, 2001); 6 pp.

Bill Communications Inc.; A Steady Stream of New Applications . . . Institutional Distribution; v. 19; Nov. 1983.

Co-pending U.S. Appl. No. 09/885,307, filed Jun. 20, 2001, entitled Acoustical Preference Tuner.

Co-pending U.S. Appl. No. 09/885,308, filed Jun. 20, 2001, entitled System and Method for Automated Recipe Selection and Shopping List Creation.

Co-pending U.S. Appl. No. 10/278,636, filed Oct. 23, 2002, entitled Automated Music Profiling and Recommendation.

Co-pending U.S. Appl. No. 10/668,926, filed Sep. 23, 2003, entitled Audio Fingerprinting System and Method.

Unklesbay et al., An automated system forplanning menus for the elderly in the title VII nutrition programs; Food Technology, 32 (8).80-83 [1978].

* cited by examiner

*FIG. 18*

WELCOME TO FOOD MAGIC.

ENTER YOUR EMAIL ADDRESS: *

ENTER A NEW USERNAME: *

ENTER YOUR PASSWORD: *

CONFRIM PASSWORD: *

FIRST NAME: *

LAST NAME: *

STREET ADDRESS:

CITY:

STATE:

ZIPCODE: *

TELEPHONE#:

FAX#:

SUBMIT

*FIG.21*

914

EAT OUT | COOK IN | WEEKLY MENU | TASTE ADJUST | SPECIAL EVENTS | OPTIONS

PREFERENCES | USER PROFILE | GROUP SETUP | MODIFY RECIPES | ADJUST SCALING

WEEKLY MEAL TEMPLATE:

930 — FOR HOW MANY DAYS? [ ] MAKE LIST SAVE

| | SOUP | SALAD | ENTREE | SIDE DISH | DESSERT | SOFT DRINK | BEER | WINE |
|---|---|---|---|---|---|---|---|---|
| 932 — LUNCHES | ☑ | ☐ | ☑ | ☑ | ☐ | ☐ | ☐ | ☐ |
| 934 — DINNERS | ☐ | ☐ | ☑ | ☐ | ☑ | ☐ | ☐ | ☐ |

| | MON | TUES | WED |
|---|---|---|---|
| BREAKFAST | COOK IN | EAT OUT | TAKE OUT |
| LUNCH | COOK IN | COOK IN | COOK IN |
| DINNER | COOK IN | COOK IN | COOK IN |

| | THURS | FRI | SAT | SUN |
|---|---|---|---|---|
| BREAKFAST | DELIVERY | NONE | COOK IN | COOK IN |
| LUNCH | COOK IN | COOK IN | COOK IN | COOK IN |
| DINNER | COOK IN | COOK IN | COOK IN | COOK IN |

*FIG.25*

EAT OUT | COOK IN | WEEKLY MENU | TASTE ADJUST | OPTIONS

PLEASE TELL US HOW YOU LIKED YOUR PREVIOUS ORDERS:

| 948 DISH | 950 RATING: |
|---|---|
| BAKED RED SNAPPER WITH SOUR CREAM STUFFING | *******REALLY LIKED IT |
| SOLE WITH MUSHROOMS | HAVEN'T TRIED IT |
| SOLE AUX AMANDES | HAVEN'T TRIED IT |
| APPLE-CELERY SALAD | HAVEN'T TRIED IT |
| SHRIMP WITH SNOW PEAS & WATER CHESTNUTS | HAVEN'T TRIED IT |
| SOLE-ASPARAGUS ROLLS WITH YOGURT SAUCE | **** |
| PARMESAN TUNA SPREAD | ***TOLERATED IT |
| PASTA WITH FRESH TUNA | HAVEN'T TRIED IT |
| POACHED HADDOCK | HAVEN'T TRIED IT |
| PRAWNS NEW ORLEANS | HAVEN'T TRIED IT |

952 SUBMIT

FIG.26A

EAT OUT | COOK IN | WEEKLY MENU | TASTE ADJUST | SPECIAL EVENTS | OPTIONS
PREFERENCES | USER PROFILE | GROUP SETUP | MODIFY RECIPES | ADJUST SCALING

| ATTRIBUTE | FACTOR | | | PRODUCT#1 | PRODUCT#2 | DISTANCE |
|---|---|---|---|---|---|---|
| | SAVE | | | SHRIMP PA | CORNMEAL | 941.847 |
| PROTEIN | 100.0 | + | - | 6.2686653 | 3.210897 | 10.5% |
| TOTAL LIPID (FAT) | 30.0 | + | - | 5.6136746 | 3.7382727 | 0.4% |
| CARBOHYDRATE, BY DIFFERENCE | 50.0 | + | - | 18.593363 | 20.200994 | 0.7% |
| ASH | 1.0 | + | - | 0.38089907 | 0.42377165 | 0.0% |
| ENERGY | 0.1 | + | - | 159.67484 | 124.616776 | 0.0% |
| ALCOHOL | 30.0 | + | - | 1.1825509 | 0.0 | 0.1% |
| WATER | 40.0 | + | - | 26.454025 | 9.506108 | 51.8% |
| CAFFEINE | 1.0 | + | - | 0.0 | 0.0 | 0.0% |
| THEOBROMINE | 1.0 | + | - | 0.0 | 0.0 | 0.0% |
| SUGARS, TOTAL | 100.0 | + | - | 0.07629361 | 0.0 | 0.0% |
| FIBER, TOTAL DIETARY | 5.0 | + | - | 0.5896591 | 1.9059237 | 0.0% |
| CALCIUM, Ca | 0.1 | + | - | 14.850088 | 6.482775 | 0.0% |
| IRON, Fe | 1.0 | + | - | 1.3624313 | 1.0240114 | 0.0% |
| MAGNESIUM, Mg | 10.0 | + | - | 18.769089 | 34.076607 | 2.6% |
| PHOSPHORUS, P | 1.0 | + | - | 70.95631 | 78.71148 | 0.0% |
| POTASSIUM, K | 10.0 | + | - | 79.4755 | 86.31282 | 0.5% |
| SODIUM, Na | 10.0 | + | - | 25.356628 | 42.697693 | 3.4% |
| ZINC, Zn | 1.0 | + | - | 0.4767058 | 056933755 | 0.0% |

962 960 964 966 968 970

*FIG.26B*

| | | | | | | |
|---|---|---|---|---|---|---|
| COPPER, Cu | | + | − | - - - - - | - - - - - | % |
| MANGANESE,Mn | | + | − | - - - - - | - - - - - | % |
| SELENIUM, Se | | + | − | - - - - - | - - - - - | % |
| VITAMINE A, IU | | + | − | - - - - - | - - - - - | % |
| VITAMINE E | | + | − | - - - - - | - - - - - | % |
| VITAMINE C, ASCORBIC ACID | | + | − | - - - - - | - - - - - | % |
| THIAMINE | | + | − | - - - - - | - - - - - | % |
| RIBOFLAVIN | | + | − | - - - - - | - - - - - | % |
| NIACIN | | + | − | - - - - - | - - - - - | % |
| VITAMINE B−6 | | + | − | - - - - - | - - - - - | % |
| FOLATE | | + | − | - - - - - | - - - - - | % |
| VIATMINE B−12 | | + | − | - - - - - | - - - - - | % |
| TRYPTOPHAN | | + | − | - - - - - | - - - - - | % |
| THREONINE | | + | − | - - - - - | - - - - - | % |
| ISOLEUCINE | | + | − | - - - - - | - - - - - | % |
| LEUCINE | | + | − | - - - - - | - - - - - | % |
| LYSINE | | + | − | - - - - - | - - - - - | % |
| METHIONINE | | + | − | - - - - - | - - - - - | % |
| CYSTINE | | + | − | - - - - - | - - - - - | % |
| PHENYLALANINE | | + | − | - - - - - | - - - - - | % |
| TYROSINE | | + | − | - - - - - | - - - - - | % |
| VALINE | | + | − | - - - - - | - - - - - | % |
| ARGININE | | + | − | - - - - - | - - - - - | % |
| HISTIDINE | | + | − | - - - - - | - - - - - | % |
| ALANINE | | + | − | - - - - - | - - - - - | % |
| ASPARTIC ACID | | + | − | - - - - - | - - - - - | % |
| GLUTAMIC ACID | | + | − | - - - - - | - - - - - | % |

*FIG.26C*

| | | | | | | |
|---|---|---|---|---|---|---|
| GLYSINE | | + | − | - - - - - | - - - - - | % |
| PROLINE | | + | − | - - - - - | - - - - - | % |
| SERINE | | + | − | - - - - - | - - - - - | % |
| CHOLESTEROL | | + | − | - - - - - | - - - - - | % |
| FATY ACIDS, SATURATED | | + | − | - - - - - | - - - - - | % |
| 4:0 | | + | − | - - - - - | - - - - - | % |
| 6:0 | | + | − | - - - - - | - - - - - | % |
| 8:0 | | + | − | - - - - - | - - - - - | % |
| 10:0 | | + | − | - - - - - | - - - - - | % |
| 12:0 | | + | − | - - - - - | - - - - - | % |
| 14:0 | | + | − | - - - - - | - - - - - | % |
| 16:0 | | + | − | - - - - - | - - - - - | % |
| 20:0 | | + | − | - - - - - | - - - - - | % |
| 18:1 | | + | − | - - - - - | - - - - - | % |
| 18:2 | | + | − | - - - - - | - - - - - | % |
| 18:3 | | + | − | - - - - - | - - - - - | % |
| 20:4 | | + | − | - - - - - | - - - - - | % |
| 22:6 | | + | − | - - - - - | - - - - - | % |
| 22:0 | | + | − | - - - - - | - - - - - | % |
| 14:1 | | + | − | - - - - - | - - - - - | % |
| 16:1 | | + | − | - - - - - | - - - - - | % |
| 18:4 | | + | − | - - - - - | - - - - - | % |
| 20:1 | | + | − | - - - - - | - - - - - | % |
| 20:5 | | + | − | - - - - - | - - - - - | % |
| 22:1 | | + | − | - - - - - | - - - - - | % |
| 22:5 | | + | − | - - - - - | - - - - - | % |

SYSTEM AND METHOD FOR CREATING AND SUBMITTING ELECTRONIC SHOPPING LISTS

CROSS-REFERENCE TO RELATED APPLICATIONS

This application is a continuation-in-part of application Ser. No. 09/556,051, filed on Apr. 21, 2000, now abandoned which is a continuation-in-part of application Ser. No. 09/340,518 (now U.S. Pat. No. 6,370,513), filed on Jun. 28, 1999, the contents of which are incorporated herein by reference.

FIELD OF THE INVENTION

The present invention relates in general to an electronic shopping system, and more specifically, to a system and method for efficiently creating and submitting electronic shopping lists.

BACKGROUND OF THE INVENTION

Individuals are often faced with the dilemma of what to eat or cook for a particular meal. In today's society where families consist of either two working spouses or a single working parent, such a decision may cause extra dilemma and stress on the parent who comes home from a long day at work and tackles the decision of what to make for dinner. Thus, if the parent gets home from work around dinner time, he or she may opt for something simple and quick—if all the ingredients needed to prepare the meal are available at the home. If all the ingredients needed to prepare the meal are not available, he or she must make a trip to the store or figure out what to make from the ingredients at home. As a consequence, the family's menu is unimaginative, and may typically end up eating the same food over and over again.

The expansion of personal computers into homes of average consumers provides some relief on the parent with the task of preparing the meals. If a particular ingredient is missing, the parent need not make a physical trip to the grocery store, but may be now purchase the ingredient over the Internet. Internet shopping, although capable of providing convenient purchasing capabilities from one's home, also supplies numerous downfalls. One of the main downfalls is that purchasing products over the Internet may be a time-consuming experience. A customer purchasing various products must generally first find and specifically select the products for inserting into an electronic shopping cart. When the products to be purchased are grocery items required for preparing a particular meal, the find and selection process may entail numerous clicks, making the shopping process more tedious and time-consuming.

Prior art exists for expediting the check-out process during Internet shopping so that an order may be placed via a single click. However the customer must still find and expressly select each product to be purchased before placing the order. The time and effort expended in finding and selecting the products, therefore, remain the same.

Accordingly, there is a need for a system and method for expediting the meal selection process as well as the process for purchasing the ingredients for preparing the meals. Such as system should select and recommend certain meals to the user based on his or her food preferences. The system should further create an electronic shopping list based on the recommended meals.

SUMMARY OF THE INVENTION

The present invention is directed to a system and method for creating an electronic shopping list for a user. According to one embodiment of the invention, the method includes selecting a first item from a plurality of items, the first item being associated with a second item, presenting to the user the first item and the second item, receiving an indication of user acceptance of at least a portion of the presentation of the first item and the second item, and automatically creating an order request to purchase at least a portion of the second item in response to the receipt of the indication of the user acceptance.

According to another embodiment of the invention, the method includes obtaining user preference information about particular food items, selecting at least one food item from a plurality of food items based on the user preference information, the at least one food item being composed of specific ingredients, presenting to the user the at least one food item and the specific ingredients contained in the food item, receiving a user acceptance of one or more of the presented ingredients, and automatically creating an order request to purchase the accepted ingredients in response to the receipt of the user acceptance.

According to a further embodiment of the invention, the method includes displaying a plurality of items, displaying an abstraction of the plurality of items, receiving a user acceptance of the abstraction of the plurality of items, and automatically creating an order request to purchase the plurality of items in response to the receipt of the user acceptance of the abstraction of the plurality of items.

According to another embodiment of the present invention, a system for electronically creating a shopping list includes a storage device storing a plurality of food items where each food item is composed of specific ingredients, a network connection, and a microprocessor coupled to the storage device and the network connection. The microprocessor selects at least one food item from a plurality of food items, the at least one food item being composed of specific ingredients, presents to the user the at least one food item and the specific ingredients contained in the food item, receives via the network connection an indication of the user acceptance of one or more of the presented ingredients, and automatically creates an order request to purchase the accepted ingredients in response to the receipt of the indication of the user acceptance.

The present invention is also directed to a system and method for submitting an order request for a group of individuals. According to one embodiment of the invention, the method comprises prompting one or more individuals in the group to submit an individual order, electronically receiving individual orders from the one or more individuals, automatically aggregating the received individual orders into an aggregate order request, and electronically submitting the aggregate order request for purchase.

It should be apparent, therefore, that the present invention helps expedite the meal selection process as well as the process of purchasing the ingredients for preparing the meals. The user need no longer struggle with the dilemma of what to prepare for dinner. Furthermore, the user need no longer waste time either making a physical trip to the local store to purchase the ingredients, or making the purchases over the Internet by manually finding and selecting each individual ingredient from a particular website.

The present invention further utilizes different levels of abstraction to help expedite the shopping process. The displayed meal list is an abstraction of the particular ingredients contained in the dishes and displayed in the shopping list. The user may choose to review and accept a generally much shorter meal list, and simply skim the numerous ingredients in the shopping list with an assumption that the correct ingredients are included in the list.

In addition to the above, the present invention also facilitates and expedites the submission of orders by multiple individuals. Different individuals may select and submit orders for meals at different times from different locations and from different types of inputs, and the orders are aggregated into a single order request for electronically submitting to a restaurant or retailer.

BRIEF DESCRIPTION OF THE DRAWINGS

These and other features and advantages of the present invention will be appreciated as the same become better understood by reference to the following Detailed Description when considered in connection with the accompanying drawings, wherein:

FIG. 18 is an exemplary user registration GUI according to one embodiment of the present invention;

FIG. 21 is an exemplary GUI for allowing meal template setups according to one embodiment of the present invention;

FIG. 25 is an exemplary GUI for receiving feedback from a user in regards to a recommended recipe;

FIGS. 26A-26D are exemplary GUIs for adjusting the weight of chemical compositions appearing in a recipe;

DETAILED DESCRIPTION

Figure 1:
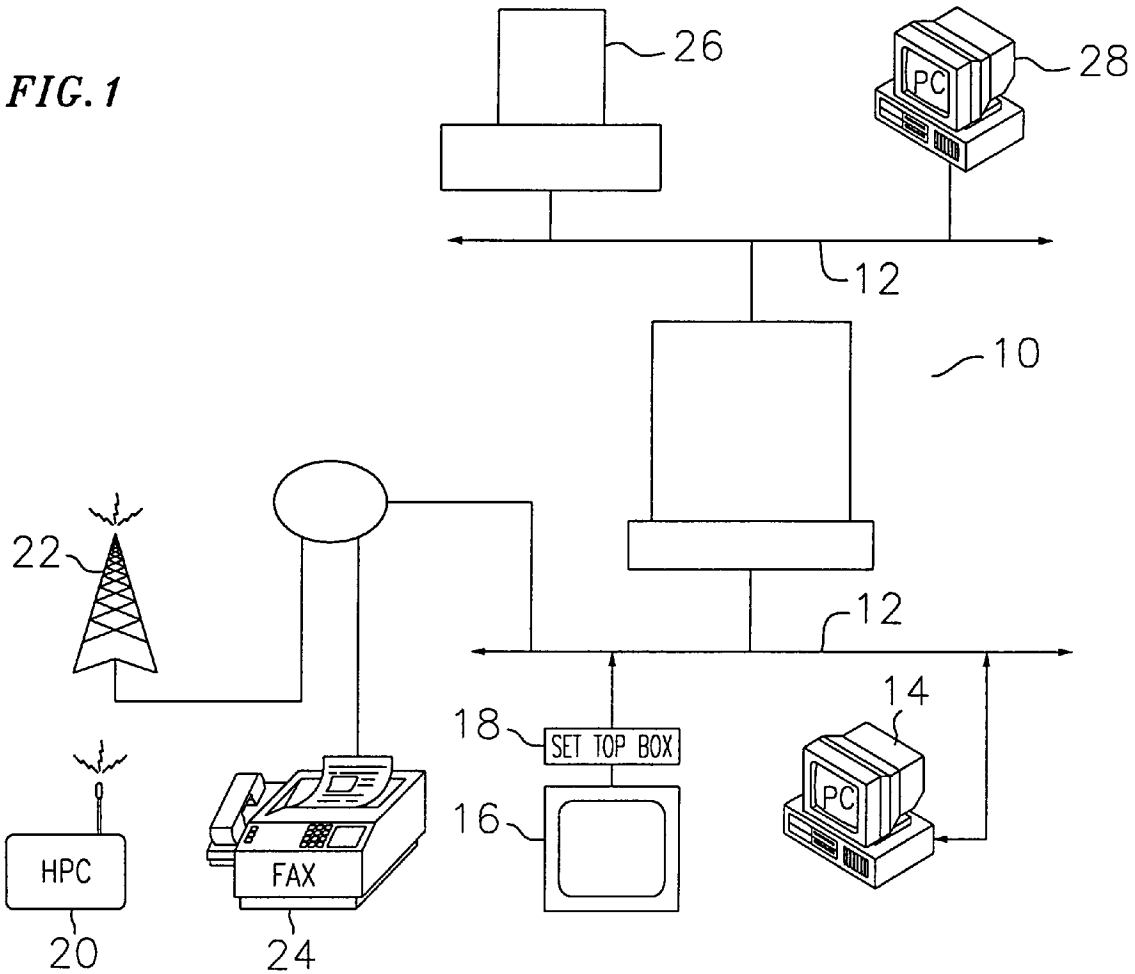
FIG. 1 is an exemplary block diagram of a recommendation system in accordance with the present invention.

FIG. 1 depicts a simplified, semi-schematic block diagram of an exemplary automatic recommendation and purchasing system for recommending and purchasing products and/or services that cater to an individual's tastes. The system preferably includes a network server or platform computer ("the server") 10 having a microprocessor configured to provide a user interface that allows consumers to enter their preference information, view recommendations made by the system, and efficiently submit purchase orders. The microprocessor is further configured to provide a user interface that allows retailers to submit to the system, information about potential products and services that may be recommended to the users of the system. A particular user interface may be configured as a web-page, electronic mail, fax, or customer service representative with access to the system.

Both consumers seeking recommendation and submitting purchase orders, as well as retailers submitting product information and receiving the purchase orders, are in communication with the network server or platform computer 10 through an Internet connection 12. The Internet connection 12 might comprise telephone lines, ISDN lines, ADSL lines, DSL lines, R/F communication, satellite, television cable, and the like. Consumers may use a personal computer 14 equipped with a modem (not shown) to access the Internet connection 12. Alternatively, a television 16 equipped with a digital or analog set top box 18 with Internet capabilities, such as one sold under the trademark WebTV® may be used for connecting to the Internet. In yet another embodiment, individuals may use a hand-held personal computer ("HPC") 20 to communicate with the recommendation system. Thus, a user dining at a restaurant or shopping at a store may access the recommendation and purchasing system to decide what dish to order, or what item to purchase. The HPC includes a wireless modem which communicates with a wireless network service 22 via RF signals. The HPC may also be replaced with any portable device receiving recommendation information from the system, and submitting purchase orders to the system. Recommendation information may further be received and purchase orders be placed by fax 24, e-mail, or any other known means of communication.

Preferably, the personal computer 14, television-set-top box combination 16, 18, and HPC 20 are each equipped with an input device (not shown) for allowing entry of data by a user of the device. Exemplary input devices include but are not limited to a keyboard, keypad, mouse, joystick, and/or remote control unit. The personal computer 14, television-set-top box combination 16, 18, and HPC 20 are also preferably equipped with a display monitor/screen for allowing output of information to the user. The display monitor may include pressure sensitive (touch screen) technology so that a user may provide input by simply selecting portions of the display.

The network server or platform computer 10 also communicates with retailers over the Internet connection 12. The Internet connection 12 at the retailer's site allows a retailer to submit product and service information to the system for recommendation to the individuals. The Internet connection 12 also allows retailers to receive purchase orders from the system. Retailers may use a network server 26 or personal computer 28 to transmit and receive such information. In addition, any of the devices described above may be employed by the retailers to communicate with the network server or platform computer 10.

Figure 2:
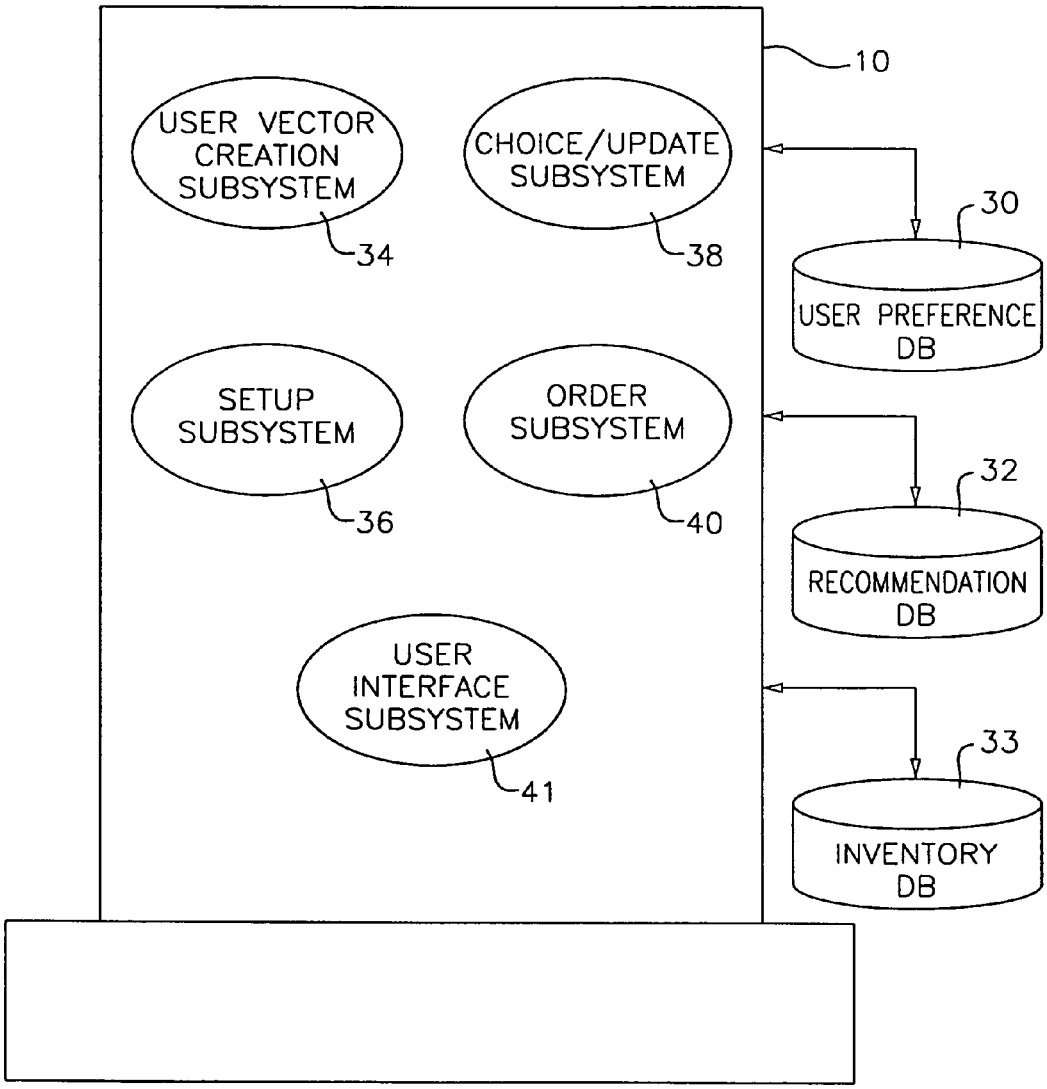
FIG. 2 is an exemplary user vector creation and update subsystem of FIG. 1.

FIG. 2 is an exemplary block diagram illustrating the system's network server or platform computer 10 in greater detail. The system preferably hosts a user preference database 30, a recommendation database 32, and a home inventory database 33. In the illustrated embodiment, the three databases reside in three separate mass storage devices, each taking the form of a hard disk drive or drive array. It is noted, however, that two or more of the databases may reside in a single mass storage device.

The user preference database 30 stores one or more user preference vectors for each individual. Associated with each preference vector is a user identification number or insignia, distinguishing one user's preference vector from another's. The user preference database 30 may also store the user's profile information, such as the user's name, age, address, customer ID, shipping information, billing information, credit card information, and the like, useful in creating and submitting electronic purchase orders.

According to one embodiment of the invention, each user preference vector comprises a series of fields (or positions) that represent the individual's preferences for particular attributes related to an item. For instance, a user's music preference vector may include separate fields to represent the user's preference for piano music, guitar music, music beat, music popularity, etc. Several preference vectors may be maintained for each user. For instance, the system may maintain one or more preference vectors for the user's taste in food and one or more preference vectors for the user's taste in movies. These preference vectors are updated as the system learns more about the user's reactions on previously sampled items.

The recommendation database 32 stores a product vector for each item capable of being recommended by the system. Each product vector is identified by the product's name. If the items to be recommended are recipes, the recommendation database 32 also stores the actual recipes for display to the user. During a recommendation process, the system compares the product vectors in the recommendation database 32 with the user preference vector in the user preference database 30, and selects products with the closest match to the user's preferences for recommendation.

The home inventory database 33 for a recipe recommendation system preferably includes information on ingredients previously purchased and available to the user to prepare a recommended dish. If a necessary ingredient is not present in the home inventory database 33, the ingredient is preferably automatically added to an electronic shopping list for submitting to a retailer for purchase.

The system illustrated in FIG. 2 further includes a user vector creation/update subsystem 34, choice/update subsystem 38, setup subsystem 36, order subsystem 40, and user interface subsystem 41. The user vector creation/update subsystem 34, choice/update subsystem 38, setup subsystem 36, order subsystem 40, and user interface subsystem 41 are preferably software modules. Alternatively, implementation of the system may be accomplished in combination of hardware, firmware (such as, for example, application specific integrated circuits or other customized circuits), and/or software, or by any method known in the art.

The user vector creation/update subsystem 34 allows the creation and update of user preference vectors. The choice/update subsystem 38 allows recommendation of items in the recommendation database 32 based on the user preference vector. The setup subsystem 36 provides a graphics user interface ("GUI") for a system programmer to define or modify vector fields and create preference questions for display to users of the system. The order subsystem 40 allows the receipt and process of on-line purchase requests from the users of the system. The user interface subsystem 41 provides an interactive, user friendly GUI for motivating the user to answer preference questions posed by the system and obtain recommendations based on the user's answers.

Figure 3:
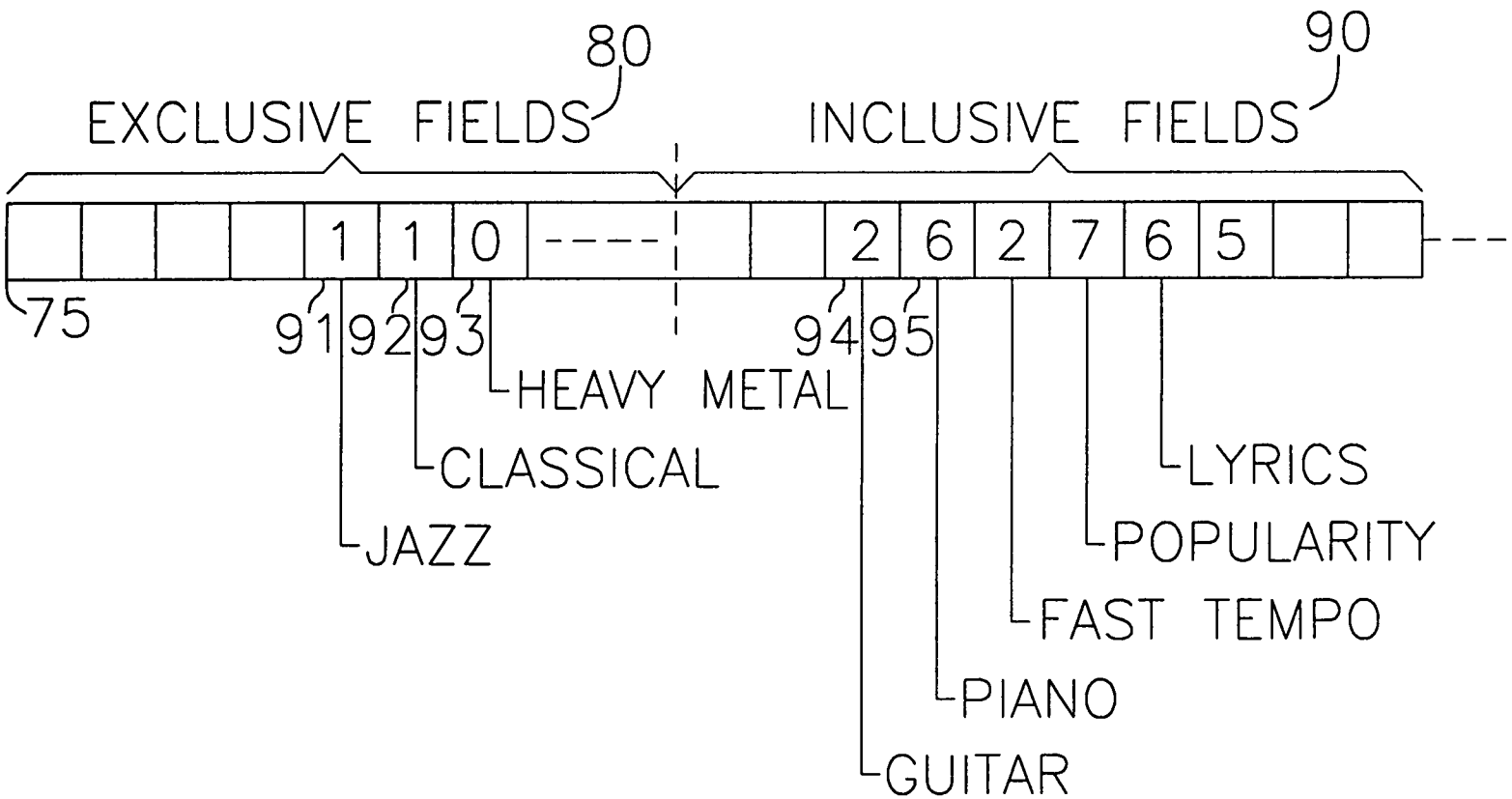
FIG. 3 is an exemplary data structure for containing user preferences (a user preference vector) in accordance with an embodiment of the present invention.

FIG. 3 illustrates an exemplary user preference vector 75 representing a user's taste in music according to one embodiment of the invention. The vector 75 is preferably divided into exclusive fields 80 and inclusive fields 90. The exclusive fields 90 preferably depict specific attributes or categories of items to exclude in making a recommendation. In the user preference vector of FIG. 3, the exclusive field for Jazz music 91 and the exclusive field for Classical music 92, are set to "1", indicating the user's desire to exclude these types of music from the items recommended. On the other hand, the exclusive field for Heavy Metal 93 is set to "0", indicating that heavy metal music is not to be excluded during the search of items to recommend.

The inclusive fields 90 preferably indicate a user's degree of preference with respect to a particular attribute. In the illustrated music preference vector, each inclusive field 90 contains a number on a scale of one to ten, with the number one indicating a lowest degree of preference, and the number ten indicating the highest degree of preference. In an alternate embodiment, the scale of each inclusive field may differ to provide more or less granularity. For instance, the scale for one field may contain a number on a scale of one to ten, while another field may contain a number on a scale of one to a hundred. Certain inclusive preferences may further be given higher or lower weights in comparison to others.

Figure 4:
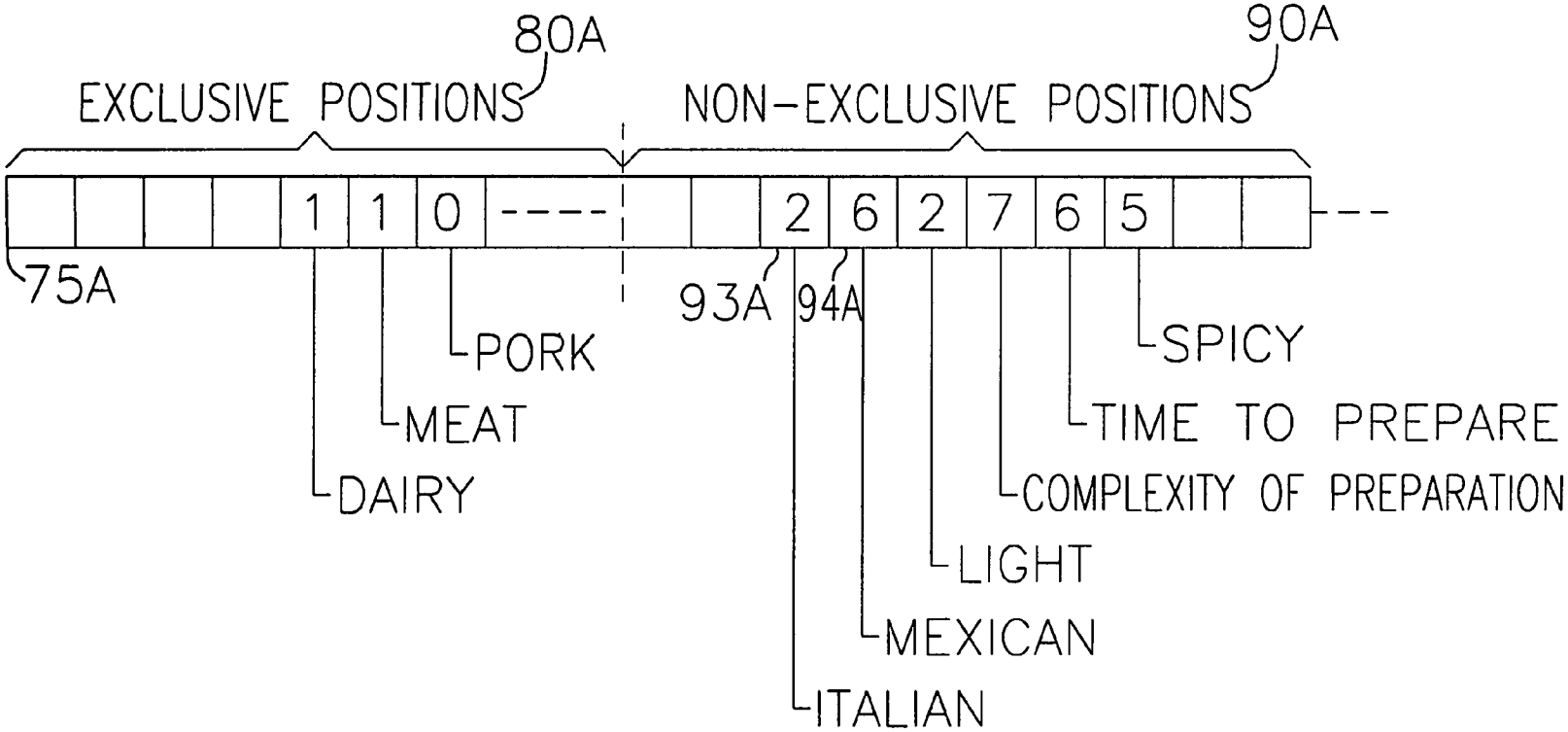
FIG. 4 is an exemplary food preference vector in accordance with an embodiment of the present invention.

FIG. 4 illustrates a user's food preference vector 75A used for recommending recipes to the user. The exclusive positions 80A preferably represent non-waivable preferences relating to the dishes that are recommended. For example, if an exclusive position 80A in the preference vector indicates that the user is vegetarian, the recipe selected is preferably a vegetarian recipe. The inclusive fields 90A preferably indicate the user's degree of preference for certain types of foods or tastes.

According to one embodiment of the invention, the product vector in the recommendation database 32 preferably includes the same exclusive fields and inclusive fields as the corresponding user preference vector. Thus, a product vector for a CD, tape, or musical piece, preferably has the appropriate exclusive fields set based on the type of CD, tape, or musical piece. Furthermore, such product vector preferably also has the appropriate inclusive fields set based on the specific attributes (lyrics, popularity, tempo, etc.) contained or related to the product.

In an alternative embodiment, the product vector includes only the inclusive fields of the corresponding user preference vector. According to this embodiment, the product vectors are stored under certain categories based on the type of product being represented. The categories are associated with the exclusive fields in the user preference vector. Thus, a product vector for a classical CD is stored under a Classical category while a product vector for a Heavy Metal CD is stored under a Heavy Metal category.

Figure 5:
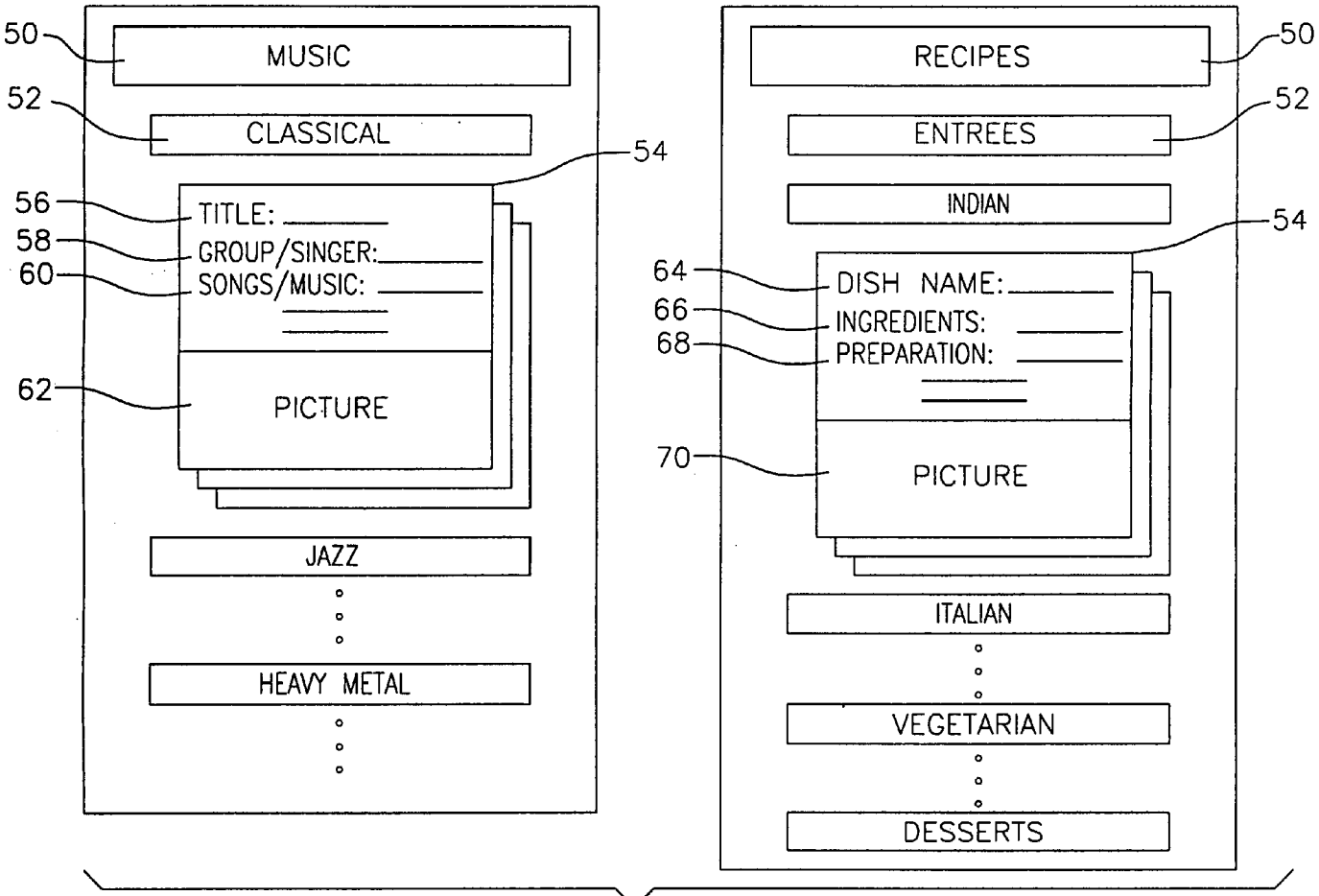
FIG. 5 is a conceptual layout diagram detailing the organization of product information in a recommendation database.

Each product vector is further associated with additional information about the product/service stored in the recommendation database 32, or alternatively, in a separate database. FIG. 5 is a conceptual layout diagram detailing the organization of product information in the recommendation database 32. As illustrated in FIG. 5, the products are categorized into broad categories 50, such as music, movies, recipes, books, and the like. The broad categories 50 may further divided into one or more sub-categories 52 for further categorizing the products. According to one embodiment of the invention, the sub-categories 52 are preferably the exclusive fields of the product vector. Thus, a music category 910 may be further divided into, for instance, Classical, Jazz, and Heavy Metal sub-categories 52. A recipes category may be divided into Entree, Appetizer, Soup, Salad, and Dessert sub-categories. The Entree sub-category may be further divided into Indian foods, Italian foods, Vegetarian foods, and the like. It is noted at this point, that the products in the recommendation database 32 may be organized according to any method known in the art. For instance, the products within each broad category 50 may be organized alphabetically. Furthermore, recipes may be organized based on the eating type, dish type, meal type, diet, ethnicity, ingredients, and the like.

Each category 50 or sub-category 52 in the recommendation database 32 preferably includes a series of product-specific records (identified generally at 54). A product record 54 in the music category may be headed by the title of a particular CD/music 56. The title may be followed by the name of the group/singer 58, and a list of songs/music 60 contained in the CD. The product record 54 may further include an information storage area 62 for maintaining an image of the CD, group/singer, or other images related to the product.

A product record 54 in the recipes category may be headed by a dish name 64 followed by a list of ingredients 66, preparation instructions 68, and an image of the prepared dish. Additional information about each ingredient may further be stored in the product record or preferably, in a separate retailer database. Such additional information may include brand names, prices, SKU (Stock Keeping Unit) or UPC numbers, retailer information, and/or the like. The product record 54 may also include a pointer to a web page stored in an offsite database. The web page may provide the information that would otherwise be included in the product record, or may provide additional information not contained in the product record.

User Vector Creation Subsystem

Figure 6A:
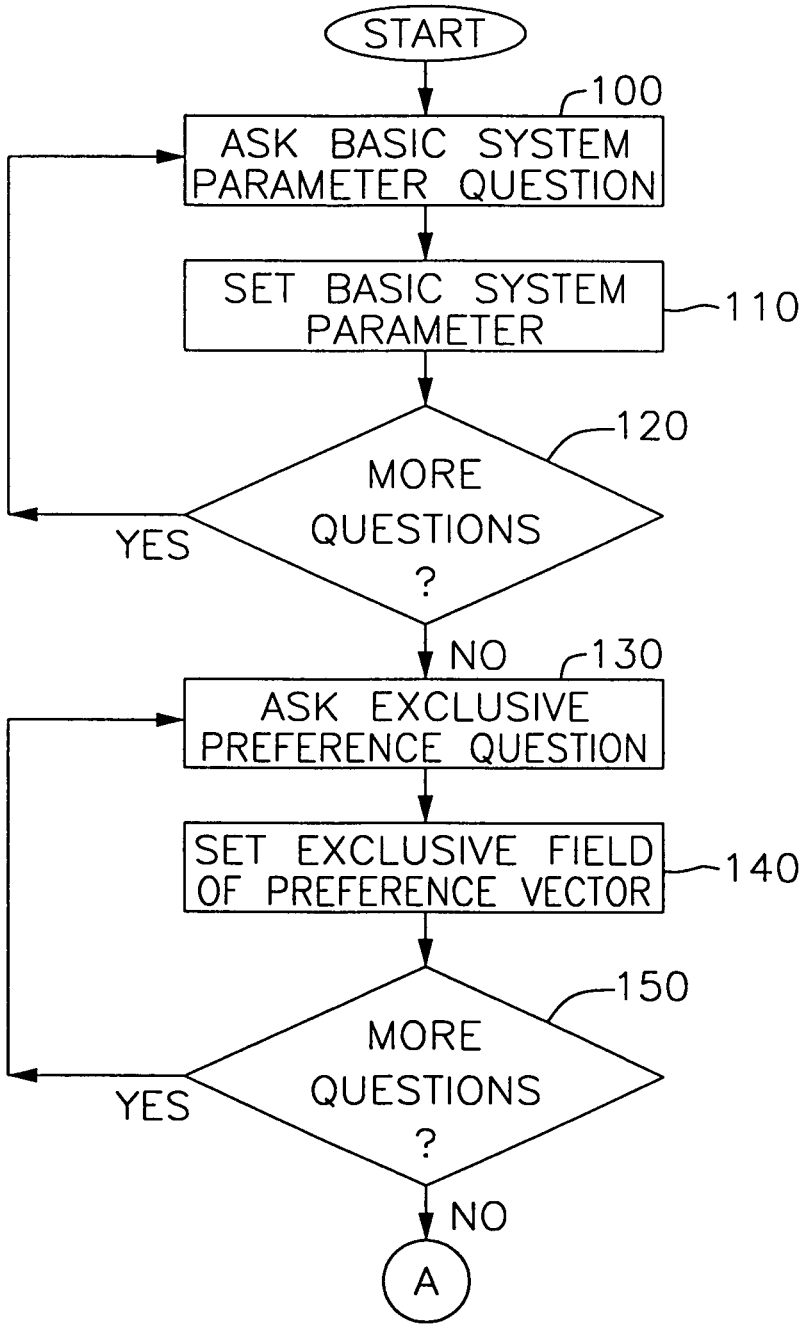
FIGS. 6A-6B are exemplary flow charts of a process for initializing a user preference vector.
Figure 6B:
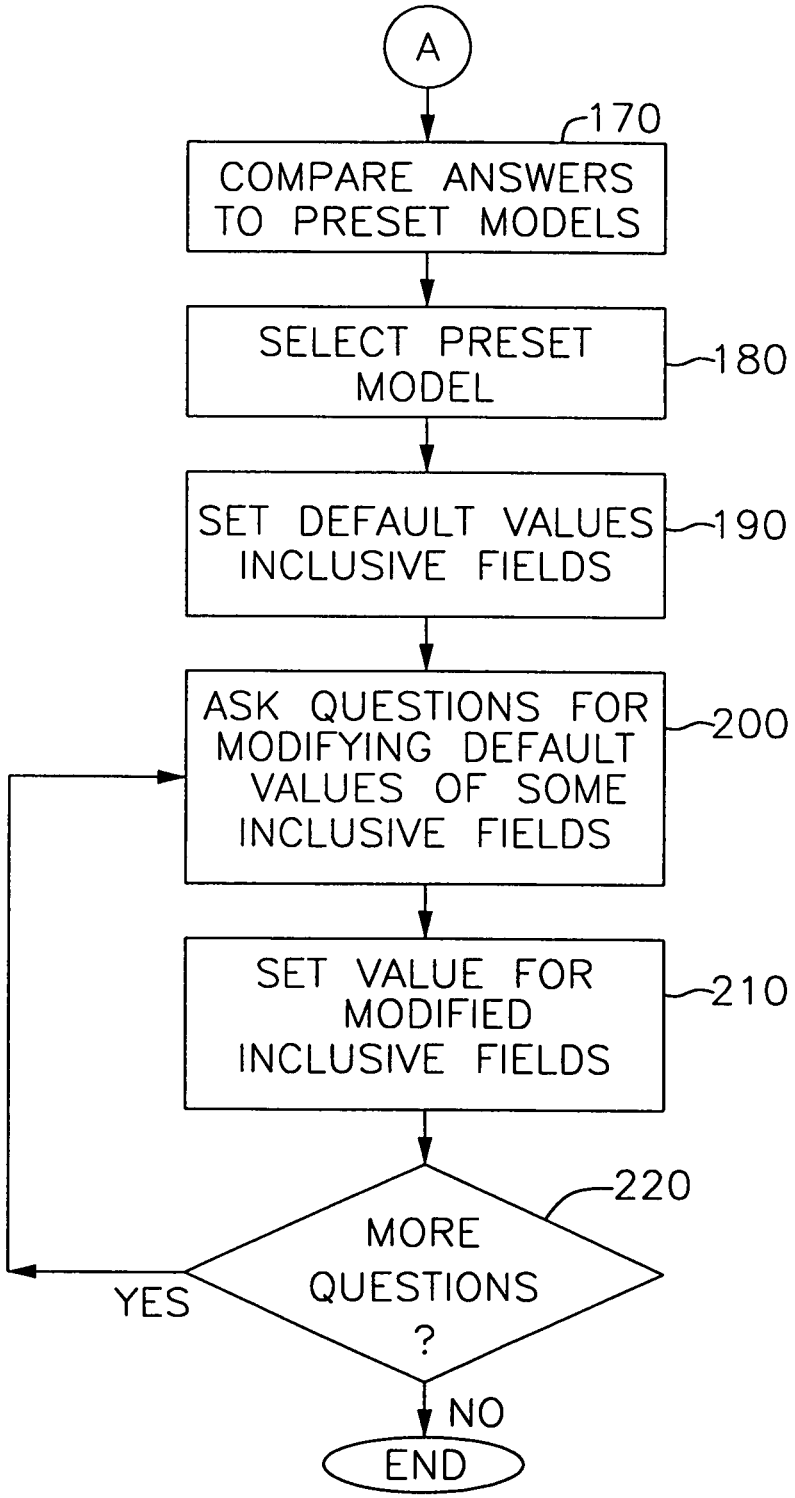

FIGS. 6A-6B are generalized flow diagrams of a user preference vector initialization routine engaged by the user vector creation/update subsystem 34 according to an embodiment of the present invention. The routine is preferably described in terms of a computer program.

To initialize the preference vector 75 for a first time user of the system, the computer program asks setup questions to obtain the user's general preferences. The answers are then utilized for an initial setting of the values of his or her preference vector 75. The setup questions may also seek to obtain profile and demographic information about the user and/or the user's family, such as the user's name, address, age, number of family members, and the like. The setup questions may further seek to obtain information associated with electronic shopping, such as the user's shipping address, billing address, credit card information, favorite retailers, and the like. If the recommendations are to be According to one embodiment of the invention, the initial preference vector setting process preferably starts by asking a basic system parameter question in step 100. Such questions are created by a systems programmer through the setup subsystem 36, as is described in further detail below. A system parameter question for setting a user's music preference vector may inquire about the user's age, gender, and occupation, the CDs or tapes already owned by the user, and the radio stations the user enjoys the most. A system parameter question for setting a food preference vector for recommending dishes to a family may inquire about the number of family members, their ages, weights, and sexes; the number of meals planned per day; the time when meals should be ready; the amount of time the family wants to spend preparing food; the number of times per week the family wishes to get take-out food; the food budget; and whether the family would rather minimize the number of shopping trips taken or the amount of food in the home.

In step 110, the computer program preferably sets a system parameter according to the user response to the question of step 100. In step 120, the program determines whether all the system parameter questions have been asked. If they have not, the program loops back to step 100 and the next system parameter question is asked.

When all the system parameter questions have been asked and answered, the program, in step 130, asks an exclusive preference question. Exclusive preference questions for initializing a user's music preference vector relate to the types of music preferred. For instance, the question may elicit information as to whether the user likes country, rap, Jazz or rock music.

Exclusive preference questions for initializing a family's food vector, might relate to the kinds of foods that the family should avoid. For instance, the question may elicit information as to particular food items, such as meat, pork, lamb, or veal, that are to be avoided. The question may also relate to particular meal ingredients to avoid, such as salt, pepper, dairy products, egg yolks, or milk.

The computer program, in step 140, uses a user response to an exclusive preference question to set a corresponding exclusive field 80 in the user preference vector 75 (FIG. 3). The program then determines, in step 150, whether there are more exclusive preference questions to ask. If there are, the program loops back to step 130 where the next exclusive preference question is asked.

According to one embodiment of the present invention, answers to system parameter questions and exclusive preference questions are used to classify the user into a preset user model represented by a preset model vector. For instance, when setting a family's food preference vector, the computer program inquires whether more than one person will be doing the cooking, or whether the family is adventurous and willing to try a great variety of different foods. Additional questions may also be asked to more accurately classify a user into a preset user model. The preset model is used to set default inclusive fields 90 of the preference vector 75. Alternatively, all inclusive fields may be initialized to an average value by default.

In a system where a preset model is to be selected, the program, in step 170, takes the answers given to the basic system parameter questions and the exclusive preference questions, and any additional setup questions asked by the system, and compares them to the attributes of various preset models. A preset model which best characterizes the user is preferably selected in step 180. In step 190, the program uses the preferences of the chosen model to set the default values of the inclusive fields 90 of the user preference vector 75.

Some exemplary family models used for initializing a family's food preference vector include:

1) Working Family with Children—characterized by moderate eating, desiring to dine out occasionally, cooking in the home most of the time, little time to cook, enjoys cooking on weekends.
2) Individual—characterized by mostly eating out, cooking only simple dishes.
3) Family with One Parent Not Working—characterized by cooking most of the time.
4) Young Two Member Family—characterized by mostly eating out and cooking occasionally for fun.
5) Experimentalist—characterized by wanting to try new food all of the time.

Once the default values have been set, the program, in step 200, asks inclusive preference questions to better represent the individual's preferences. The answers to these questions are preferably used in step 210 to modify the default values of some of the inclusive positions 90. In setting the inclusive preference fields of a music preference vector, the questions may relate to the type of instrument the user likes, with instructions to rank certain types of instruments on a scale of one to ten. For example, the music preference vector 75 of FIG. 3 illustrates a user that prefers piano over guitar. The guitar preference field 94 is set to "2" whereas the piano preference field 95 is set as "6".

Questions may also be asked about the user's music preferences in general. These questions may include: "What is the most important attribute of the types of music you like?"; "What is your preference on the tempo of the music?"; "How important is the popularity of the music?"; and "Do you pay particular attention to the lyrics?" Such questions may affect one or more inclusive attributes.

In modifying default inclusive field values of a family's food preference vector, the computer program may inquire, for instance, the following: "Are any family members diabetic?"; "Are any family members on a low cholesterol diet?"; "Do any family members have a heart condition?"; "Are any of the family members trying to gain weight?"; "Are any of the family members trying to lose weight?"

Questions may also be asked about the type of food that the family likes. For instance, the user may be presented with various types of foods, such as Italian, French, Mexican, Chinese, Japanese, Mediterranean, etc., with instructions to rank the family's preference on a scale of one to ten. For example, the food preference vector 75A of FIG. 4 illustrates a family that prefers Mexican food over Italian food. The Italian food preference field 93A is set to "2" whereas the Mexican food preference field 94A is set, as "6".

Questions may also be asked about the family's eating preferences in general. These questions may include: "What is the most important quality of a good meal?"; "The amount of food?"; "The flavor of the food?"; "The preparation time?"; "Does the family like salads?"; "Does the family like appetizers?"; "Does the family like sandwiches?"; "Does the family like snacks?"; "Does the family like to eat out?"; "Does the family like to eat on the run?"; "Does the family like deserts?"; "Does the family like wine with dinner?"

In step 220, the program determines whether all the questions for modifying default values of certain inclusive vector positions have been asked. If all the questions have been asked and answered, the initial user preference vector 75 has been set, and the program ends. The initial user preference vector 75 is used by the system to make an initial recommendation to the user. As the user utilizes the system over time, the system learns and adapts to the individual's tastes through feedback from the user.

In an alternative embodiment of a menu recommendation system, the user is prompted to select one or more favorite dishes from a displayed list of dishes. The user further determines whether. The user may also be asked to select his or her favorite food(s) from a list of available foods.

Choice/Update Subsystem

Figure 7:
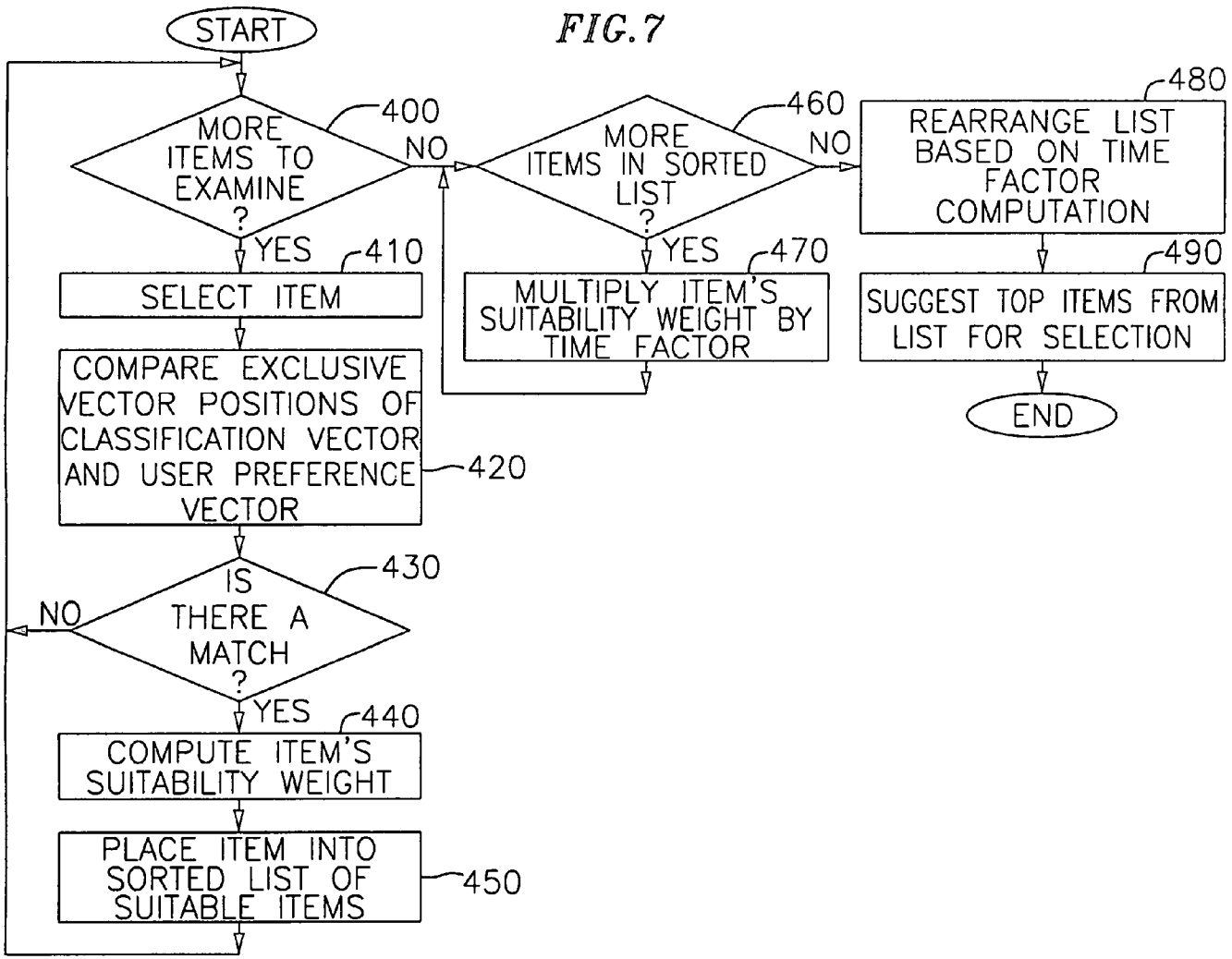
FIG. 7 is an exemplary flow chart of a process for determining if a particular item is suitable for recommendation according to an embodiment of the present invention.

FIG. 7 is a flow chart of an exemplary process engaged by the choice/update subsystem 38 for determining if a particular item in the recommendation database 16 is suitable for recommendation. Although the illustrated process describes the method of making recommendations based on one user preference vector, a person skilled in the art should recognize that the same process may apply to make recommendations based on multiple preference vectors or cluster vectors. Cluster vectors are described in further detail below.

The computer program, in step 400, inquires whether there are any items in the recommendation database 32 to examine for making a recommendation. If there are, the program, in step 410, selects an item from the recommendation database 32. In step 420, the program preferably compares the exclusive vector positions of the selected item's product vector against the exclusive vector positions of the user preference vector. A match is preferably determined to exist in step 430 if the exclusive positions of the selected item's product vector are set to the same values as the positions in the user preference vector. If one of the exclusive positions does not match, the item is preferably excluded from recommendation.

If all of the exclusive positions match, the rest of the positions in the product vector, that is, the inclusive positions, are used in step 440 to preferably calculate a suitability weight. The suitability weight preferably represents how well the item matches with the user's preferences. In the described embodiment, the vector distance between a product vector and the user vector preferably determines the suitability weight. The closer the vector distance, the higher the suitability weight. The vector distance is preferably calculated according to the following distance formula:

$$\sqrt{S1^2(Y1-X1)^2+S2^2(Y2-X2)^2+\ldots+Sn^2(Yn-Xn)^2}$$

where Y1, Y2, . . . , Yn are values in the fields of the user preference vector, X1, X2, . . . , Xn are values in the fields of the product vector, and S1, S2, . . . Sn are scaling coefficients. Each scaling coefficient is associated with a field in the user preference vector and/or the product vector, and is indicative of the degree of impact the attribute associated with the field has in defining a user's taste and/or a product's characteristic.

According to another embodiment, of the invention, the suitability weight is a scalar product of the inclusive fields of the user preference vector and the inclusive fields of the item's product vector, namely, S1X1Y1+S2X2Y2+ . . . +SnXnYn. A person skilled in the art should recognize that other known methods of calculating the suitability weight may also be utilized without departing from the spirit and scope of the present invention.

In step 450, a selected item is placed in a list of suitable items sorted according to their suitability weights, and the program loops back to step 400 to determine whether there are any more items to consider. The top items in the list of suitable items are, therefore, the items with a closest match to the user's preferences.

For certain items, it may be desirable to keep track of the recommended items actually sampled by the user, as well as when the sampling took place. For instance, in a recipe recommendation system, it may be desirable to keep a time factor attached to each sampled recipe to prevent recipes from being recommended too often. This helps to add variety to a user's menu. The time factor associated with each sampled recipe is preferably a value from zero to one, and is used to adjust the suitability weight calculated for a particular item. The system preferably remembers when an item was last used by storing the latest date on which the item was sampled. If the item was not used within a predetermined number of days, the time factor for the item is set to one. Otherwise, the time factor is set to a fraction of one based on the number of days since its last use. For example, for a system where the standard number of days is set to ten, an item that has not been used in the past ten days is assigned one as its time factor. On the other hand, an item that was used only five days ago it is assigned a time factor of 0.5.

According to this embodiment, the program asks in step 460 whether there are any more items in the sorted list of suitable items on which to perform a time factor calculation. If there are, the program, in step 470, multiplies the suitability weight of a current item in the list with its time factor. This process continues until the suitability weights of all the items in the sorted list have been recomputed based on their time factors. The list is then rearranged in step 480 based on the new calculations.

In step 490, the program recommends the top items from the sorted list. The actual number of items recommended is preferably predetermined by either the user or systems programmer. In recommending recipes, the top seven recipes may be recommended as the menu for an entire week. The system may also recommend wines likely to complement a recommended dish.

Figure 8:
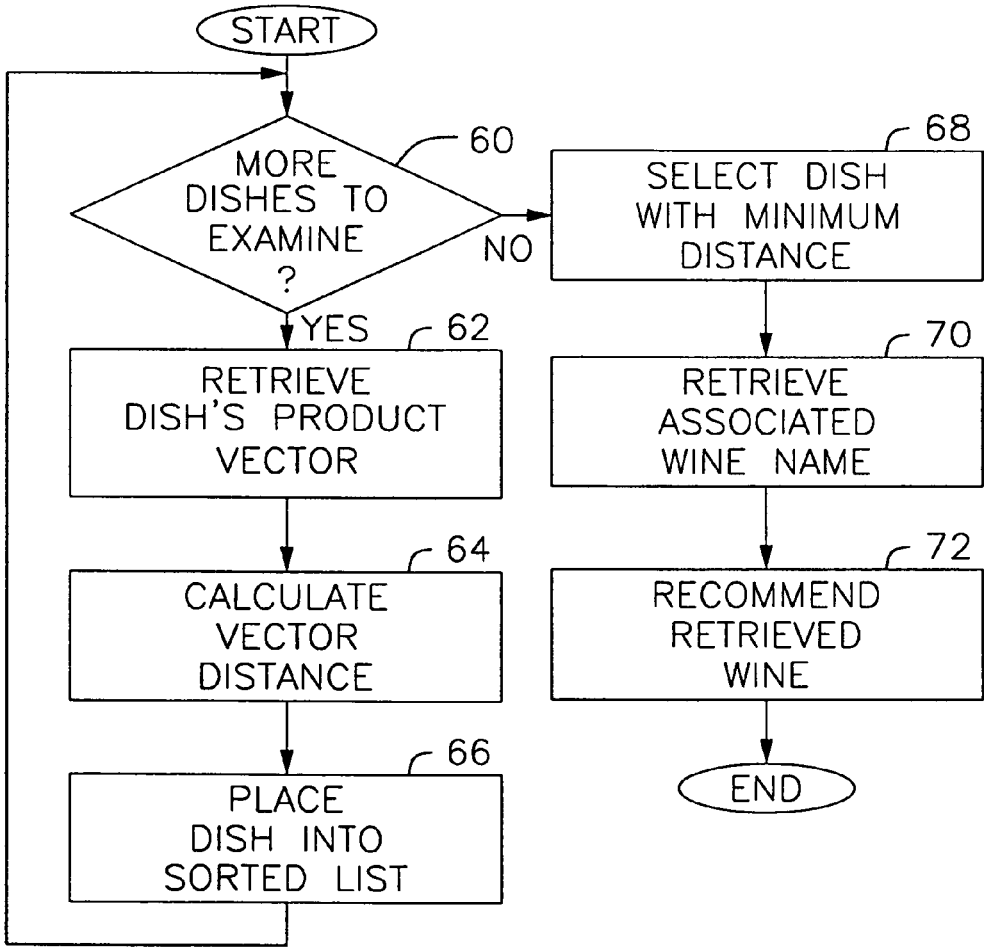
FIG. 8 is an exemplary flow chart of a process for recommending wines to complement a recommended dish.

FIG. 8 is a flow diagram of a computer program for recommending wines, in accordance with one embodiment of the invention. According to this embodiment, the system maintains a preset list of dishes along with the name of wines that best complements each dish. In making a wine recommendation, the program starts, and in step 60, inquires whether there are more dishes to examine in the preset list of wine dishes. If the answer is yes, the program proceeds to retrieve the product vector of a wine dish. This product vector is preferably stored in the recommendation database 32 (FIG. 2). In step 64, the program computes the vector distance between the wine dish's product vector, and the product vector of a dish that is recommended to the individual. In step 66, the program places the wine dish into a sorted list according to its vector distance. If all the wine dishes in the list have been examined and placed according to their vector distances, the program next selects, in step 68, a wine dish with preferably the smallest vector distance to the dish that is recommended to the user. In step 70, the program retrieves the wine name associated with the selected wine dish. The program, in step 72, then recommends the retrieved wine to the user, as complementing the dish that is recommended.

Figure 9:
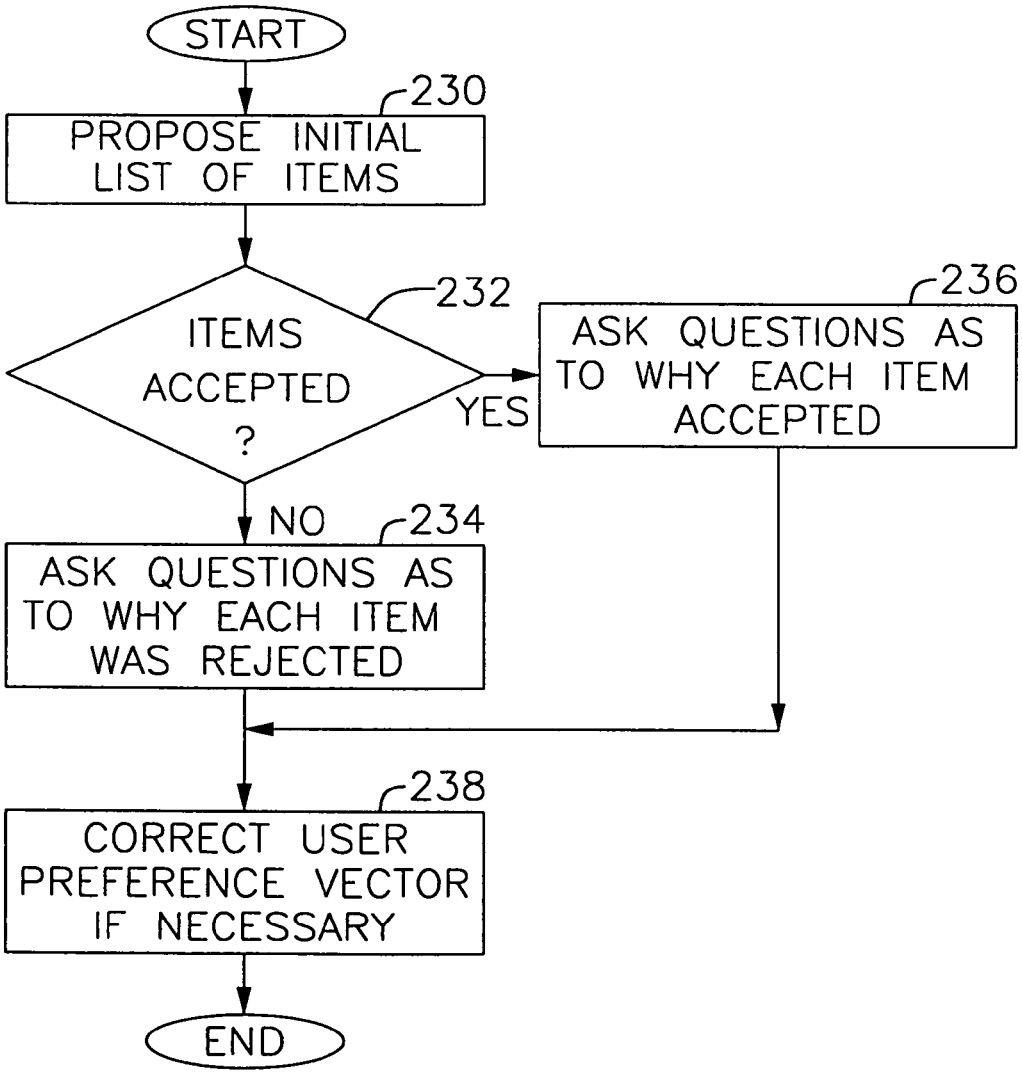
FIG. 9 is an exemplary flow chart of initial steps for learning and adapting to user preferences in accordance with an embodiment of the present invention.

As an individual uses the system over time, the system learns and adapts to the user's preferences. FIG. 9 illustrates the initial learning and adaptation process according to one embodiment of the invention. In step 230, the program proposes an initial list of items to the user. In step 232, the user either accepts or rejects the recommended items. If the items are rejected, the program in step 234 preferably asks feedback questions to ascertain why the items were rejected. Similarly, if the items are accepted, the program in step 236, preferably asks questions to ascertain why each item was accepted. In step 238, the user preference vector 75 is updated, if necessary, and used for future choices. For instance, if a recommended recipe was rejected because it was too spicy, the value in the spiciness field of the user preference vector might be decreased. As a user uses the system over time, the recommendations become more and more accurate and feedback from the user becomes less and less required. In this case, the system may no longer require this type of initial feedback from the user.

Figure 10:
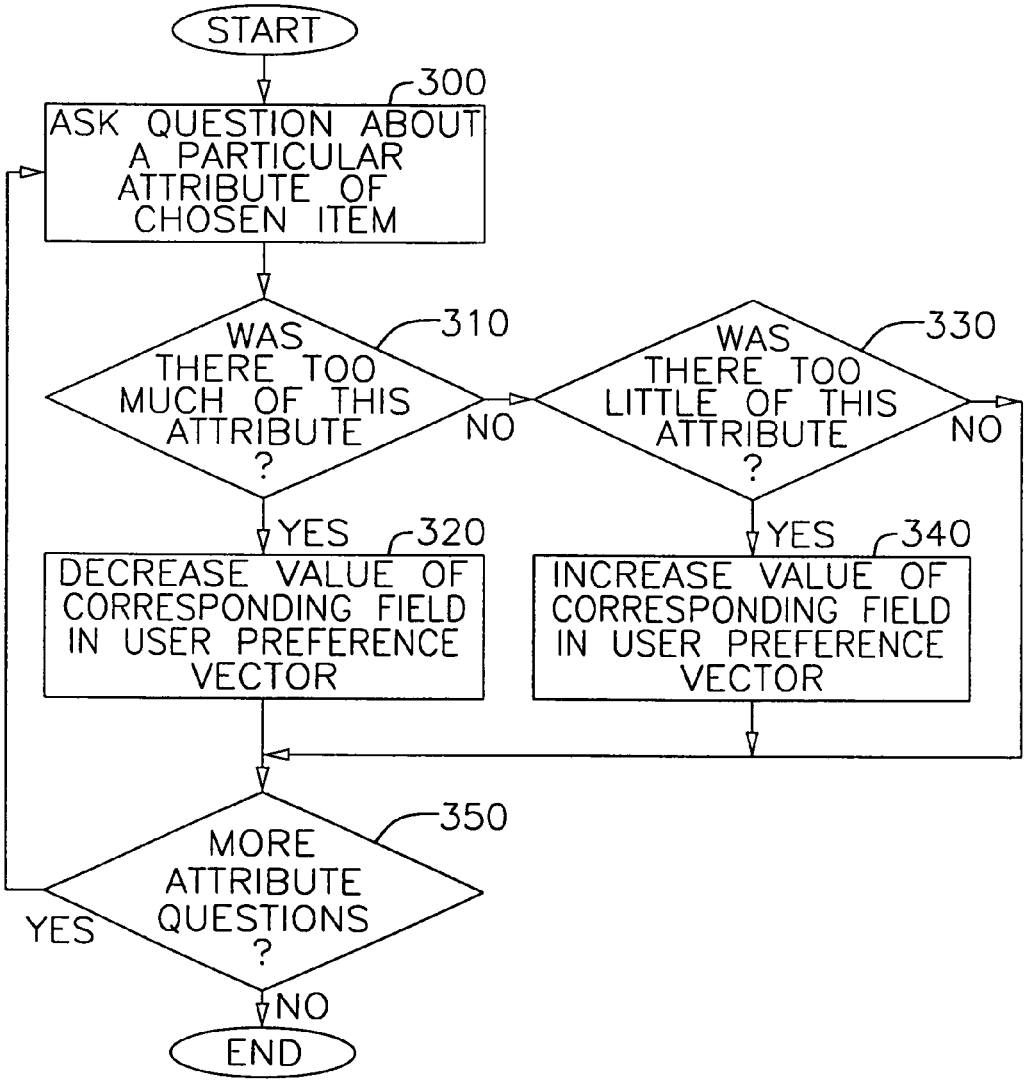
FIG. 10 is an exemplary flow chart of steps for updating a user preference vector based on a sampled item.

FIG. 10 illustrates the process of obtaining feedback from the user for further updating a preference vector after the user has actually sampled a recommended item. The computer program begins and in step 300 asks a question about a particular attribute of the sampled item. Examples of such questions for a system recommending CDs include: "What rating would you give to the recommended CD?"; "What did you like most? Tempo? Instruments? Lyrics?"; and "What did you dislike about the CD?" Examples of questions for a system recommending recipes might include: "What rating would you give to the recommended meal?"; "What did you like most? Taste? Amount of preparation required?"; "Which ingredients did you like or dislike?"; "How should the meal have been changed? Less salty? Lighter?"; and "Was there enough food?"

Based on the user response, the program in step 310 determines whether there was too much of the inquired attribute in the recommended item. If there was, the value in the user's preference vector corresponding to that attribute is decreased in step 320. Likewise, if the program determines in step 320 that there was too little of the inquired attribute in the recommended item, the value in the user's preference, vector corresponding to that attribute is increased in step 340. For example, if the songs in a recommended CD were too slow, the value of the field in the user preference vector 75 representing the individual's preference for slow music is decreased below the value in the corresponding field of the CD's product vector. If a recommended recipe was too salty, the value of the field in the family food preference vector representing the family's preferred saltiness is decreased below the value in the corresponding field of the recipe product vector.

In an alternative embodiment, a user preference vector modification and/or creation may be done by keeping track of items purchased by a user. According to this embodiment, the system keeps a track of the user's purchase pattern, and creates or updates a preference vector for that user based on such pattern. For instance, if one of the fields in the preference vector represents a user's preference for spicy food, a value may be set for that user based on a study of the user's purchase of items such as chili peppers and hot sauce. This may be accomplished by having a user use a customer card every time he or she visits the store to keep record of the user's purchases. A recommendation system within the store may then make recommendations about items in the store based on the individual's preference vector. Recommendations may be displayed on the customer's shopping cart while he or she is shopping. Alternatively, the store may place the recommendation system at an easily accessible location, such as at the entrance of the store, where a user may get a recommendation prior to shopping.

In addition to updating the user preference vector, ratings of products sampled by the user are preferably used for making recommendations in the future. The system creates a positive cluster vector if a recommended item is given a high rating. For instance, a positive cluster vector might be created for an item if given a rating of 4 or above, in a scale of 0 to 5. The system also creates a negative cluster vector if a recommended item is given a low rating. For instance, a negative cluster vector might be created for an item if it is given a rating of 2 or below. Either cluster vector, when first created, includes the fields and values of the product vector which was given the high or low rating.

The system preferably maintains a maximum number of positive clusters and negative clusters. Thus, in a system where a maximum of five positive clusters is allowed, the system creates a positive cluster vector for the first five items which are given a high rating. If a user, gives a high rating to a recommended item after the five positive clusters have been created, the product vector for the new item is merged into one of the existing positive clusters.

According to a preferred embodiment, the system merges a new product vector into an existing cluster by calculating the vector distance to the closest product already belonging to the cluster. The system then selects the cluster with the least vector distance to the new product as the cluster to which the new product is to be merged. During the merging step, the system examines the values stored in vectors already inside the cluster and the new product vector, computes an average value for each vector field, and updates the values in the cluster vector to the computed average values. Thus each cluster contains one or more products with the cluster vector reflecting average values of the products in the cluster.

According to one embodiment of the invention, the user preference vector reflects the average value of each field stored in all the positive clusters. In an alternative embodiment, the system creates a separate average cluster vector for each positive cluster reflecting the average values of all the products in each cluster. During a recommendation process, the system not only uses the user preference vector, but also the average cluster vectors, in making recommendations. For instance, the system may list four items which match the user preference vector, and three items that match an average cluster vector. In this way, the chances that at least some of items recommended, namely, the items recommended based on the average cluster vector, will be to the user's liking.

Order Subsystem

Referring back to FIG. 2, the system's order subsystem 40 allows the system to receive and process on-line purchase requests from the user. In a menu recommendation system, ingredients in recipes recommended by the system are automatically inserted into a shopping list and submitted to one or more retailers for purchase. In this regard, the system displays a recommended meal list and automatically creates a shopping list of the ingredients necessary to prepare the recommended dishes. The user reviews the meal list and the shopping list, and submits the shopping list for purchase of the ingredients. Thus, the user need no longer expressly create a shopping list with the ingredients necessary to make the dishes by manually finding and selecting each individual ingredient. The described approach further utilizes different levels of abstraction to help expedite the shopping process. The displayed meal list is preferably an abstraction of the particular ingredients contained in the dishes and displayed in the shopping list. The user may choose to review a generally much shorter meal list, and simply skim the numerous ingredients in the shopping list with an assumption that the correct ingredients are included in this latter list.

Preferably, the recommended meal and shopping lists are pushed to the user, eliminating the need for the user to expressly request the lists every time he or she needs them. For instance, the lists may be automatically created and transmitted to the user via e-mail or fax, on a periodic basis, such as; for example, on a weekly basis. The lists may also be presented to the user on smart appliances, such as smart refrigerators, also on a periodic basis. In this scenario, the smart refrigerator preferably includes an input, output, memory, and processing capabilities for creating and/or displaying the lists. The smart refrigerator may also determine the ingredients already present in the refrigerator and/or home inventory database 33, and include ingredients into the shopping list that are not already available to the user.

As another example, the recommended meal and shopping lists may be displayed on the user's shopping cart while he or she shops at a local store. Alternatively, the user may access the lists through a kiosk within the store prior to the beginning of the shopping process. A person skilled in the art should recognize that other conventional devices known in the art may be used for presenting and pushing information to the user, such as, for instance, pagers, portable devices, personal digital assistants, web pages, and the like.

Figure 38:
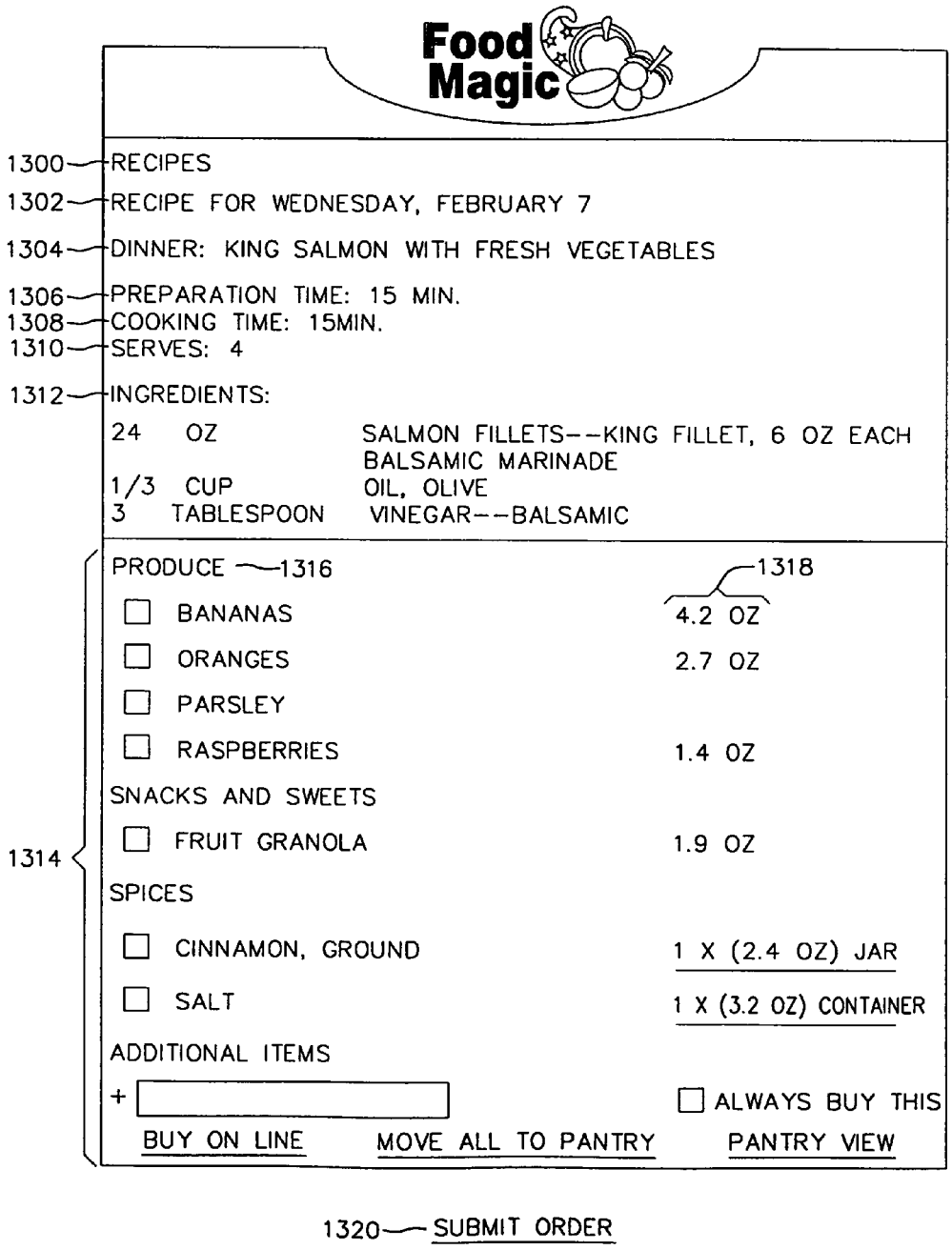
FIG. 38 is an exemplary e-mail for recommending a meal and allowing the user to purchase ingredients associated with the meal according to one embodiment of the invention.

FIG. 38 is an exemplary e-mail for recommending a meal and allowing the user to purchase ingredients associated with the meal. The e-mail is preferably transmitted by the network server or platform computer 10 via the Internet connection 12. The e-mail is preferably received by the user and viewed on a display monitor/screen of the user's personal computer 14, television 16, HPC 20, or the like.

Preferably, the e-mail includes one or more recipes 1300, each of which may be associated with a particular date 1302 and a type of meal 1304 for which it is recommended. The e-mail may further include information about the preparation of the recipe, such as its preparation time 1306, cooking time 1308, and/or serving size 1310. Also included in the e-mail is a list of ingredients needed for preparing the recipe 1312, preparation instructions (not shown), and/or an image of the prepared dish (not shown).

The e-mail preferably further includes a shopping list 1314 of the ingredients needed to prepare the recommended dishes. The shopping list may be organized based on various food categories 1316, and preferably indicates a quantity or size 1318 required for preparing the recommended dishes. Preferably, the quantity or size 1318 for a particular ingredient is an aggregate of the amount required for all the recipes recommended to the user.

According to one embodiment of the invention, the user may select certain ingredients in the shopping list 1314 that are to be removed or excluded from the shopping list. This may be desirable if, for instance, the user already has the particular ingredient and need not be repurchased. According to another embodiment of the invention, the removal process is automatic. In this scenario, the ingredients in the recommended dishes are compared against the ingredients in the home inventory database 33 (FIG. 2) for identifying ingredients that need not be purchased. These ingredients are then removed or excluded from the shopping list.

In a further aspect of the invention, the e-mail displays a list of previously recommended meals, and requests feedback about the user's satisfaction about the recommendations. For instance, the user may provide a rating for each meal that was recommended and tasted by the user. This information is preferably used by the choice/update subsystem 38 for modifying the user preference vector to more closely reflect the user's preferences.

The e-mail preferably includes a link 1320, such as, for example, a hyperlink, that the user may actuate to submit an order for the accepted ingredients in the shopping list 1314. A person skilled in the art should recognize, however, that the hyperlink 1320 may be replaced by a radio button, an icon, a menu entry, or any other mechanism for indicating the acceptance of the displayed meal list 1110. For example, a user may select a pre-defined button on a remote control unit to indicate his or her acceptance of the meals. In another example, the user may indicate the acceptance via voice command, e-mail, or the like.

Figure 39:
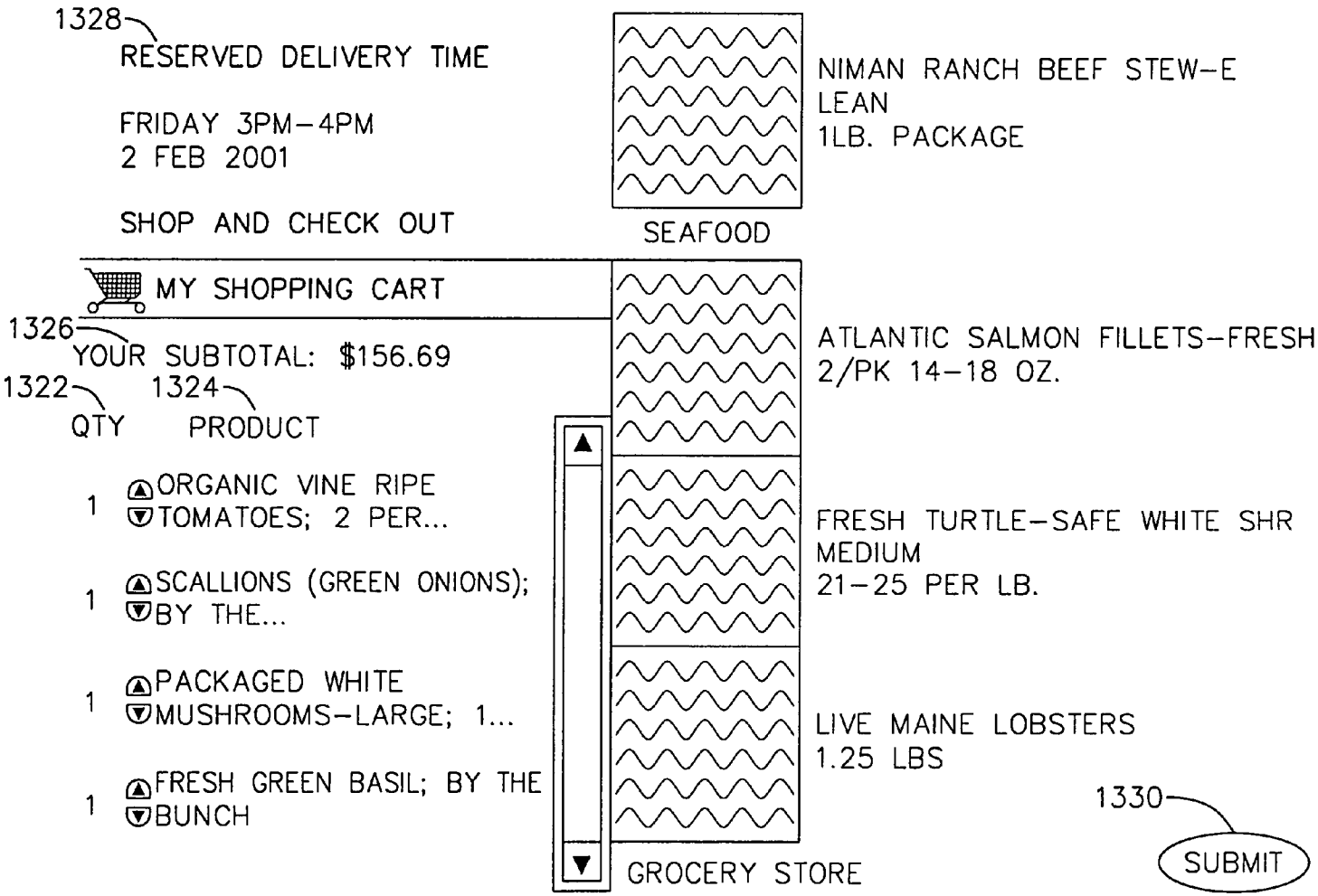
FIG. 39 is an illustration of an exemplary electronic shopping cart according to one embodiment of the invention.

Actuation of the link 1320 causes a display of an electronic shopping cart including the accepted ingredients from the shopping list. FIG. 39 is an illustration of an exemplary electronic shopping cart according to one embodiment of the invention. The shopping cart preferably includes an amount 1322 and a description 1324 of each ingredient in the cart. The shopping cart may further include the price of the individual ingredients as well as a running total 1326 of all the items in the shopping cart.

According to one embodiment of the invention, the user may specify during setup that he or she would like to receive recommendations for other products, such as CDs, movies, books, and the like, along with the meal recommendations. For example, the user may belong to a CD-of-the-month-club where he or she purchases a new CD each month. According to this example, the shopping cart may automatically include a new CD for the user's purchase, selected based on the user's music preferences.

Upon actuation of a submit button 1330 by the user, the items in the shopping cart are processed for purchase. Preferably, the items purchased are delivered to the user based on a particular delivery time 1328 reserved for the order.

Figure 40:
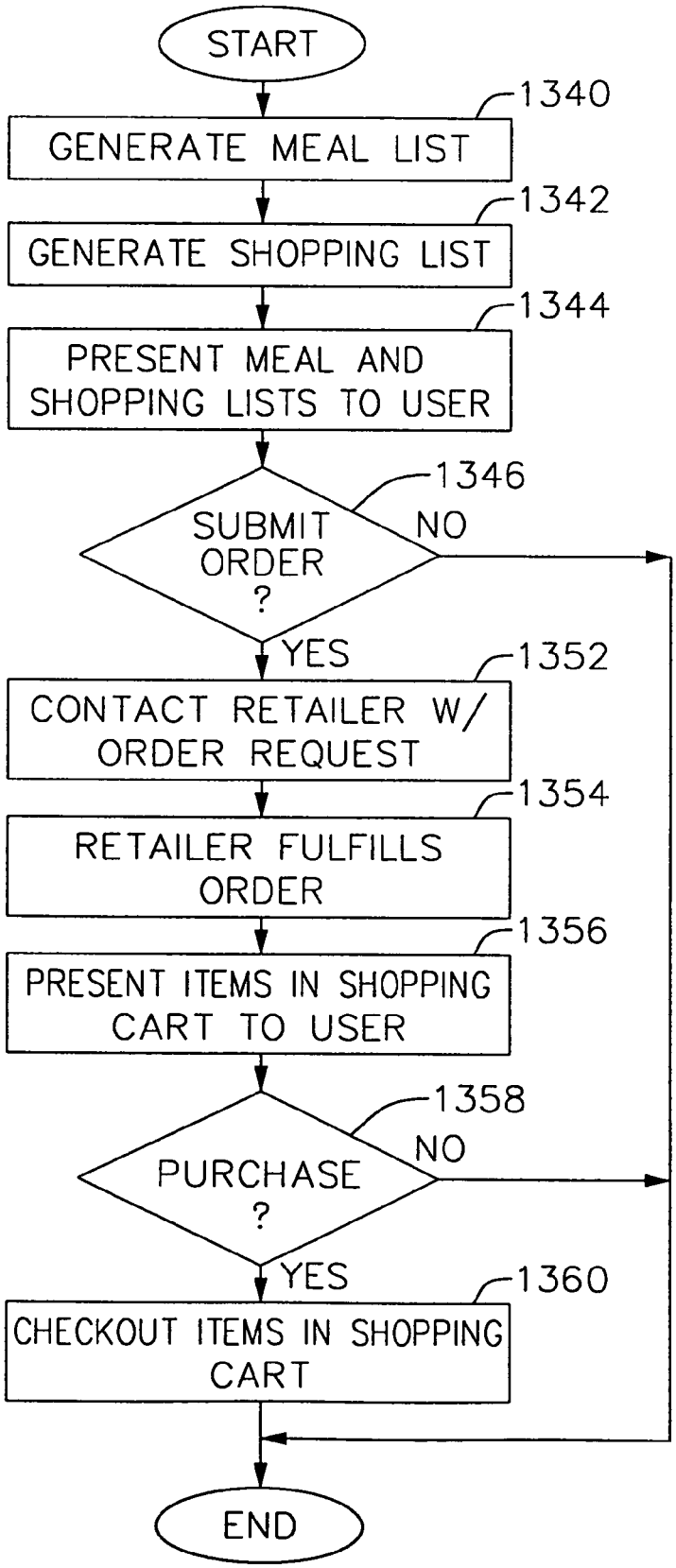
FIG. 40 is an exemplary flow diagram of a process for creating and submitting an electronic shopping list according to one embodiment of the invention.

FIG. 40 is an exemplary flow diagram of a process for creating and submitting an electronic shopping list according to one embodiment of the invention. The process starts, and in step 1340, the choice/update subsystem 38 generates a meal list, preferably, based on the preferences of the user. In an alternative embodiment, the meals are selected from a group of recipes that the user has indicated to be among his or her favorites. In yet another embodiment, the meals are selected based on a combination of user preference information and favorite food information.

In step 1342, the choice/update subsystem 38 generates and displays a shopping list including the ingredients necessary to prepare the accepted meals. The ingredients are preferably retrieved from the product records 54 in the recommendation database 32 for the corresponding meals.

In step 1344, the choice/update subsystem 38 presents the meal and shopping lists to the user via, for example, an e-mail message. In step 1346, the order subsystem 40 determines if an order is to be submitted to a retailer with the ingredients in the shopping list. In this regard, the order subsystem 40 determines if it has received an indication from the user to submit the accepted items in the shopping list for purchase. If it has, the order subsystem 40 contacts a retailer in step 1352 with an order request. The order request may include a customer identifier for the user, as well as information on the items to be purchased. The order is preferably submitted to the retailer over the Internet connection 12. Alternatively, the order may be submitted via telephone, fax, or other known communication device.

The retailer receiving the order may be a default retailer selected by the system, or a particular retailer selected by the user. The order may also be submitted to multiple retailers instead of only one. In an alternative embodiment, the fulfillment of the order is done by the system itself, and not submitted to a separate retailer.

If the retailer receives the order request, the retailer proceeds to fulfill the order in step 1354. In this regard, the retailer preferably uses the customer ID to retrieve information about the customer from a customer database. The retrieved information may include the user's name, shipping address, billing address, payment method, and the like. The retailer further searches a retailer database for the ingredients specified in the order. In its simplest form, the retailer database includes a product lookup table including information on products available for sale. Such information may include each product's SKU or UPC code, generic and/or brand name information, price, description, quantity/size, availability information, image, and/or the like. The ordered ingredients are then inserted into the user's electronic shopping cart.

In step 1356, the items in the shopping cart are presented to the user. Preferably, this is achieved by establishing a connection between the user and the retailer's server 26, and displaying the shopping cart at the retailer's website. In step 1358, the retailer's server 26 determines whether the user has indicated that the items in the shopping cart are to be purchased. If the answer is YES, the retailer's server 1360 proceeds to complete the purchase transaction by performing a checkout of the items in the shopping cart. The purchased items are then preferably delivered to the user based on the reserved delivery time.

In an alternative embodiment of the invention, the creation and submission of the shopping list is preferably a two step process from the user's point of view. As a first step, the user preferably accepts a meal list including one or more dishes recommended by the system. This preferably causes a creation of a shopping list including the ingredients necessary for making the dishes. As a second step, the user preferably accepts the displayed shopping list, causing it to be submitted for purchase.

Figure 41A:
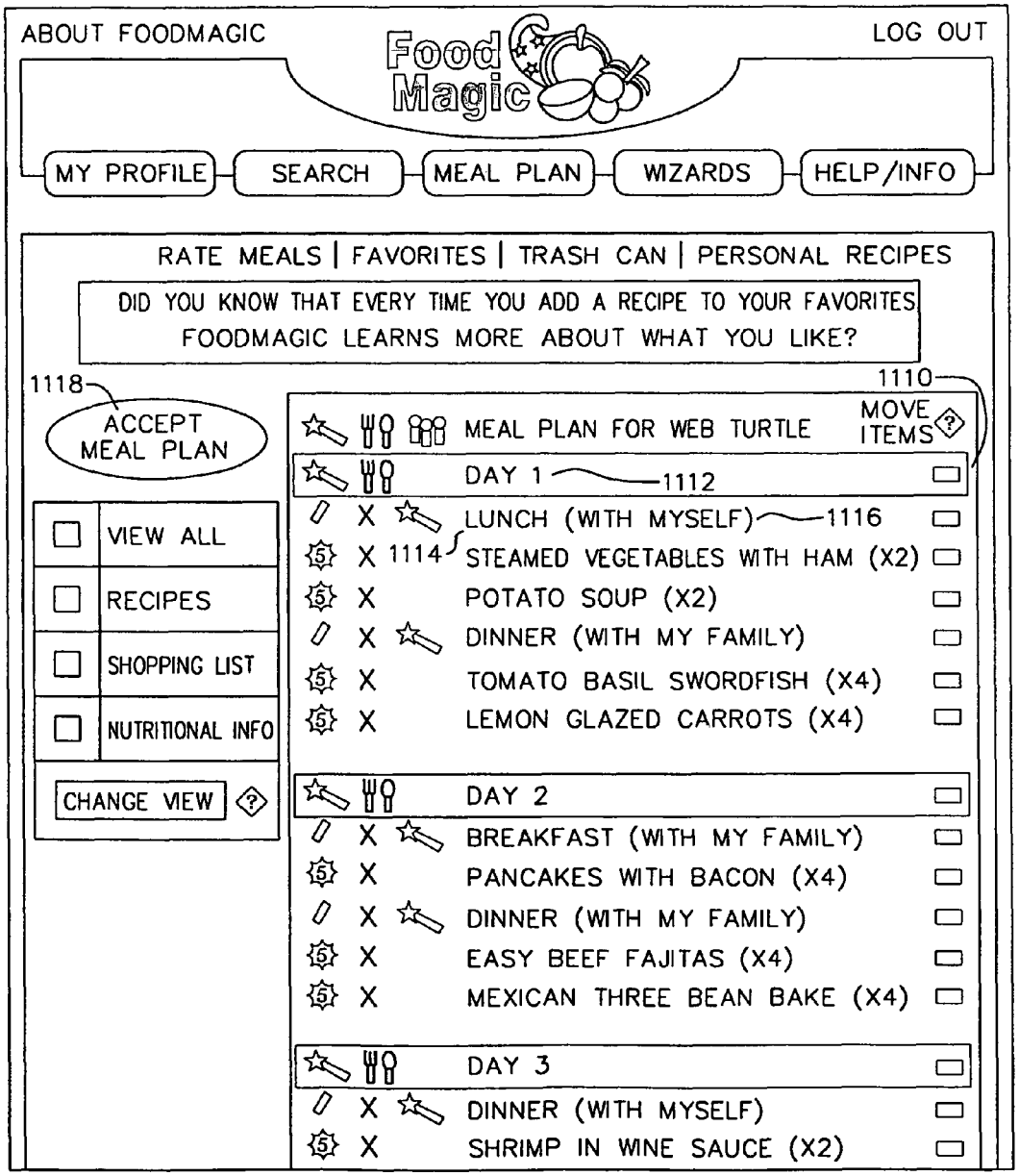
FIGS. 41A-41B are exemplary GUIs for allowing the creation of an electronic shopping list according to a two step process.
Figure 41B:
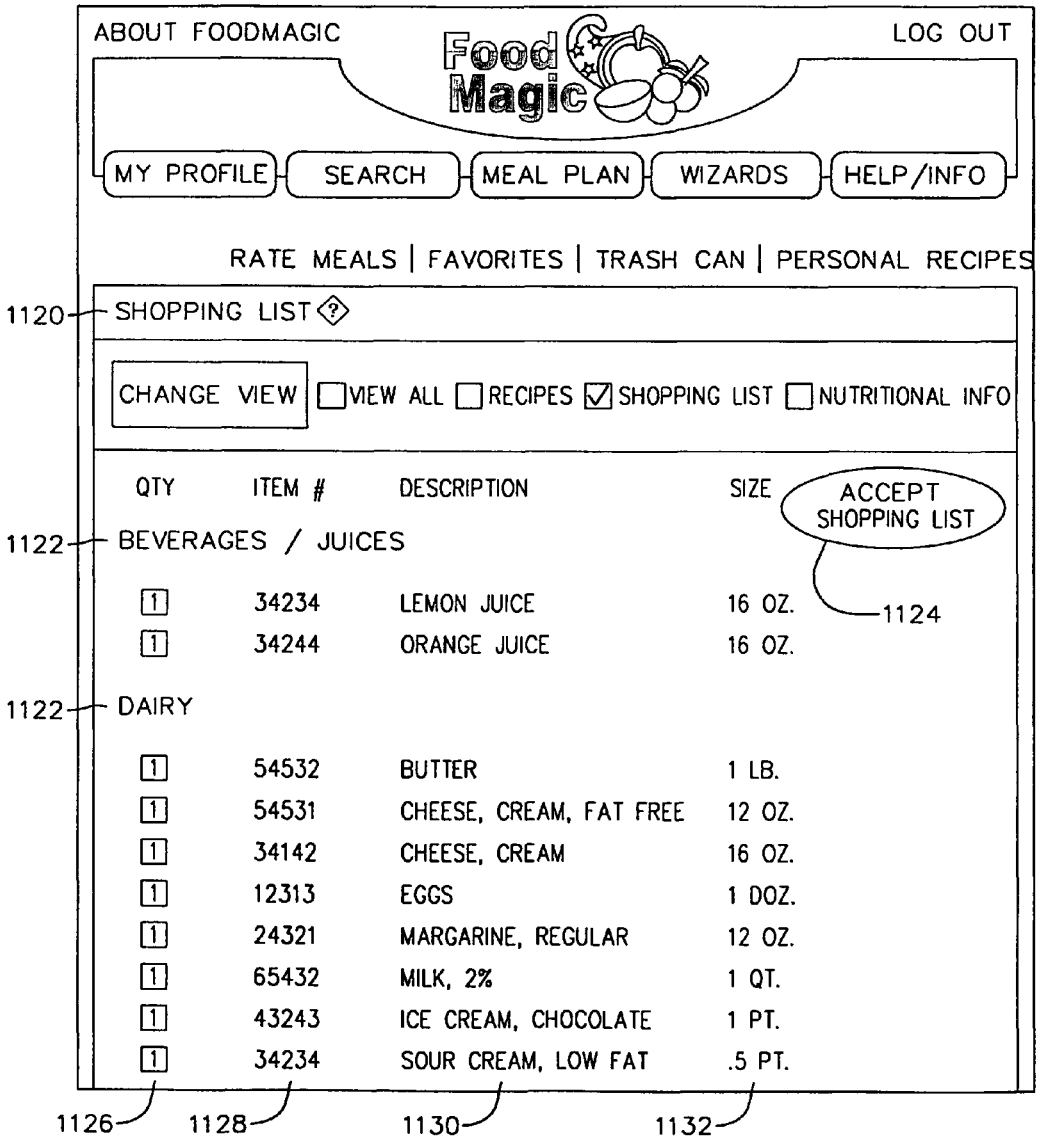

FIGS. 41A-41B are exemplary GUIs for allowing the creation of a shopping list according to the above-described two-step process. The GUI displays a meal list 1110 including meals recommended for the user for different days 1112. According to one embodiment of the invention, the days may be specified by a specific date and/or day of the week. Preferably, the meals are also associated with a particular meal type 1114 (e.g. breakfast, lunch, dinner), and the type and/or number of people 1116 to share the meal.

The GUI preferably includes a radio button 1118 that the user may actuate to indicate acceptance of the recommended meal list. A person skilled in the art should recognize, however, that the radio button 1118 may be replaced by an icon, box, menu, or any other mechanism that allows acceptance of the displayed meal list 1110. For example, a user may select a pre-defined button on a remote control unit to indicate his or her acceptance of the meals. In another example, the user may indicate the acceptance via voice command.

Actuation of the radio button 1118 causes the GUI to display a shopping list 1120 of ingredients necessary to prepare the recommended dishes. The shopping list may be organized based on various food categories 1122, and preferably indicates a quantity 1126, item number 1128 (e.g. SKU or UPC number), description 1130, and size 1132 of the item to be purchased. The user may modify the quantity 1126 of a particular ingredient to be purchased if so desired. For instance, the user may set the quantity of a particular ingredient to 0 if it is not to be submitted for purchase. The shopping list may also include additional information that a user may want to know prior to accepting the shopping list, such as brand name and price information for each item.

The user preferably indicates acceptance of the shopping list by actuating another radio button 1124 provided by the GUI. The acceptance information is preferably transmitted to the order subsystem 40 via the Internet connection 12. Upon receipt of the acceptance information, the order subsystem 40 proceeds to create an order request including the accepted ingredients on the shopping list, and submit the order request to one or more retailers for fulfillment. The order request is preferably also transmitted via the Internet connection 12. Alternatively, the order request is transmitted via fax, telephone, or any other communication medium known in the art.

Figure 42:
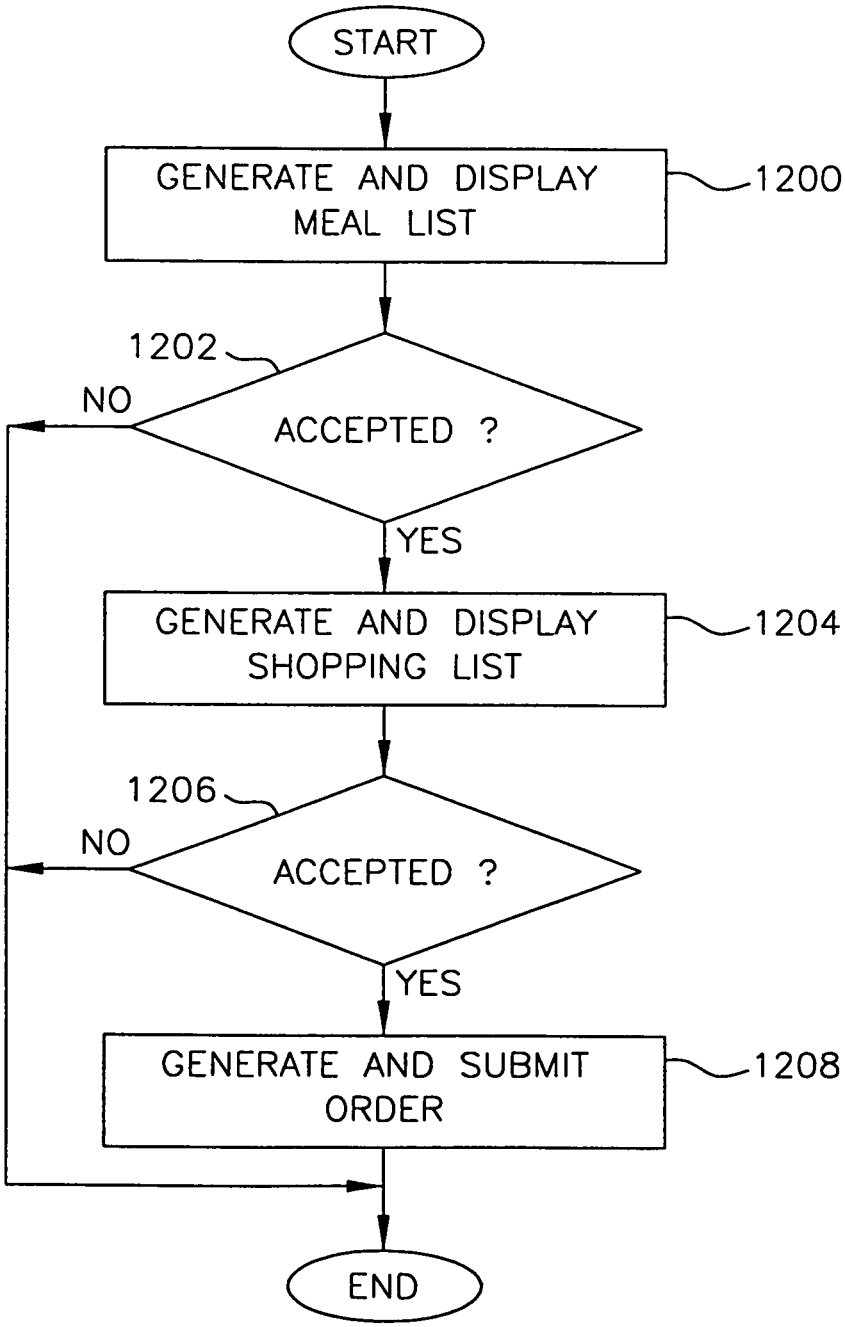
FIG. 42 is an exemplary flow diagram of a process for creating and submitting an electronic shopping list according to the embodiment illustrated in FIGS. 41A-41B.

FIG. 42 is an exemplary flow diagram of a process for creating and submitting an electronic shopping list according to the embodiment illustrated in FIGS. 41A-41B. The process starts, and in step 1200, the choice/update subsystem 38 generates a meal list and displays it on the display monitor/screen of the user's personal computer 14, television 16, HPC 20, or the like. Preferably, the meals on the list are recommended based on the preferences of the user. In an alternative embodiment, the meals are selected from a group of recipes that the user has indicated to be among his or her favorites. In yet another embodiment, the meals are selected based on a combination of user preference information and favorite food information.

In step 1202, the order subsystem 40 determines whether the user has indicated acceptance of the meal list. If the meal list has been accepted, the order subsystem 40 generates and displays, in step 1204, a shopping list including the ingredients necessary to prepare the accepted meals. The ingredients and related information are preferably retrieved from the product records 54 in the recommendation database 32 corresponding to the accepted meals. The related information, such as item number, price, brand name, and the like, may alternatively be obtained from a retailer's database via the Internet connection 12.

In step 1206, the order subsystem 40 determines whether the user has indicated acceptance of the ingredients in the shopping list. If the ingredients have been accepted, the order subsystem 40 proceeds to generate and submit an order request for purchase of the accepted ingredients. In this regard, the order subsystem 40 retrieves information about the user from preferably the user preference database 30. The user information may alternatively be stored in a separate database (not shown) hosted by the network server or platform computer 10. The user information preferably includes the user's name, shipping address, billing address, payment method, and the like. According to one embodiment of the invention, the order request is submitted to one retailer or divided among various retailers. The user may also specify the retailer(s) to fulfill the order as part of his or her user information.

The order request is preferably transmitted over the Internet connection 12. Alternatively, the order request is transmitted to the retailer(s) via telephone, fax, or other known communication device. Upon receipt of the order request, the retailer fulfills it and delivers the purchased ingredients directly to the user. Alternatively the retailer may wait for the user to pick-up the ingredients.

Figure 43:
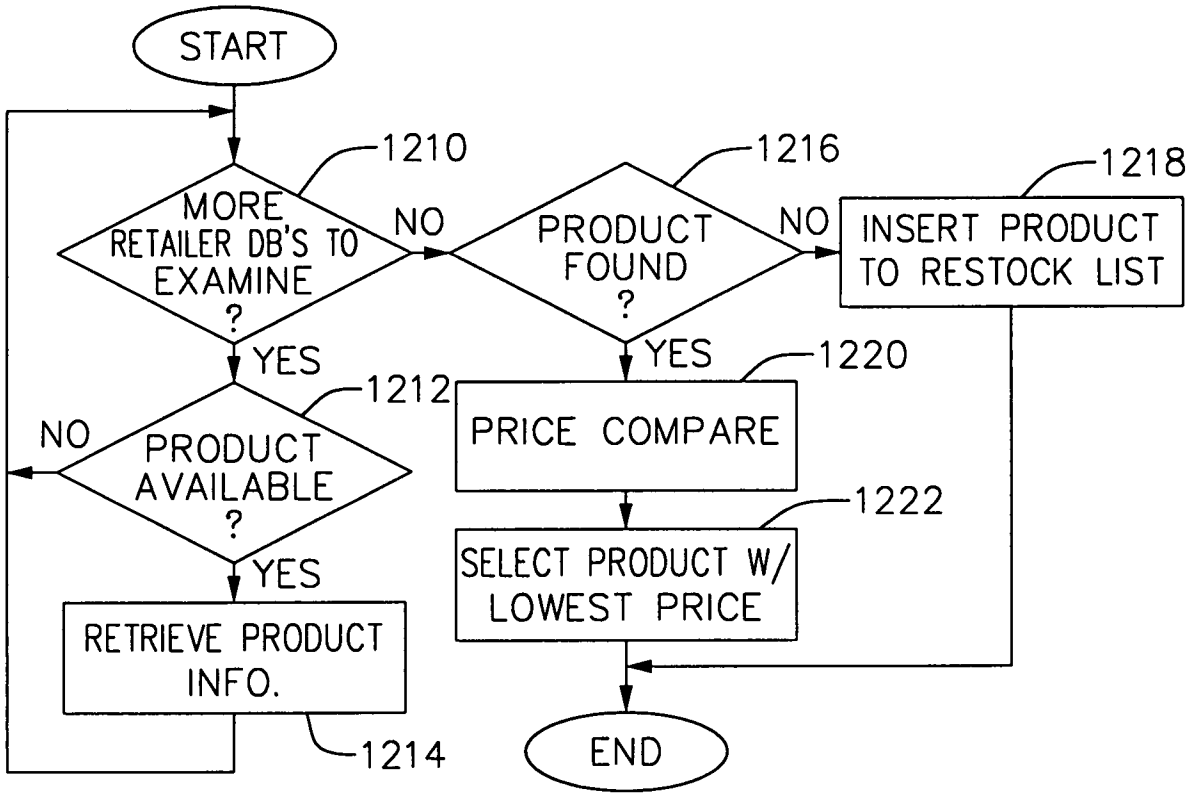
FIG. 43 is a more detailed flow diagram of the step for generating and displaying a shopping list according to one embodiment of the invention.

FIG. 43 is a more detailed flow diagram of the step for generating and displaying a shopping list according to one embodiment of the invention. According to the embodiment illustrated in FIG. 43, the retailer or retailers offering the lowest prices for the ingredients are selected as the recipients of the order request. In this regard, the process starts, and in step 1210, the order subsystem 40 determines whether there are more retailer databases to examine. Such retailer databases are preferably hosted by the retailer's network server 26 or personal computer 28, and are accessible to the order subsystem 40 over the Internet connection 12. In its simplest form, each retailer database includes a product lookup table including information on products available for sale. Such information may include each product's SKU or UPC code, generic and/or brand name information, price, description, quantity/size, and/or availability information.

If there is a retailer database to examine, the order subsystem 40 examines the database to determine, in step 1212, if the product is available for sale. To make this determination, the order subsystem preferably searches the product lookup table for an entry for the product. If the product is available for sale, all or a portion of the information for the product stored in the product lookup table is retrieved, and the process returns to step 1210 for determining whether other retailer databases need to be examined.

If all the retailer databases have been examined, the process determines in step 1216 if the product was found in any of the examined databases. If the answer is NO, the product is inserted into a restock list in step 1218, and submitted to the retailers. If the answer is YES, the order subsystem 40, in step 1220, compares the price for the product offered by each of the retailers. In step 1222, the order subsystem 40 selects a retailer offering the lowest price for submitting the order for the product.

Figure 44:
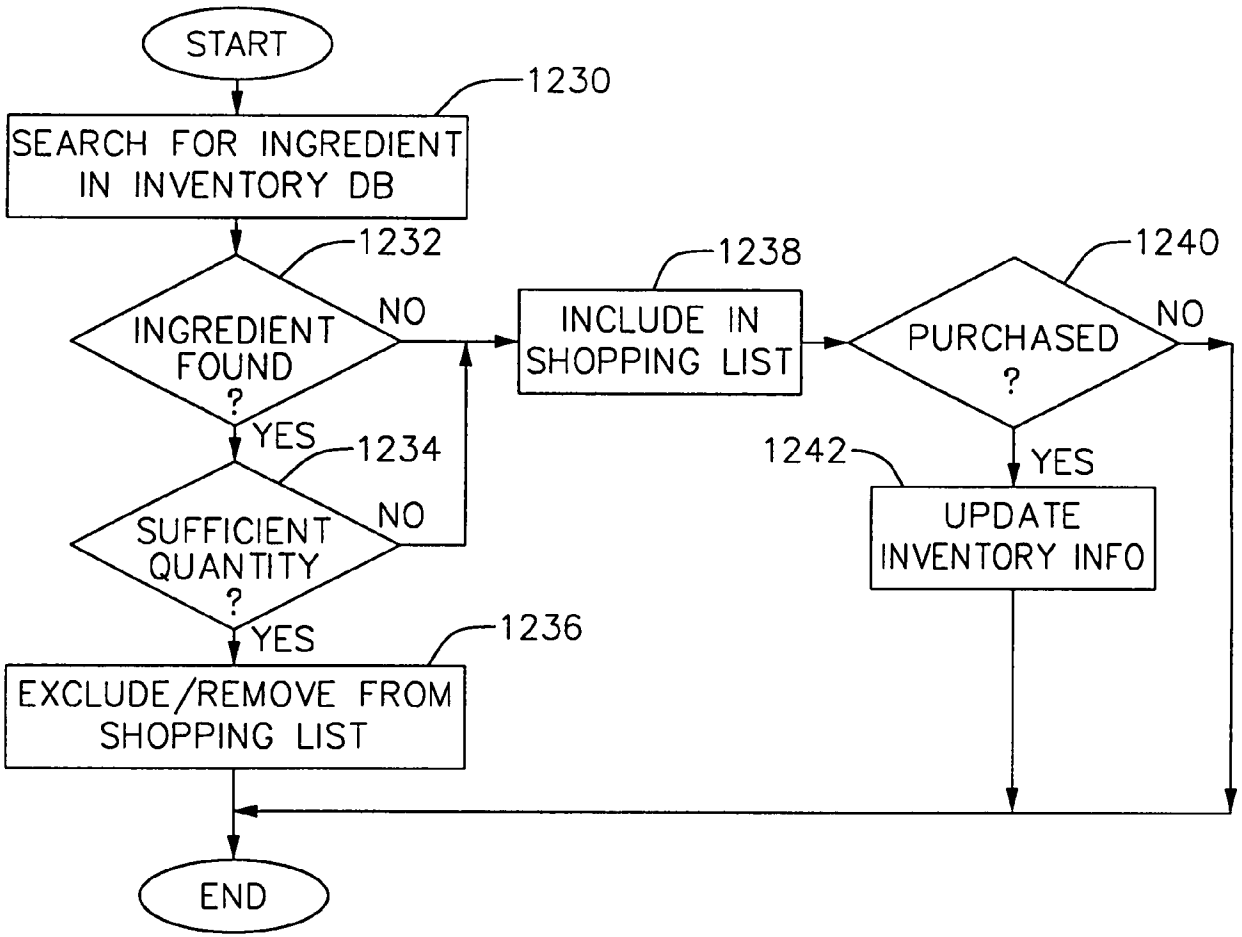
FIG. 44 is a flow diagram of a process for determining whether an ingredient should be excluded from an electronic shopping list.

According to one embodiment of the invention, the order subsystem 40 automatically excludes or removes an ingredient from the shopping list based on prior purchase and availability information. FIG. 44 is a flow diagram of a process for determining whether an ingredient should be excluded from the shopping list. The process starts, and in step 1230, the order subsystem 40 searches the home inventory database 33 for the particular ingredient. In step 1232, a determination is made as to whether the ingredient has been found. If it has, the order subsystem 40 inquires if the quantity required by the recommended recipes is available. If it is, the ingredient is excluded or removed from the shopping list.

If the ingredient is not found in the home inventory database 33, or the amount available is not sufficient for preparing the recommended recipes, the ingredient in step 1230, is included or maintained in the shopping. In step 1240, the order subsystem 40 determines if the product was in fact purchased. If the answer is YES, the inventory information in the home inventory database 33 is updated to add the purchased item.

Figure 11:
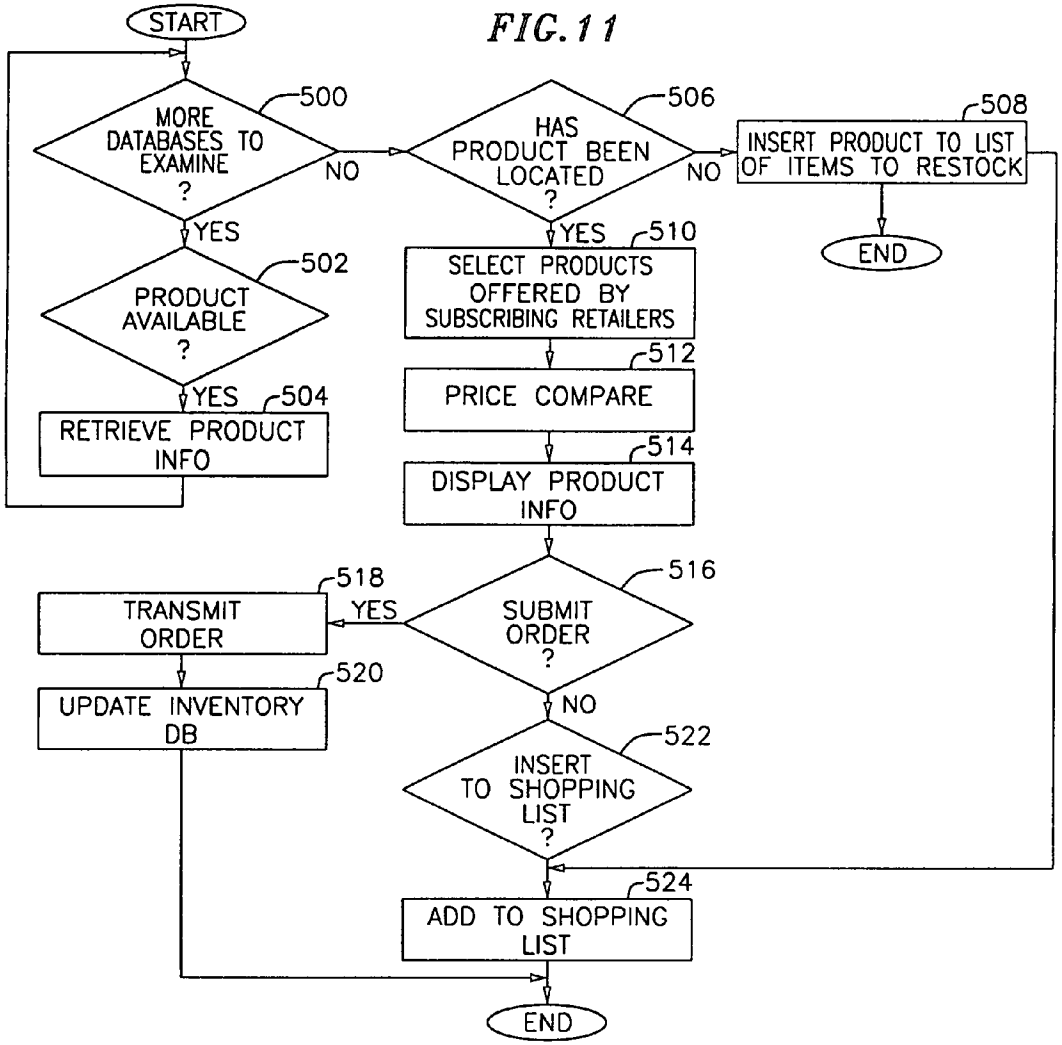
FIG. 11 is an exemplary flow chart of a process undertaken by an order subsystem once a user selects a product which he or she may want to purchase.

In another embodiment of the invention, the user is given the option to manually create the shopping list, and it is not automatically created based on recommended items. FIG. 11 is an exemplary flow diagram illustrating the process undertaken by the order subsystem 40 once a user selects a product which he or she may want to purchase. The computer program starts and inquires in step 500, whether there are any more retailer databases to examine for determining the availability of the product. The program, in step 502, examines the retailer database for availability of the selected product. If the product is found, the program retrieves the product information in step 504.

If all the retailer databases have been examined, the program inquires in step 506 if any products have been located. If the product was not located, the program, in step 508, inserts the product to a list of items to restock.

If the product was found in more than one retailer database, the program, in step 510, selects the product offered by a sponsor of the system. Furthermore, if, among the sponsor retailers, one retailer offers the product at a cheaper price than the other, the program, in step 512, selects the retailer offering the cheaper product. Alternatively, the program may select a retailer paying the higher sponsorship fee. The retailer and product information in the retailer database is then displayed in step 514.

In step 516, the program inquires whether the user wants to purchase the product from any of the listed retailers. If the answer is YES, the system, in step 518, transmits a submit order to the selected retailer and updates that retailer database in step 520 to reflect the purchase. The updating process may be manual or automatic.

If the user is not comfortable in submitting a request over the network, the program inquiries in step 522 whether to insert the item into the user's shopping list. If the answer is YES, the item is inserted in step 524. In doing so, the program inserts the brand name of the item offered by one of the sponsors of the system. The list may be printed by the user for his or her next shopping trip. The item is also inserted into the user's shopping list if the item is not available in the retailer database.

Inventory Control Subsystem

In a recipe recommendation system, the individual user's personal computer 14, set-top box 18, or HPC 20 (FIG. 1) optionally includes an inventory control subsystem which keeps track of ingredients used for meal preparations. According to this embodiment, the personal computer 14, set-top box 18, or HPC hosts a home inventory database 33 storing an inventory table of ingredients available at the user's home. Each entry in the table specifies a UPC code for the ingredient, amount available, and expiration date. New items can be automatically or manually added to the database. For instance, every time a grocery item is ordered via the Internet, the inventory control subsystem automatically inserts the ordered item into the inventory table. Alternatively, the update may be made when the goods are actually delivered to the user. In this scenario, the individual uses a bar coder reader to manually scan the UPC code on the goods delivered. The information may also be keyed into the subsystem via the keyboard or touch screen display.

Update to the inventory table is made each time a recommended recipe is selected for cooking. For example, if a recipe calls for two eggs, the subsystem subtracts two from the total number of eggs listed in the inventory table. This method of keeping inventory may require some feedback from the family. For instance, if a user decides to discard a product, he or she may notify the inventory subsystem so that it can be subtracted from the home inventory database 33. Such notification may be accomplished by scanning the product label via the barcode reader, and keying-in the amount used.

The inventory subsystem further keeps track of validity dates of stored products. If a product is purchased with a pre-marked expiration date, this date is monitored to determine if a product should be discarded or not. If a product does not come with a pre-marked expiration date, the system assigns an expiration date based on the type or category of products. For instance, all leafy vegetables may have one kind of validity date whereas all types of non-leafy vegetables may have a different kind of validity date.

If the validity date or expiration date of the product has passed, the system asks the user if the product should be discarded or kept for an additional number of days. If the product is quickly perishable, such as fish, the system may not allow the user to extend the validity date. If an extension is allowed, the inventory subsystem may advise the user as to the types of health risks involved.

The inventory subsystem also performs periodic inventory checks of the products in the home inventory database 33. The user may select the time period in which to perform the inventory process. During this process, the inventory subsystem lists all of the products that are stored in the home inventory database 33 and asks for confirmation of the amount that is stored for each product. The quantity of each product is then updated. The inventory subsystem may also try to optimize the amount of food stored in the house. It may ensure that only a minimal amount of food is stored. The inventory subsystem may, however, have options to store and monitor food supplies for emergency reasons. For instance, the inventory subsystem may monitor food and water supplies needed for the family in the case of an earthquake.

Setup Subsystem

Figure 12:
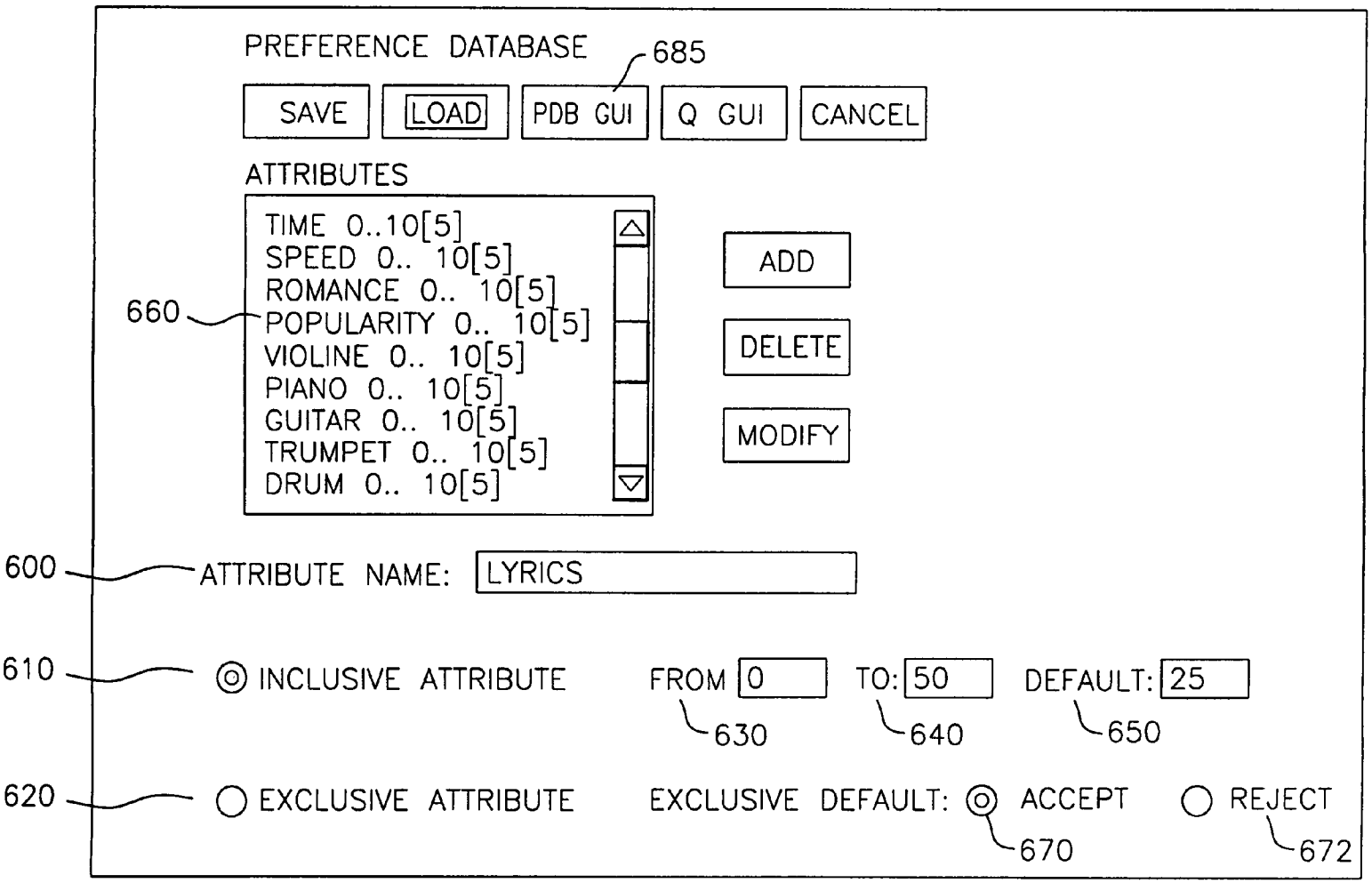
FIG. 12 is an exemplary preferences database GUI for defining attributes.

Referring again to FIG. 2, a setup subsystem 36 in the system's server or platform computer 10 provides a graphics user interface ("GUI") for a system programmer to define or modify vector fields and create preference questions for display to users of the system. FIG. 12 illustrates an exemplary preferences database GUI for allowing the programmer to define attributes 600 and classify them as inclusive 610 or exclusive 620 attributes for a CD recommendation system. Inclusive attributes 610 are used to define the inclusive fields 90 (FIG. 3) of user preference vectors, product vectors, and cluster vectors. Exclusive attributes 620 are used to define the exclusive fields 80 of the vectors.

The system programmer may further set default values for each exclusive or inclusive attribute. For instance, an inclusive attribute may be defined to have a certain range of values with a minimum value defined in a textfield labeled "From" 630 (here, 0) and a maximum value defined in a textfield labeled "To" 640 (here, 50), and a default value defined in a textfield labeled "Default" 650 (here, 25). Other attributes may have other ranges and default values. For instance, the attribute for popularity 660 is defined to have values ranging from 0 to 10, with a default value of 5.

If an attribute 600 to be entered is an exclusive attribute, the programmer selects an exclusive attribute option 620. The entered attribute is set to "1" if the programmer selects the "Accept" option 670. If the programmer selects the "Reject" option, the entered attribute is set to "0".

Figure 13:
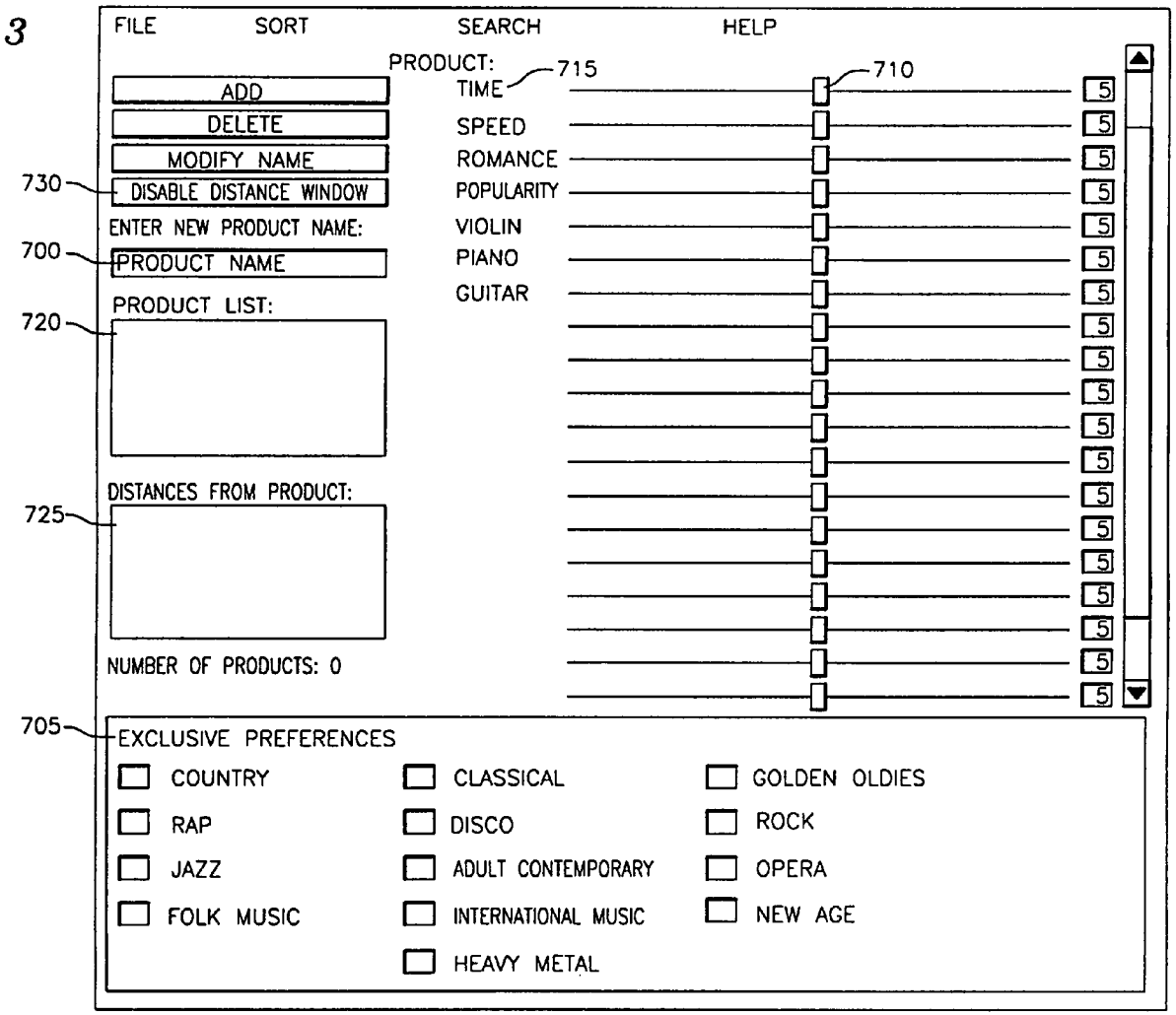
FIG. 13 is an exemplary product database GUI for creating product vectors based on the exemplary attributes of FIG. 12.

Once the attributes have been defined, the systems programmer creates a product vector for each product for entry into the recommendation database 32 (FIG. 2). This is done by selecting a "PDB GUI" 685 button. FIG. 13 illustrates an exemplary product database GUI invoked upon selection of the "PDB GUI" button. The product database GUI allows creation of a product vector by entering a product name 700, marking the exclusive preferences 705 that describe the product, and manipulating sliders 710 to set the values of the inclusive preferences. A Product List window 720 lists all the products in the recommendation database 32. A Distances From Product window 725 displays these products in a sorted list. In the illustrated embodiment, a selection of a product from the product list causes a sorting of the remaining products based on their vector distance to the selected product's vector. The more similar a product is to the selected product, the higher it appears in the Distances From Product window 725. This window may be disabled by selecting an "Enable Distance Window" check box 730.

Figure 14:
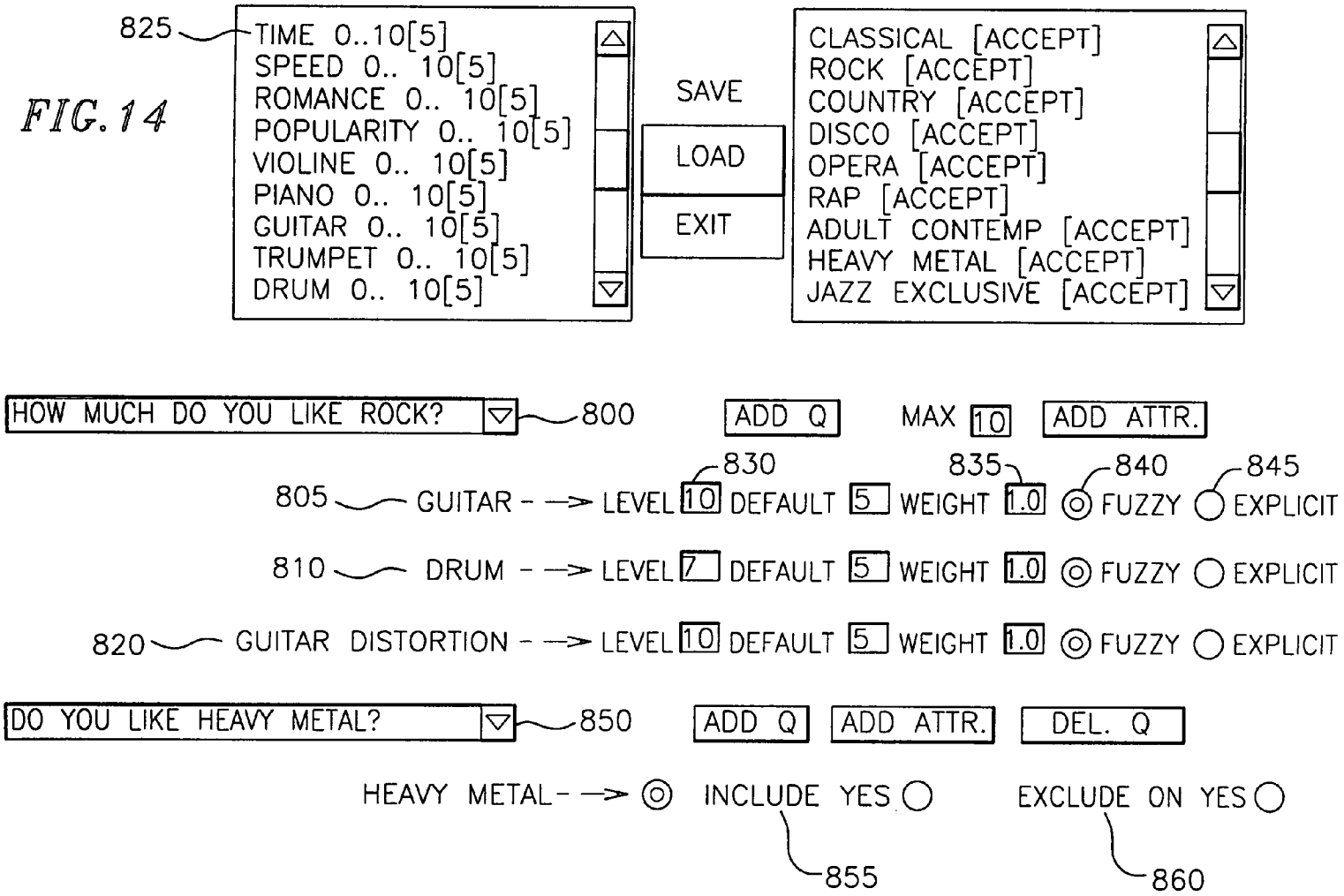
FIG. 14 is an exemplary question setup GUI for initializing a user preference vector.

FIG. 14 illustrates an exemplary question setup GUI for allowing a systems programmer to define the questions to be displayed to a user to initialize a user preference vector. The questions may be created with help of experts in the relevant areas. For instance, questions for setting a user's food preference vector may be created with the help of a dietician.

A systems programmer creates questions relating to inclusive preferences based on the inclusive attributes created with the preferences database GUI of FIG. 12. The inclusive preference questions may be either "fuzzy" or "explicit." Explicit questions solicit a yes/no or numerical answer. Fuzzy questions solicit open-ended answers.

After creation of an inclusive question, a systems programmer selects the attributes 825 to which it relates. For instance, in the illustrated example, the systems programmer creates an inclusive preference question, "How much do you like rock?" 800. After entry of such a question, the systems programmer selects the guitar 805, drum 810, and guitar distortion 800 attributes to which the question relates. The level field 830 in this illustration indicates the maximum value allowed for a selected attribute. For instance, the maximum value for the guitar attribute is "10". Certain attributes will be more important than other attributes. The degree of importance is reflected in this example by a weight field 835.

System programmers also create exclusive questions. Exclusive questions require "yes" or "no" answers from a user as illustrated by the question, "Do you like heavy metal?" 850. Exclusive questions are used to set exclusive preference fields. An exclusive preference will be either included 855 or excluded 860 based on the user's answer to the question.

In addition to creating attributes and questions, the system programmer may further specify where the product vectors and user preference vectors are stored. These may be stored in the system's database or in an offsite database.

Alternative Recipe Recommendation System

Figure 15:
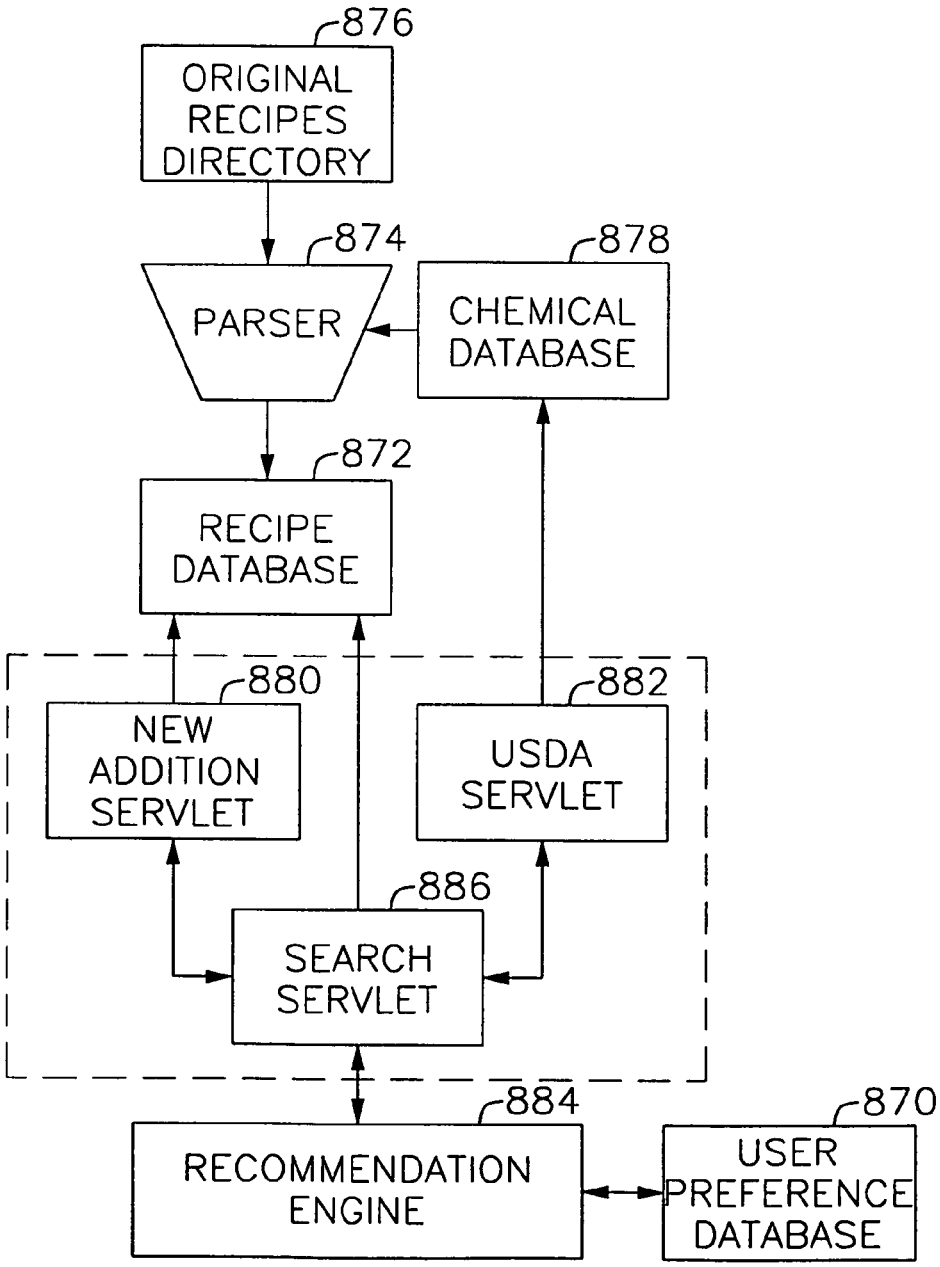
FIG. 15 is a block diagram of a configuration of an alternative network server or platform computer of FIGS. 1 and 2.
Figure 16:
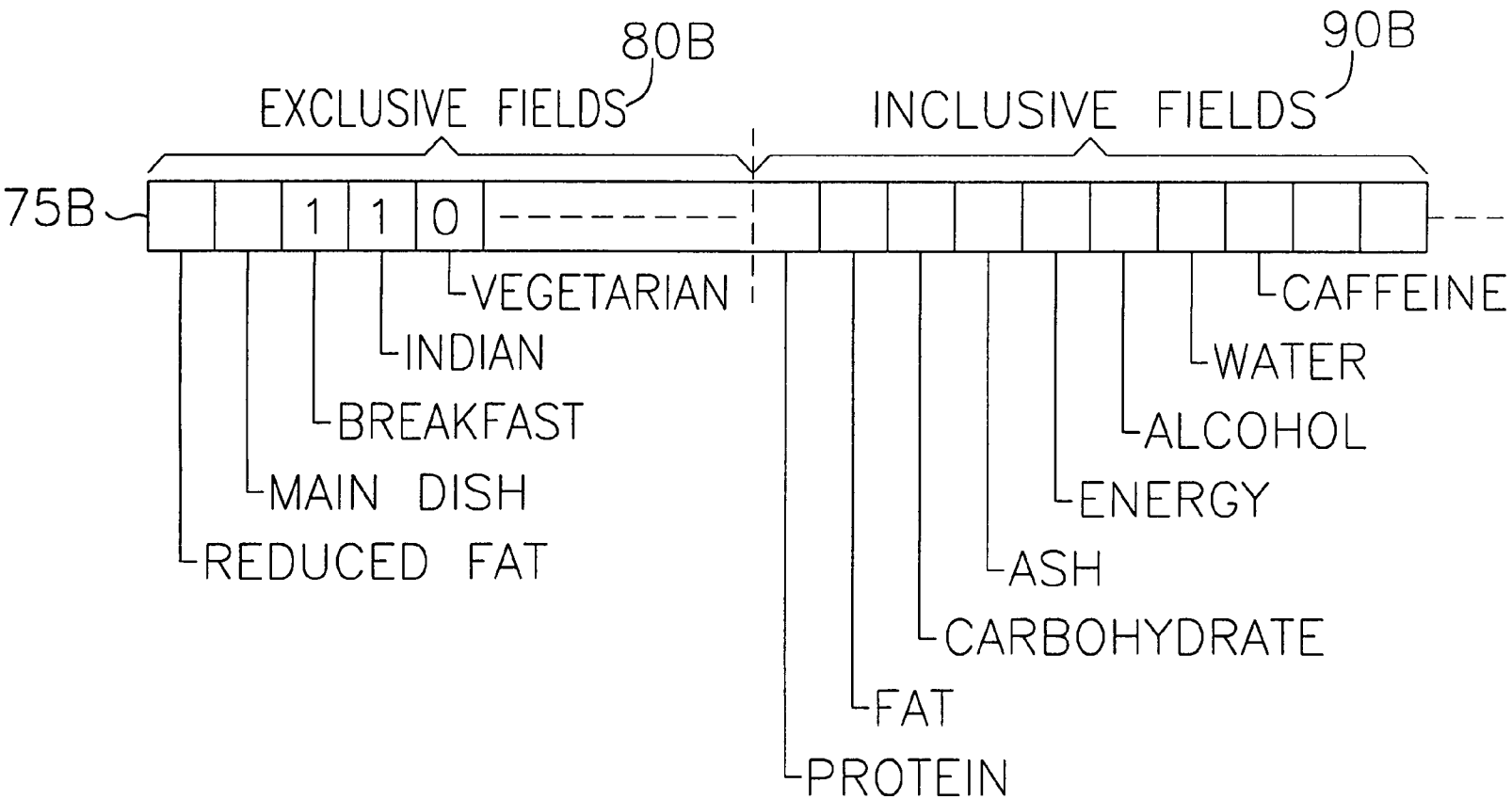
FIG. 16 is an alternative embodiment for storing user food preferences in a user preference vector.

FIG. 15 is a block diagram of a configuration of an alternative network server or platform computer 10 of FIGS. 1 and 2, for specifically recommending recipes. According to the illustrated embodiment, the system hosts a user preference database 870 storing user preference vectors that map the food tastes of the individual users of the system. FIG. 16 illustrates an exemplary individual's food preference vector 75B. The vector is divided into exclusive fields 80B and inclusive fields 90B. The exclusive fields 90A depict specific categories of foods to exclude in making a recommendation.

Inclusive fields 90B indicate a user's degree of preference with respect to a particular attribute. According to a currently preferred embodiment, the inclusive fields correspond to chemical components that may be contained in a dish. Each chemical component or combination of chemical components creates a particular type of taste (e.g. saltiness, bitterness, etc.) A value is assigned to the various chemical components based on the user's preference to such chemicals. The system determines the user's tastes by requesting a user to specify one or more of his or her favorite foods. The system then analyzes the chemical components in the specified foods, and assigns values to the inclusive fields 90B, as is described in further detail below.

Referring back to FIG. 15, a recipe database 872 stores a recipe vector for each dish capable of being recommended by the system. Each recipe vector is identified by the name of the dish. According to one embodiment of the invention, the recipe vector includes the same exclusive fields and inclusive fields as a user's food preference vector 75B (FIG. 16). Thus, a recipe vector will have the appropriate exclusive fields set based on the food category it belongs, and the appropriate inclusive fields set based on the amount of chemical components contained in the recipe.

In an alternative embodiment, the recipe vector includes only the inclusive fields depicting the chemical components of the dish. According to this embodiment, the recipe vectors are stored under appropriate categories based on the type of dish being represented. Each category is associated with an exclusive field of a user's food preference vector. Thus, a recipe vector for a vegetarian dish is stored under a Vegetarian category while a recipe vector for a Breakfast dish is stored under a Breakfast category. Furthermore, a single recipe vector may belong to multiple categories.

Recipe vectors are created with the aid of a parser 874 which is in communication with an original recipes directory 876 and a chemical database 878. The parser 874 takes a recipe in the original recipes directory 876, parses out the ingredients in the recipe, and maps the ingredients to the chemicals in the chemical database 878, as is discussed in further detail below. A parsed recipe may be modified via a menu addition servlet 880. The servlet, moreover, allows recipes to be entered directly into the recipe database 872 without invoking the parser.

The chemical database might be organized into a series of records, each record being specific to a particular food item/ingredient. Each record is headed and identified by the name of the food item/ingredient, and includes a list of all the chemical components that may be found in any type of food. FIGS. 26A-26D illustrate a list of chemical components included in each record according to a currently preferred embodiment. Associated with each chemical component is a value reflective of the amount present in a base unit of the corresponding food item/ingredient. For example, a food item identified as an "egg, whole, raw, fresh", may have a base unit of 1 medium egg. The record for this food item would then list the amount of each chemical component for 1 medium egg. The mapping of a food item to its chemical components may be obtained from publications by the United States Department of Agriculture (USDA).

Figure 17:
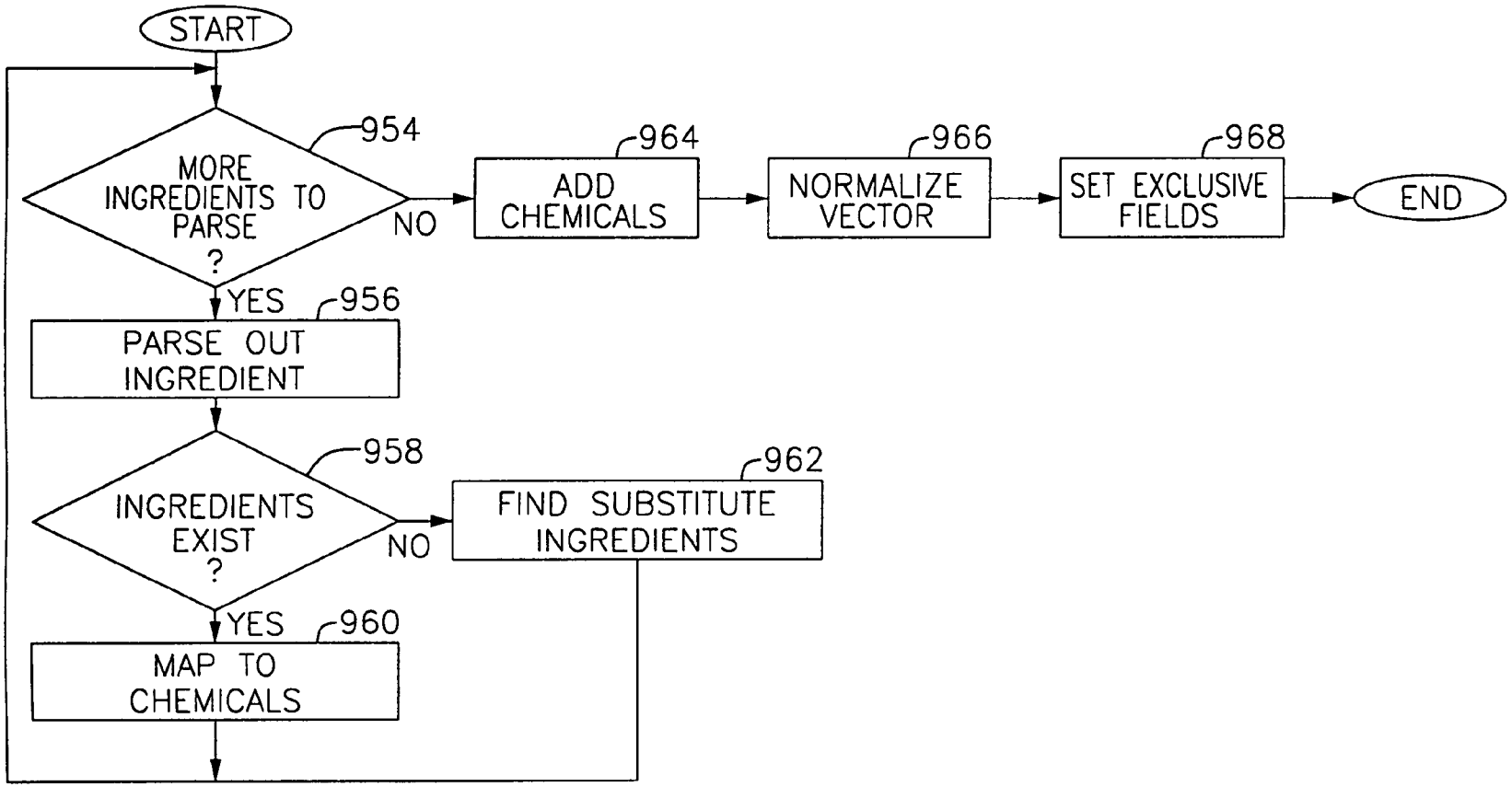
FIG. 17 is an exemplary flow chart of a process for parsing and creating recipe vectors according to one embodiment of the present invention.

FIG. 17 is a flow diagram of an exemplary parsing and recipe vector creation process according to one embodiment of the invention. The computer program starts by taking an original recipe from the original recipes directory 876, and in step 954, inquires whether there are any more ingredients to parse. If the answer is yes, the program parses out an ingredient in step 956. The program also asks in step 958 whether the parsed ingredient exists in the chemical database 878. If it does, the system maps the chemical compositions making up the ingredient to an ingredient vector. In doing so, the system searches the chemical database for a record corresponding to the ingredient. If the record is found, the system sets the values of the ingredient vector according to the chemical values stored in the located record. The system then multiplies the values in the ingredient vector with the weight/amount of the ingredient called for in the recipe. In addition, the system might multiply each field in the ingredient vector by the weight (scaling coefficient) assigned to the field. Chemical compositions which make greater contributions to an ingredient's taste and attribute are given higher weights than those that do not have much effect on neither taste nor attribute. For instance proteins and sugars are given a maximum possible weight (e.g. 100 in a scale of 0-100), while energy and calcium are given low weights (e.g. 0.1 in a scale of 0-100).

If the program does not find an ingredient in the chemical database, a substitute ingredient that is found in the database is used in its place. The substitution may be done manually by a systems programmer via the menu addition servlet 880. Alternatively, the system might select a key phrase in the ingredient's name, and find an ingredient in the recipe database that includes the selected key phrase.

After all the ingredients of the given recipe have been parsed, the computer program, in step 964, adds the chemicals found in the various ingredients by performing a vector addition of all the ingredient vectors. The resultant vector is saved as a recipe vector, and in step 966, is normalized for hundred grams of the entire recipe. In step 968, the exclusive fields of the recipe vector are set via a systems programmer, and the process ends.

The system also hosts a USDA servlet 882 which allows addition of ingredients and their corresponding chemical compositions, into the chemical database 878. Thus, if an ingredient in a recipe being parsed is not found in the chemical database, the ingredient and its chemical composition may be added to the database. Alternatively, the closest match to the ingredient missing from the database may be used to map the chemicals.

A recommendation engine 884 in conjunction with a search servlet acts to find recipes that will cater to an individual's tastes. According to a currently preferred embodiment, the recommendation engine computes the vector distance between the user's food preference vector and each recipe vector to find the dishes to recommend.

FIGS. 18-28 are layouts of exemplary graphic user interfaces provided by the recommendation system. FIG. 18 is an exemplary user registration GUI. A user must provide an e-mail address and a fax number if he or she wants to receive recommendation information via e-mail or fax. The user further selects a username and a password to access the system. The user also provides other identification information, such as the user name, address, and telephone number, as part of his registration process. The user's address is used by the system to recommend restaurants in the user's geographic area.

Figure 19:
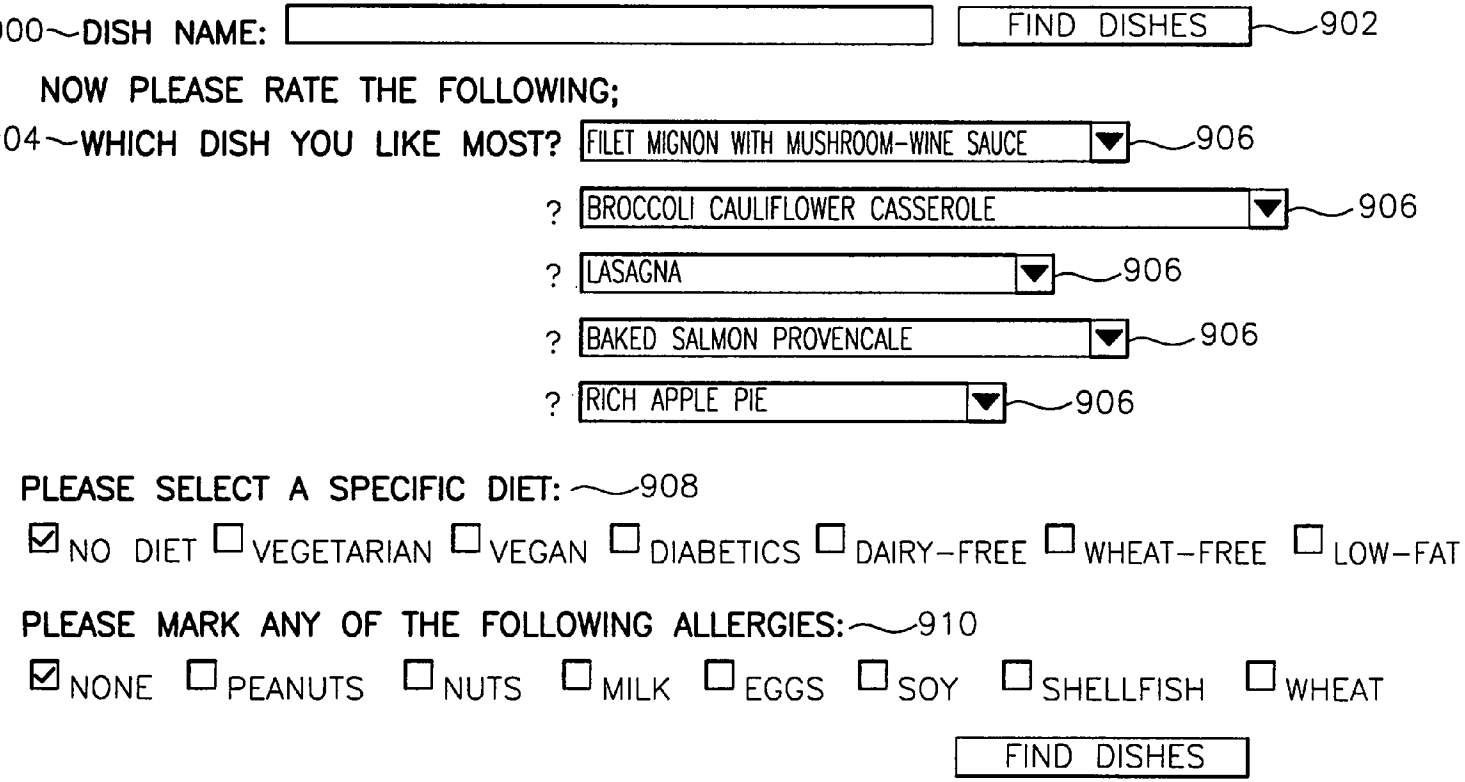
FIG. 19 is an exemplary. GUI for allowing entry of user preference information according to one embodiment of the present invention.

FIG. 19 is an exemplary GUI for allowing entry of preference information from the user for initializing the user's food preference vector. The user may use the GUI to enter his or her favorite dish 900, and select a find dishes button 902. If the name of the dish exists in the recipe database, the dish typed-in by the user is accepted. Otherwise, if the system cannot find an exact match, the system displays a list of other comparable dishes for user selection. In its most general form, this is accomplished by finding dishes with names that partly match the dish name specified by the user. For instance, the user may type-in "Spaghetti" as his or her favorite dish. If the recipe database 872 (FIG. 15) does not contain a dish simply called "Spaghetti" but does contain dishes with the word "Spaghetti" such as "Spaghetti and meatballs", "Seafood spaghetti", and "Spaghetti and white clam sauce", the list of such dishes are displayed to the user for his or her selection.

The system further allows the user to rate up to five other dishes that the user likes 904 to get better knowledge of the user's tastes. The user accesses a list of dishes stored in the recipes database 872 by selecting a down-arrow button 906, and further selecting a dish from a resultant pull-down menu of dishes. In an alternative embodiment the user simply selects one or more meals from a predetermined list of meals as being closest to his or her liking.

The system also inquires whether the user is on a particular type of diet 908, or whether the user is allergic to particular types of foods 910. The user-responses are then used for setting the exclusive fields in the user's exclusive preference vector.

The user may further select the types of meals to be recommended for each type of meal, such as, for example, soup, salad, entree, side dish, dessert, and/or wine. Furthermore, the user may also specify a group for which the recommendations are to be made, and the number of people in that group. The user may additionally indicate whether the recommendations are to be automatically created and presented to the user, such as, for example, via e-mail. In this scenario, the user may further indicate the frequency of the recommendations.

Upon the completion of the form illustrated in FIG. 19, the user selects a "Submit ratings" button, and submits the responses to the system's network server or platform computer 10 (FIG. 1). The system then proceeds to create and/or update the user's food preference vector. If the user has entered a favorite dish 900, the system retrieves the recipe vector for the particular dish, and copies the values of the recipe's inclusive fields, into the inclusive fields of the user's preference vector. The exclusive fields are set according to the responses to questions posed by the system regarding to the user's diet 906 and allergies 908.

According to a currently preferred embodiment, the system creates food preference vectors for the other five dishes the user has rated to be to his or her liking 904. Each preference vector acts as a cluster vector. As the user uses the system and indicates other dishes to be his or her favorite, the recipe vectors for those dishes are merged into a cluster with a smallest vector distance to the new favorite dish. Cluster vectors and various alternatives in creating cluster vectors is discussed above in greater detail.

Figure 20:
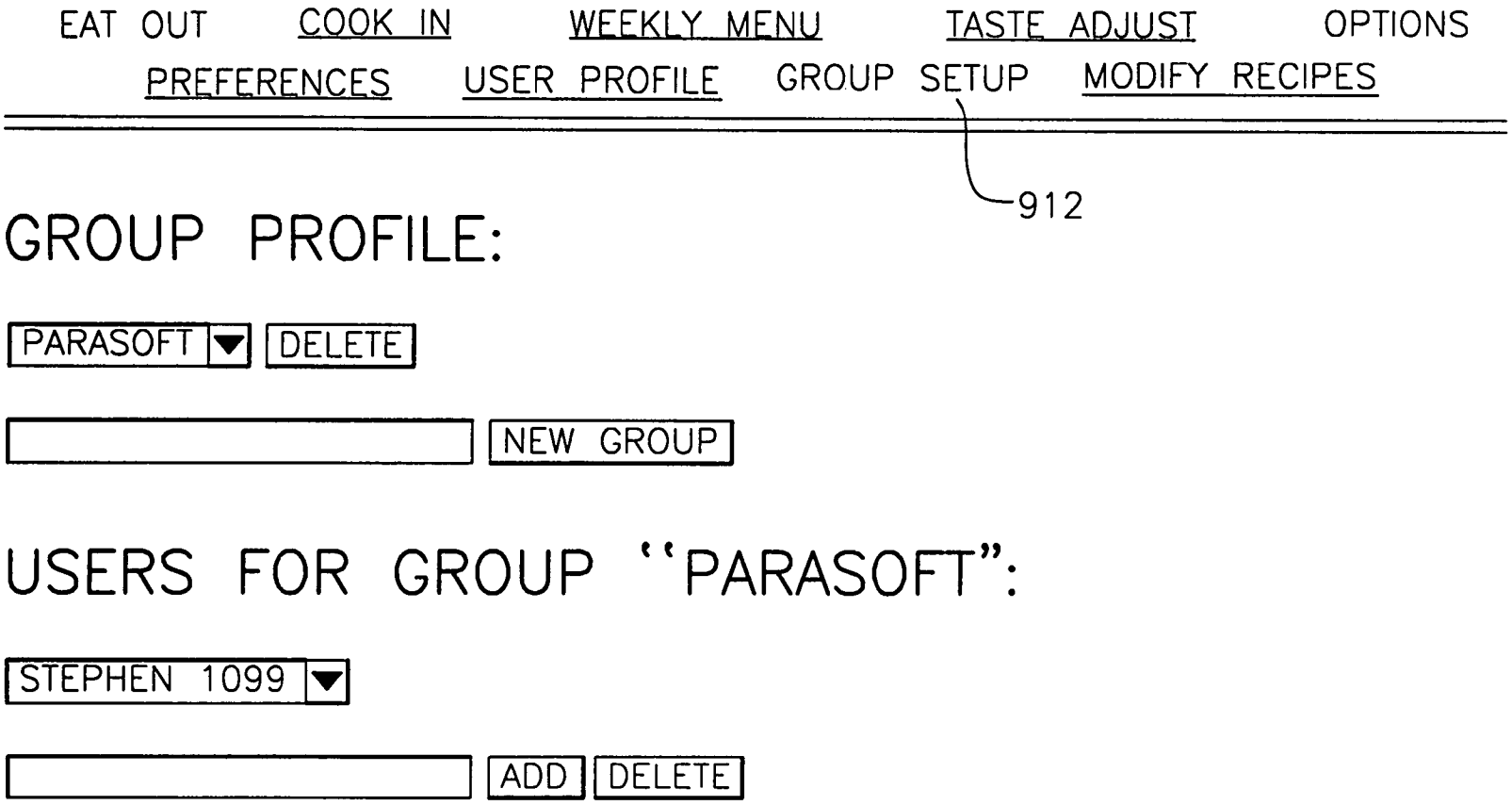
FIG. 20 is an exemplary group setup GUI in accordance with one embodiment of the present invention.

After one or more preference vectors have been created, the system may now make recommendations on recipes that will cater to the individual's tastes. In addition, the system may also make recommendations that cater to a group of individuals who have registered into the system. FIG. 20 is an exemplary group setup GUI. In accordance with one embodiment of the invention, the user may create a new group, or add himself or herself to an existing group, by selecting a group setup option 912. When a user first registers onto the system, a new group is created with the individual as the initial member and creator of the group. A creator of the group is given special privileges, such as the ability to delete the group, and add or delete members to the group.

In making a recommendation for a group, the system selects a recipe in the recipe database and computes the vector distance to the nearest product cluster of each member in the group. The average distance to the recipe is then calculated by adding the vector distances to the recipe for all the members, and dividing the total distance by the number of members in the group. This is done for each recipe in the recipe database. The system then recommends the recipe with the smallest average vector distance.

FIG. 21 is an exemplary GUI for allowing a user to set a meal template for a specified number of days 930. For instance, the user can request that a soup, salad, entree, side dish, dessert, soft drink, beer, and/or wine be recommended for all lunches 932 or dinners 934. The user can also specify, for each day of the week, whether the user will be cooking in, eating out, doing take out, or requesting delivery.

Figure 22:
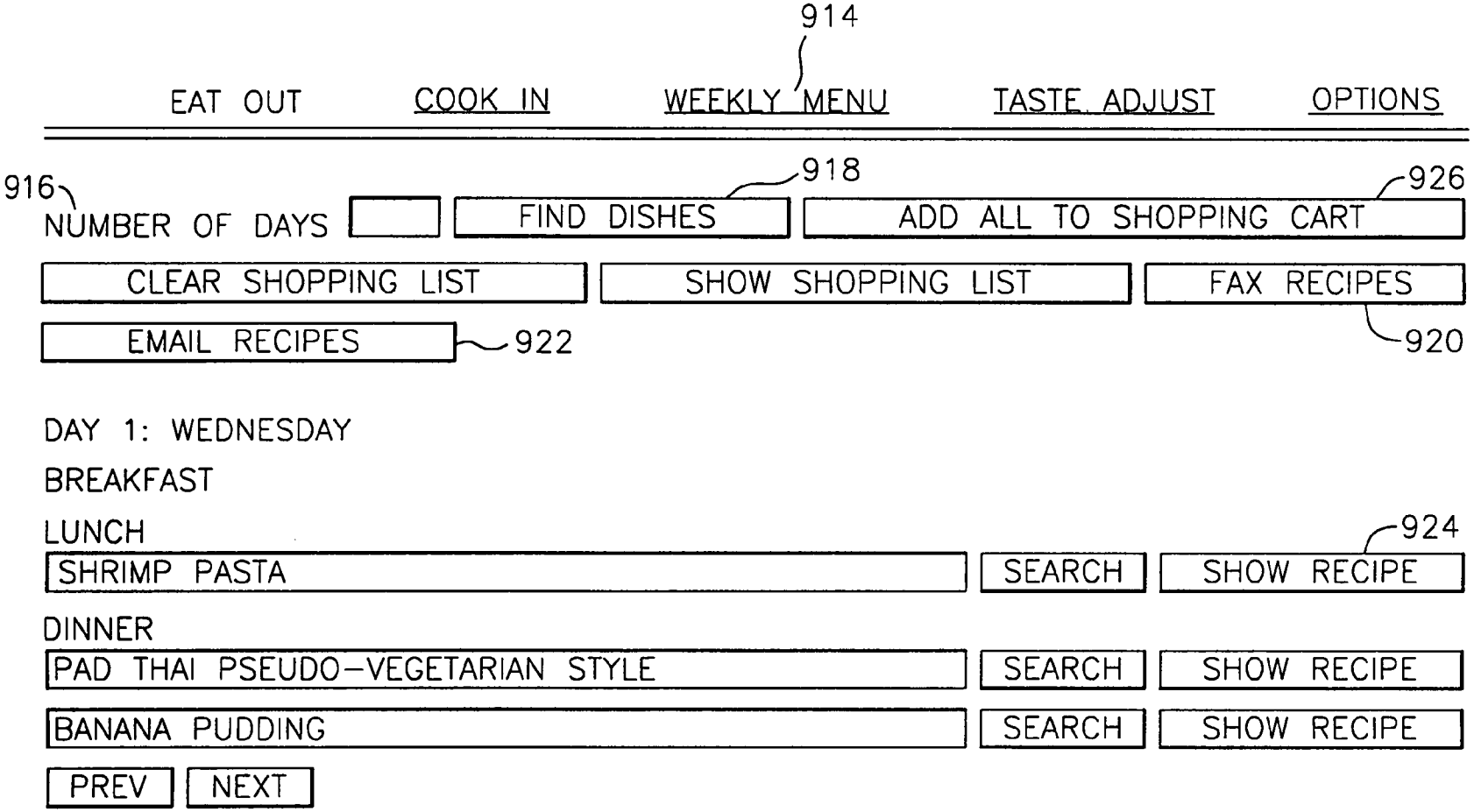
FIG. 22 is an exemplary GUI for displaying a weekly menu according to one embodiment of the present invention.

A user may view his or her weekly, menu by selecting a weekly menu option 914, as illustrated in FIG. 22. The user may also view recommendations for a different number of days (e.g. the next two weeks) by entering a desired number in a "Number of days" 916 field, and selecting a "find dishes" button 924. For a day specified as a cook-in day, the system displays recommendations of specified type of dishes (e.g. soup, salad, entree, etc.). A "Show Recipe" button 924 next to the recommended dish allows the user to view a picture of the prepared dish, the dish ingredients, and preparation instructions.

Figure 23:
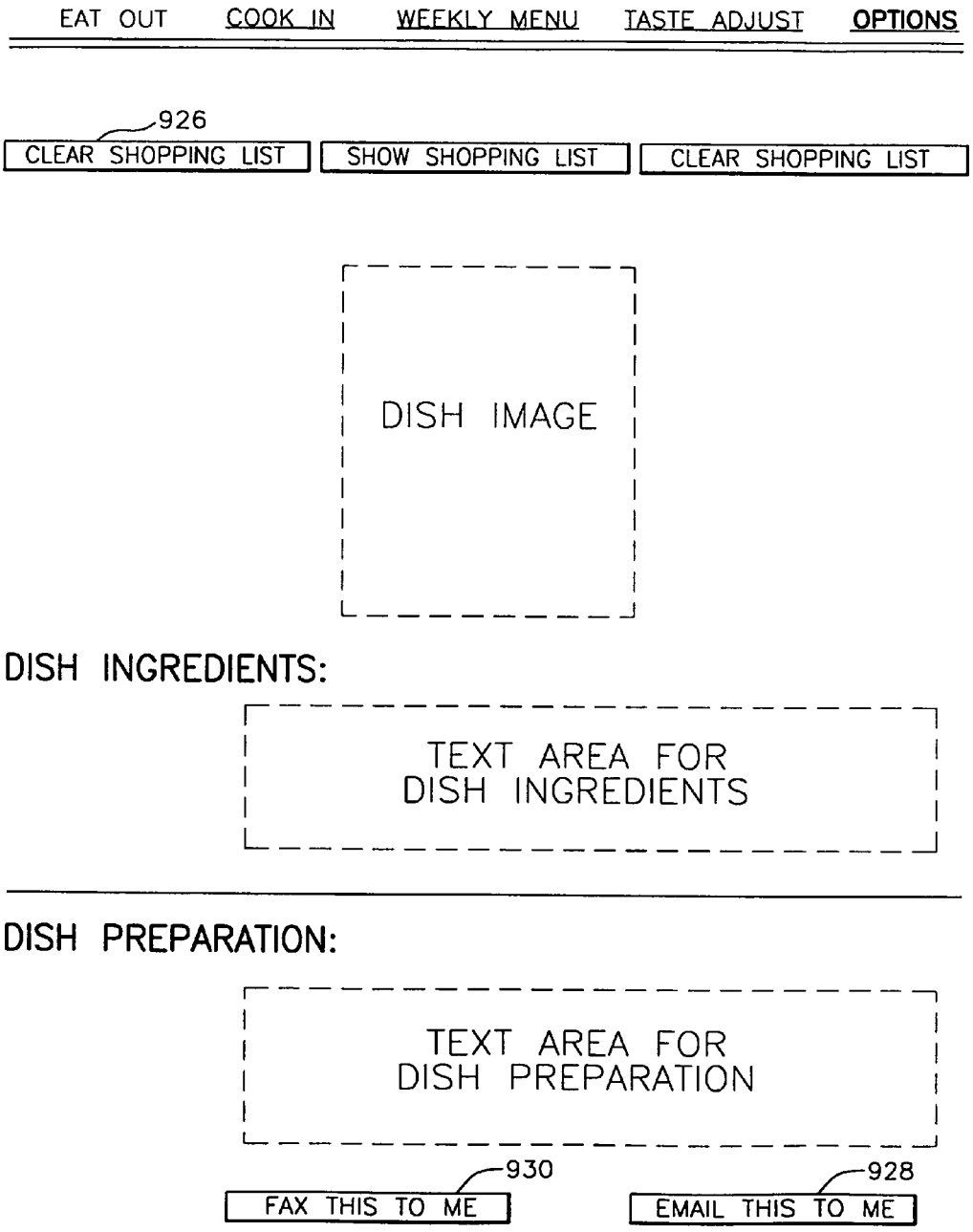
FIG. 23 is an illustration of an exemplary recipe recommended by the system.

FIG. 23 illustrates an exemplary recipe displayed upon selection of the "Show Recipe" button 924. The ingredients necessary may be added to a shopping list by selecting an "Add to Shopping List" button 926. Furthermore, the recipe may be e-mailed 928 and/or faxed 930 to the user, if so desired. According to one embodiment of the invention, multimedia presentations are used in conjunction with the written instructions to instruct a family member in how to prepare the recommended dish. The multimedia presentation will typically include a video/audio presentation. In other cases, references to cookbooks will be made for the user to look up the instructions in a specified cookbook.

For a day specified as an eat-out, take-out, or delivery day, the recommends a restaurant along with dishes which cater to the user's tastes. In doing so, the system accesses a restaurant database including a list of restaurants in the user's geographical area. Alternatively, the restaurant database includes a list of restaurants registered with the system.

Figure 24:
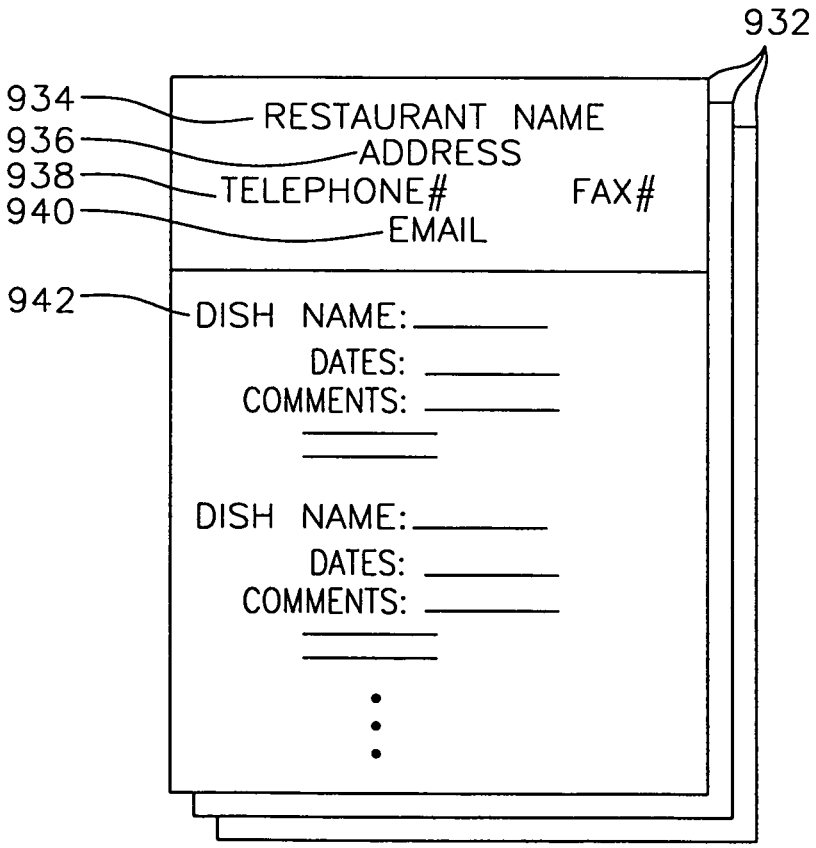
FIG. 24 is a diagram of a layout of an exemplary restaurant database according to one embodiment of the present invention.
Figure 26D:
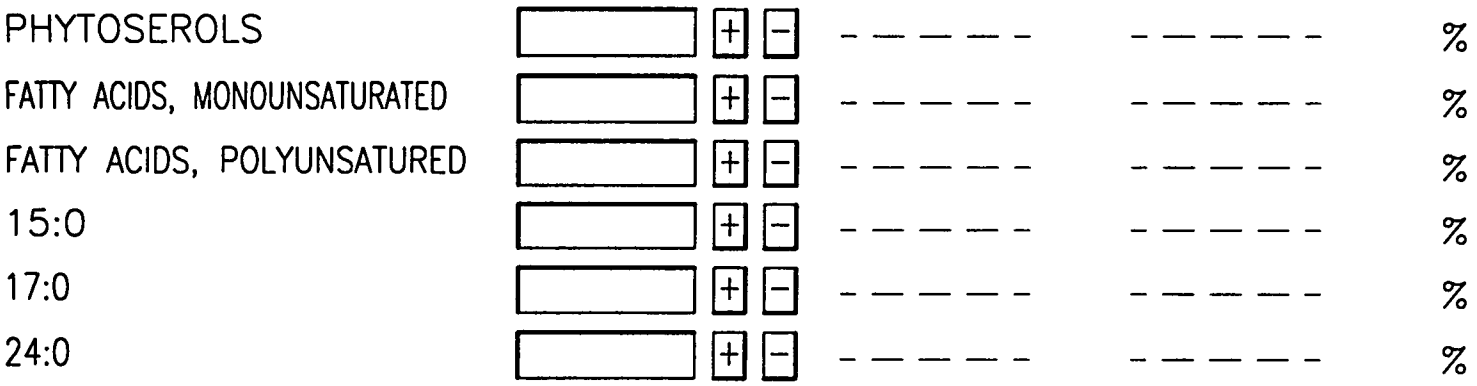

FIG. 24 is a diagram of a layout of an exemplary restaurant database. The restaurant database comprises a series of restaurant specific records (identified generally at 932) each of which is headed and identified by a restaurant name 934. Following the restaurant name, each restaurant's data record includes the address 936 of the restaurant, including it's e-mail address 940, and the restaurant's telephone and fax numbers 938. The record might further indicate whether the restaurant delivers, allows take-outs, or receives orders via the Internet or fax.

Each restaurant record 932 also includes an information storage area with a list of dishes 942 offered by the restaurant. In a currently preferred embodiment, each dish is associated with a recipe vector in the recipe database 872 (FIG. 15). Associated with each listed dish 942 are the dates 944 in which the dish is offered. For example, the dish may be offered everyday, or on certain days of the week (e.g. Sundays). The dish may also be offered for a limited period of time (e.g. June 1-June 28). Also associated with each dish are comments 946 related to the dish, if such was provided by the restaurant.

In recommending a restaurant to a user, the system analyzes the dishes offered by each restaurant, and computes the vector distance between the user's food preference vector and a restaurant's recipe vector. The restaurant with a dish with the smallest vector distance is then recommended.

If a restaurant is to be recommended to a group of individuals, the system calculates the vector distance to the dishes of a particular restaurant, and calculates the average vector distance for that restaurant. A restaurant with the smallest average vector distance is then selected for recommendation. Alternatively, each member of the group might be requested to select a menu item from any of the restaurants in the restaurant database. The system then analyzes the recipe vectors of the chosen items, and selects a restaurant that best satisfies the menu items selected. If a particular menu item is not located in the selected restaurant's record 932, the system finds the closest substitute menu item and proposes it to the individual whose menu item was not located. The individual may accept the recommended item, or select a different item from the selected restaurant's menu. The system may further add the various menu items (e.g. 6 cheeseburgers, 2 fries, 5 cokes), and transmit the order via the Internet, fax, or other known communication means.

In an alternative embodiment of the invention, a particular member of a group invites other members of the group to submit their orders from a predetermined menu. In this regard, the particular member communicates an invite to the other members via e-mail, instant messaging, or the like. The invite preferably includes a time, place of meal, menu of available foods, and time by which the orders are to be submitted. Each receiving member preferably selects the desired food items from the menu, such as, by clicking on the items, and submits them to a group shopping cart maintained in memory by the server 10 upon actuating a submit button. The items may be submitted over a period of time, by the different members, from different locations and potentially from different types of input devices, such as, for example, a browser, portable device, cell phone, and the like. The server 10 preferably invokes its microprocessor to automatically aggregate the orders in the group shopping cart and submit them to a particular restaurant or retailer as a single order request via the Internet connection 12.

Referring back to FIG. 22, a user may request that the recommendations made for the entire week, whether it be a particular dish and/or restaurant recommendation, be e-mailed and/or faxed to the user. The user makes these requests by selecting a "fax recipes" button 920 or an "email recipes" button 922, respectively. Alternatively, the system automatically e-mails or faxes the recommendations for the week, at the beginning of each week. In this way, the user need not revisit the system to get the recommendations once he or she is registered.

In addition, an "Add all to Shopping Cart" option 920 causes the system to prepare a shopping list of all ingredients necessary for preparing the cook-in meals for the week (or an otherwise specified number of days). In doing so, the system adds the recommended quantities of ingredients required in more than one recipe, rather than listing the same ingredient in multiple locations of the list. For example, if the recipes recommended for day one and day three both require a cup of sugar, the system places two cups of sugar into the shopping list instead of placing a cup of sugar in two separate listings. Furthermore, the system determines whether an ingredient is offered by one of the sponsors of the system. If this is the case, the sponsor's brand name is suggested for the ingredient. For instance, if one of the ingredients to be inserted into the shopping list is cream cheese, and one of the sponsors of the system is Kraft Foods, Inc., the system would place Philadelphia® cream cheese into the user's shopping list. If the system has access to an inventory database 33, as is described in further detail above, the system places an ingredient into the shopping list if the user is running low on the ingredient.

The system further allows a user to search for dishes which taste similar to a dish entered. A user does so by entering a dish and selecting a "Search" button 925. The system then searches the recipe database 872 and displays a list of dishes with the smallest vector distance. A user may similarly find dishes which include specified types of ingredients or find dishes that exclude specified types of ingredients.

FIG. 25 is an exemplary GUI for receiving feedback from a user in regards to a recommended recipe. The user gives a rating 950 to each recommended dish 948 if it has been sampled by the user. For instance, if the user really liked a sampled dish, he or she may give it a rating of "8". On the other hand, if he or she just tolerated a dish, a rating of "3" is given. The ratings are submitted by selecting a "Submit" button 952.

The system utilizes the feedback received from the user to modify his or her food preference vector. According to one embodiment of the invention, a highly rated dish (e.g. dishes with rating of "7" or above) is merged into an existing cluster, as is described in further detail above. The ratings of the dishes are used to modify the values of the inclusive fields of the user's food preference vector. The amount by which a value is modified is proportional to the degree of dislike expressed by the user. For instance, if the protein field in the user's preference vector has a value of 30 (a value that is below average on a scale of 0 to 100), and the user gives a rating of "1" to a sampled dish, expressing a great dislike to the dish, the system might modify the protein field to a value of 90 (a value that is above average). This is done for every inclusive field in the user's preference vector. On the other hand, if the user only slightly disliked a dish, the inclusive field values may be modified only slightly, such as modifying the protein field to a value of 35. For the lowly rated dishes (e.g. dishes with ratings of "2" or below) the system further creates negative cluster vectors to ensure that these dishes, or similar dishes, are not recommended in the future.

FIGS. 26A-26D are exemplary GUIs for adjusting the weights (scaling coefficients) 960 of the chemical compositions 962 appearing in the inclusive fields of a recipe vector or a user preference vector. The weights 960 are preferably set based on the contribution of each chemical composition to a dish's taste or attribute. In creating a recipe vector for a particular dish, the system multiplies the weight of a chemical composition with the amount of the chemical present in the dish. Thus, if a dish contains six grams of protein, and the protein attribute is given a weight of 100, the value in the protein field before normalization would be 600 (6×100).

An individual user of the system or a systems programmer may increase or decrease the weight factors by selecting a "+" icon or a "−" icon, respectively. Furthermore, a user may view the amount of each chemical composition 964 in a particular dish, by entering the name of a desired dish 966 found in the recipe database. If the user enters a name of a second dish 968, the system displays the chemical compositions in the second dish, as well as the vector distance 970 between the first dish 966 and the second dish 968.

Figure 27:
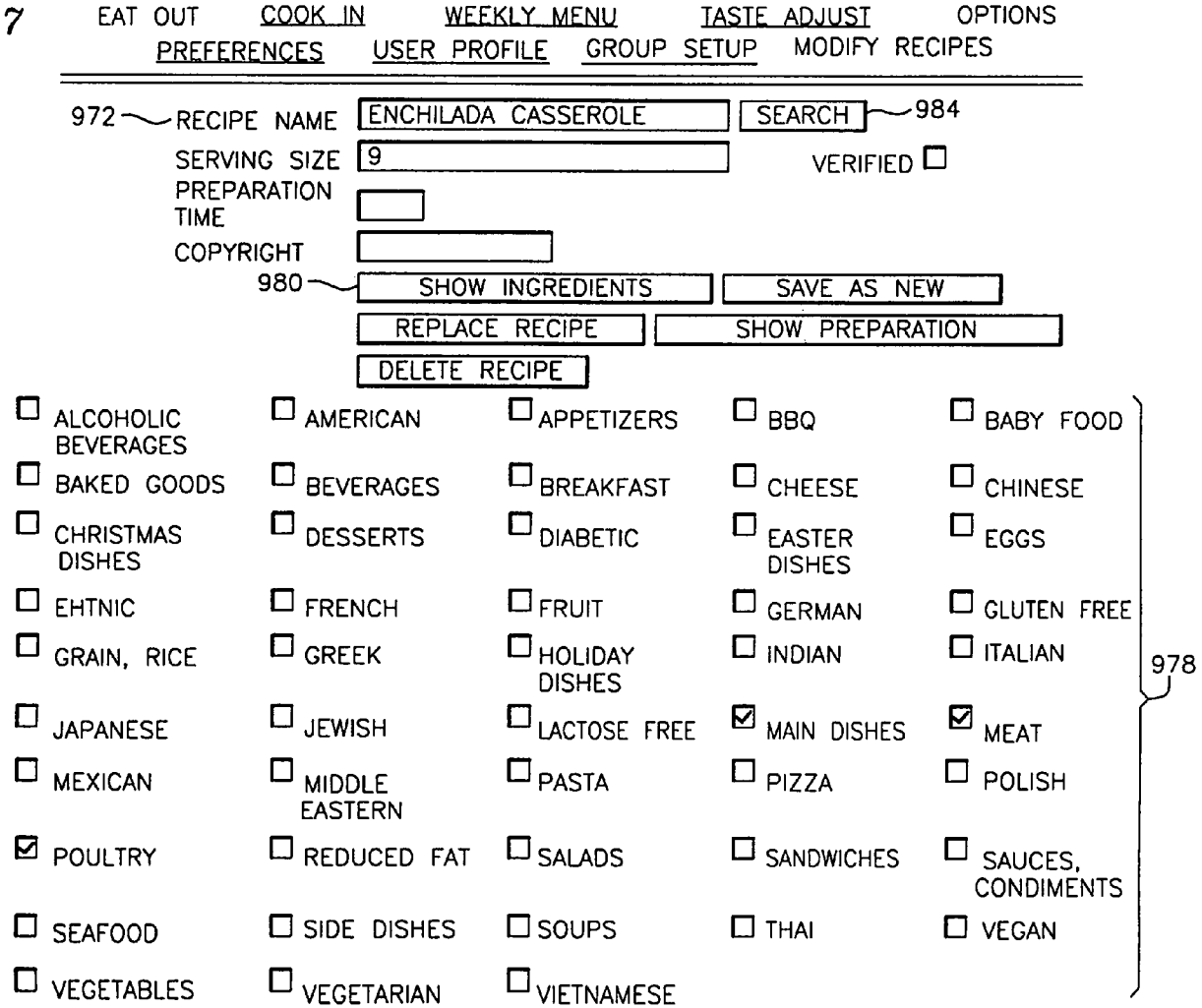
FIG. 27 is an exemplary GUI for the menu addition servlet of FIG. 15.

FIG. 27 is an exemplary GUI for the menu addition servlet 880 of FIG. 15. The GUI is available to a systems programmer for modifying recipes and recipe vectors, as well as adding new recipes directly into the recipe database 872. The systems programmer enters a new recipe by entering a recipe name 972, serving size 974, and preparation time 976 for the recipe. The programmer then selects the exclusive categories 978 to which the recipe belongs, and sets the exclusive fields of the corresponding recipe vector.

Figure 28:
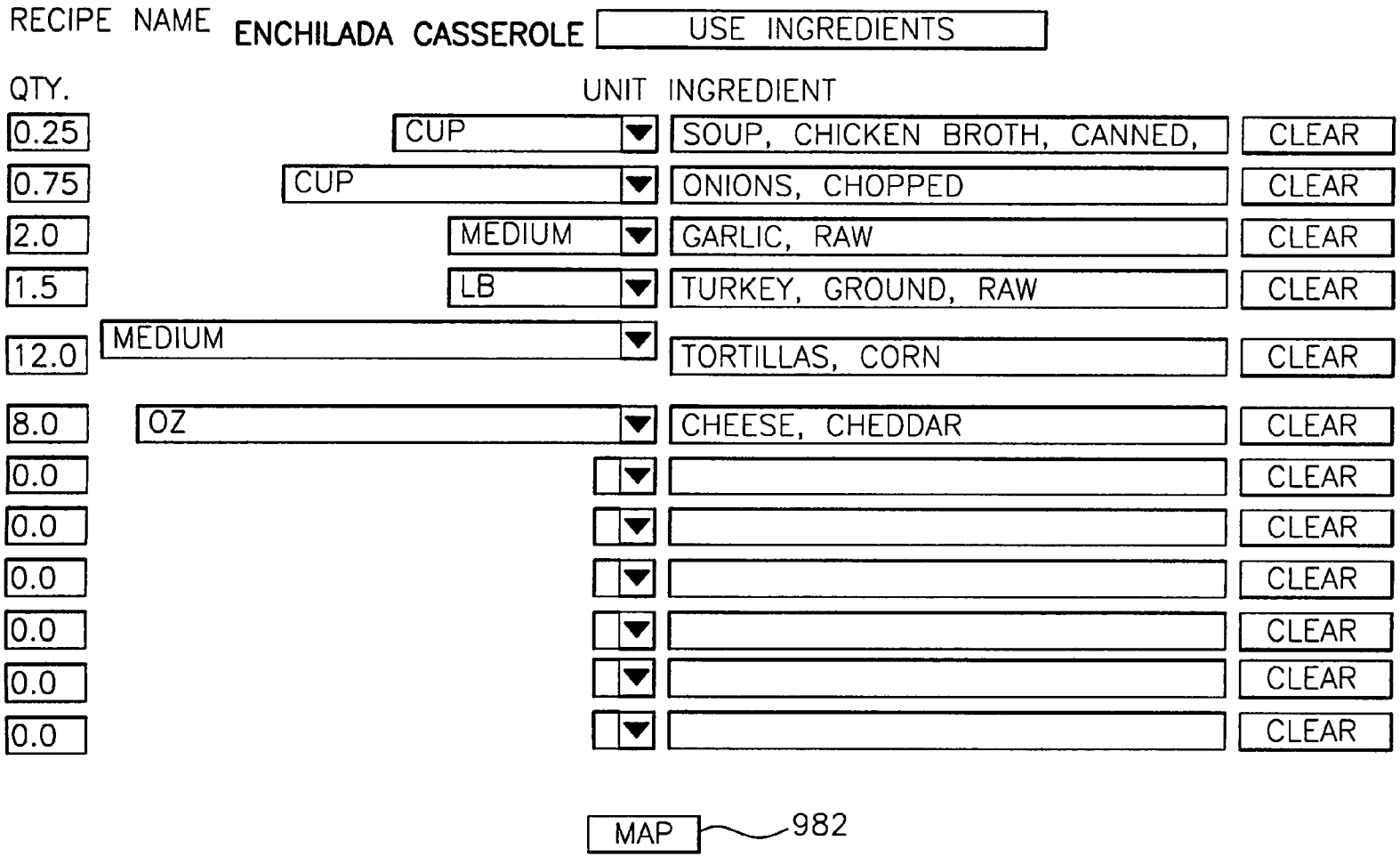
FIG. 28 is an exemplary GUI for adding or modifying ingredients of a recipe in accordance with one embodiment of the present invention.

A "Show Ingredients" button 980 allows the programmer to enter the ingredients for the new recipe. FIG. 28 is an exemplary GUI for entering ingredients upon selection of the "Show Ingredients" button 980. After entry of the ingredients, the user selects a "Map" button 982 for mapping the ingredients to chemicals in the chemical database 878 (FIG. 15), and setting the inclusive fields of the corresponding vector.

If the systems programmer desires to modify an existing recipe, he or she enters the desired recipe name 972 and selects a "Search" button 984. The programmer may then make modifications to the exclusive categories 978, or add/modify ingredients by selecting the "Show Ingredients" button 980. The modified recipe is then re-mapped by selecting the "Map" button 982 of FIG. 28.

User Interface Subsystem

According to one embodiment of the invention, the network server or platform computer 10 includes a user interface subsystem 41 providing an interactive, user friendly GUI for motivating the user to answer preference questions posed by the system and obtain recommendations based on the user's answers. In this regard, the user interface subsystem 41 presents a virtual character who greets the user upon access of the system through the Internet connection 12. The virtual character may take one of many forms, including 3D graphics animation, flash animation, motion capture, real-time broadcast, or video. A person skilled in the art should recognize, however, that any other known forms for representing the virtual character may be used as long as the virtual character sparks and maintains the user's interest in using the system.

The virtual character preferably makes the process of providing user preference information more user-friendly and interesting. In doing so, the user interface subsystem 41 invokes a routine programmed to take the user on a virtual tour and present various items to the user for obtaining the user's feedback. For instance, in a music recommendation system, the virtual character takes the user on a tour of a virtual music store, catalog or playlist where the user is presented with different types of music and asked to give a rating to the music being played. In a menu recommendation system, a virtual chef presents to the user various types of recipes, including a picture of the meal, the ingredients present, and cooking instructions. The user then gives a rating of the meal based on the information being presented and/or based on his or her past experience with the meal.

In sparking and maintaining the user's interest during the tour, the virtual character is preferably programmed to present to the user trivia information, jokes, and the like. The virtual character may also be represented through whimsical artwork to inject humor and entertainment to an otherwise boring and tedious process of providing the user's preference information through questionnaires or survey forms.

After the user's preference information has been obtained, the virtual character recommends one or more choices of items calculated to be to the user's liking. The recommendations are also preferably presented to the user during the virtual tour. For example, in the music recommendation system, the virtual character takes the user to various sections in the virtual music store, catalog or playlist and plays songs calculated to be to the user's liking. The virtual character then inquires whether the user has indeed liked the song, and whether he or she would like to create a personalized CD, DVD, or tape with the recommended song. After a predetermined number of songs have been recommended, preferably enough to fill a CD, DVD, or tape, the user interface subsystem 41 proceeds to download the recommended songs to the user's personal computer 14 over the Internet connection 12. Otherwise, the network server or platform computer 10 records the recommended songs on the CD, DVD, or tape and sends it to the user via regular mail.

The entertainment factor provided by the user interface subsystem, therefore, motivates users to participate and remain engaged in the system during the recommendation process. The refreshing boost provided by such entertainment factor replaces the drudgery typically associated with filling preference questionnaires or surveys, motivating the users to provide accurate preference information for increased accuracy in the recommended choices.

Recommendation System Based on Preference Topography

In an alternative embodiment of the system, user preferences are described in terms of a preference topography that charts the contours of a user's taste. As a topography of a physical landscape, the user's preference topography includes valleys, plains, mountains, and the like, representing the areas and the degree of like and dislike for certain objectively measurable qualities or attributes of products. A user's topography is therefore an N-dimensional rating space with N variables associated with N objectively measurable qualities or attributes. The N variables may or may not be capable of being described linearly, and may even be non-related components.

Figure 29:
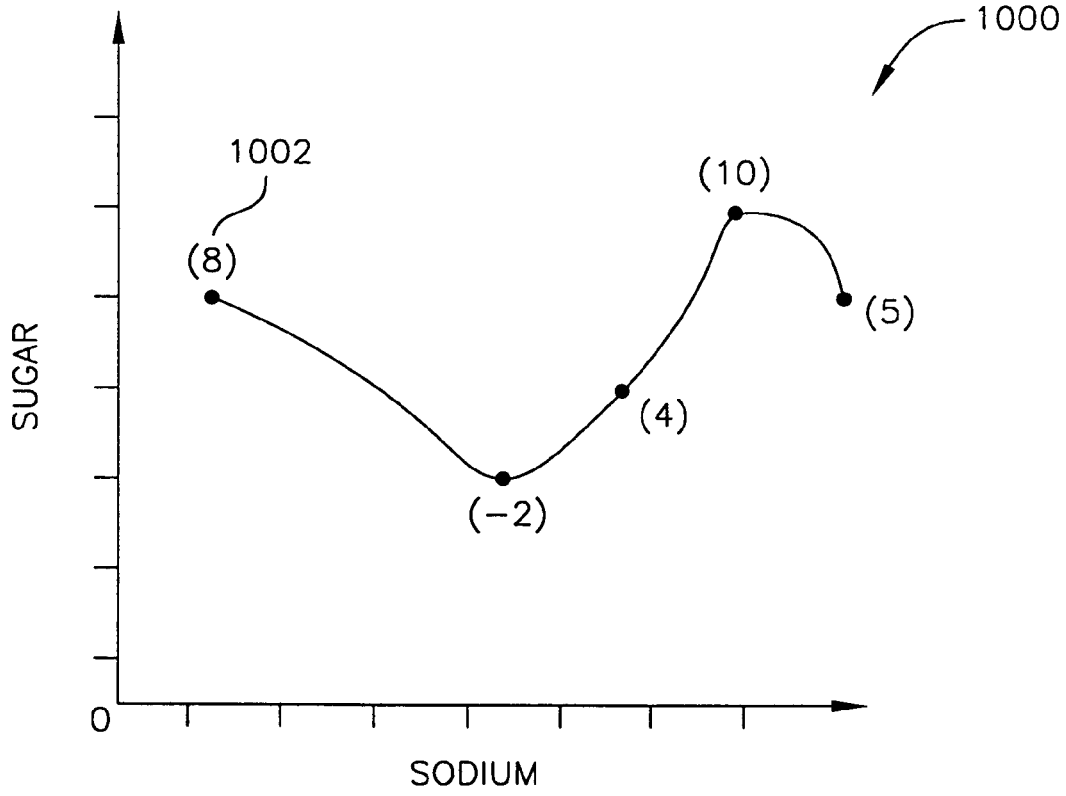
FIG. 29 is a two-variable representation of a preference topography.

FIG. 29 is a two-variable representation of a preference topography 1000. In representing a user's food preference, a first variable may be used to indicate the amount of sodium in a dish, and a second variable may be used to indicate the amount of sugar in the dish. Given these two variables, the user's food preference topography is created by obtaining ratings 1002 from the user indicative of the user's preference for a food having various combinations of sodium and sugar, and representing such ratings as a third dimension.

According to one embodiment of the invention, separate preference topographies may be maintained for the user based on factors such as the time of day, environment, mood, and the like. For example, in a music recommendation system, a different music preference topography may apply depending on the user's mood. Thus, the user may prefer one type of music when he or she is feeling sad, and other types of music when he or she is feeling happy. The user's food preference topography may also differ based on the above factors. For instance, the user may prefer to be more open-minded about the types of food that he or she may like while on vacation than when at home.

Figure 30:
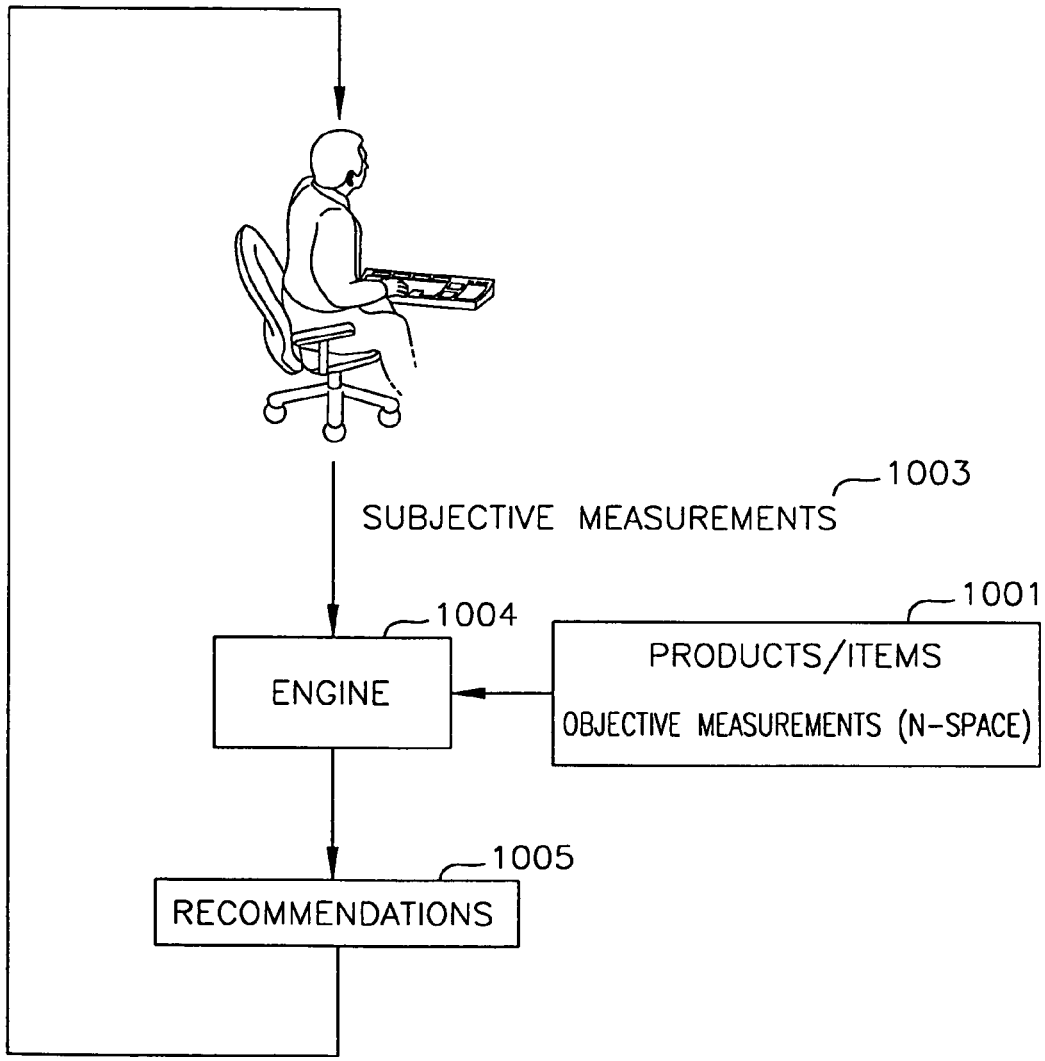
FIG. 30 is a functional block diagram of an alternative recommendation system using preference topographies.

FIG. 30 is a functional block diagram of a recommendation system using preference topographies. The system includes a recommendation engine 1004 that takes as inputs objective measurements 1001 of products defined by the N variables, and subjective measurements (user ratings) 1003 of one or more of such products. The engine 1004 creates and/or updates the preference topography based on these inputs, and makes recommendations 1005 to the user based on the preference topography. The recommendation may be as simple as recommending one choice, or may involve further processing by the engine 1004 to recommend a predetermined number of maximally unique choices. In the latter scenario, the choices recommended are as different from one another as possible, but nonetheless calculated to be to the user's liking.

Alternatively, the engine 1004 may not only present a recommended choice, but also present to the user other choices calculated to complement the recommended choice. For example, in a recipe recommendation system, the engine 1004 may recommend recipes for main entrees as well as side dishes, desserts, and/or wines that complement the recommended entrees.

The engine 1004 may further provide aggregate recommendations where a recommended item is an aggregate of other items calculated to be to the user's liking. For example, the engine 1004 may recommend an album with various songs or a restaurant offering various dishes. The engine may also make a recommendation for an aggregate number of users using a composite of each user's preference topography.

Figure 31:
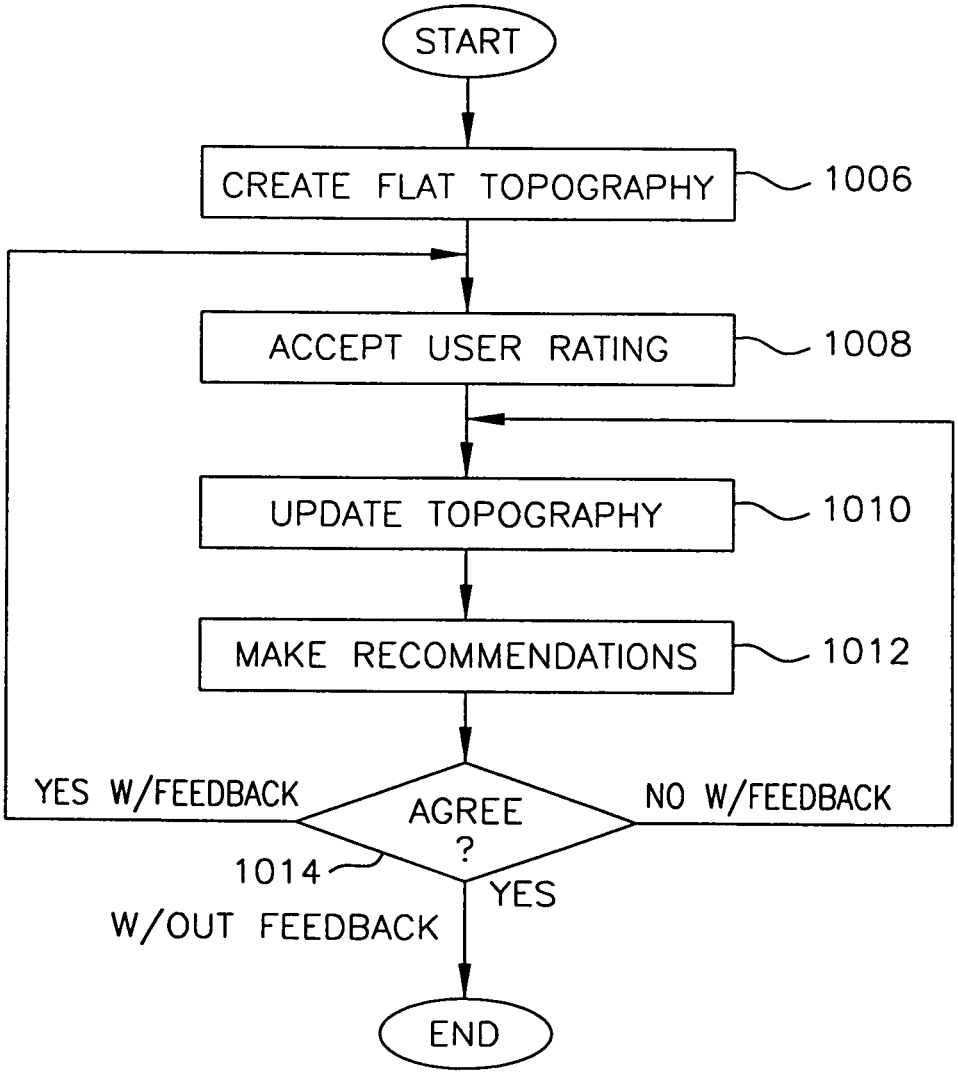
FIG. 31 is a flow diagram of a recommendation process of the system of FIG. 30 using preference topographies.

FIG. 31 is a flow diagram of a recommendation process, described in terms of a software program, of the system of FIG. 30 using preference topographies. The program begins, and in step 1006, creates a flat topography where all the products in the recommendation database 32 represented by the N variables are deemed to be of equal preference to the user and thus, given the same default rating (e.g. a rating of three). In step 1008, the program accepts a user rating for a particular product. For example, in a recipe recommendation system, the program may ask the user to select his or her favorite dish, or ask the user to rate a specific dish selected by the program.

In step 1010, the program updates the topography to reflect the user rating. In this regard, the program retrieves a product vector for the rated product which includes the objective measurements for the N variables representing the product. For instance, in a recipe recommendation system where two of the variables are sodium and sugar, the product vector indicates the amount of sodium and sugar contained in the dish. A valley (if the user rating is lower than a current rating) or mountain (if the user rating is higher than a current rating) reflective of the user's preference for the particular combination of the N variables is then created on the user's topography.

In step 1012, the program makes one or more recommendations of items in the recommendation database 32 based on the preference topography. The user may agree or disagree with the recommended choices as indicated in step 1014. If the user disagrees, the program returns to step 1008 where the user is asked to rate additional products for more accurately representing the user's preference topography. If the user agrees and also provides feedback about the recommended choices (e.g. by rating such recommendations), the program again updates the topography to reflect the feedback provided. If the user agrees without further feedback, the program ends.

Figure 32:
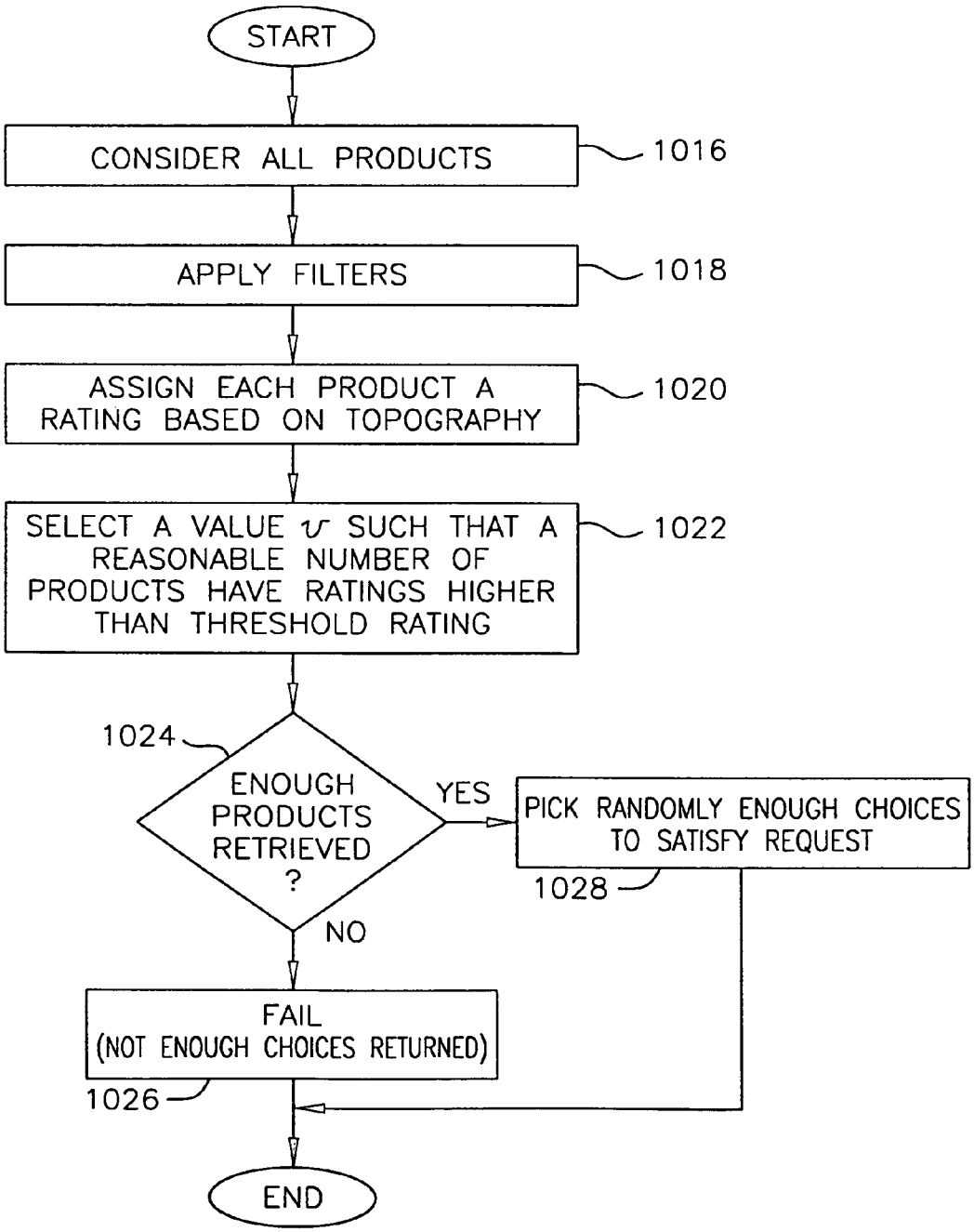
FIG. 32 is a flow diagram of a recommendation step of FIG. 31.

FIG. 32 is a flow diagram of the recommendation step 1012 of FIG. 31 described in terms of a software program. The program starts, and in step 1016, proceeds to consider all products in the recommendation database 32. In step 1018, the program applies various filters for eliminating products that should not be included in the recommended choices. As described above in conjunction with the alternative embodiments, the system presents to the user exclusive preference questions that the user responds with an absolute answer (e.g. a YES or a NO question). One such exemplary question for a meal recommendation system is whether the user is a vegetarian.

In step 1020, the program assigns to each product that has not been filtered out a rating based on the user's topography. In step 1022, the program selects a value v, such that a reasonable number of products retrieved by the engine have ratings higher than a threshold rating. For example, a value v may be selected so that the top 100 rated products are retrieved by the engine. According to one embodiment of the invention, the value v and/or the threshold rating is a function of the recommendation request or preference topography. For example, if ten products are to be recommended, the value v would be chosen to be at least ten, but preferably a factor of ten, such as 100. Also, if the preference topography is densely populated with many product ratings, the value v would preferably be larger. The products retrieved preferably remain the same until the preference topology changes.

In step 1024, the program inquires if the selected value v has retrieved a sufficient number of products. If the answer is NO, an error message is returned in step 1026. If the answer is YES, the program, in step 1028, selects enough choices from the retrieved products to satisfy the request. Thus, if the request is for five choices, the program selects five such choices from the retrieved products. The choices are preferably as different from one another as possible. This may be accomplished, for example, by selecting products that maximizes their total vector distance. If the user requests other five choices, the program selects from the retrieved group five choices that have not yet been recommended.

Figure 33:
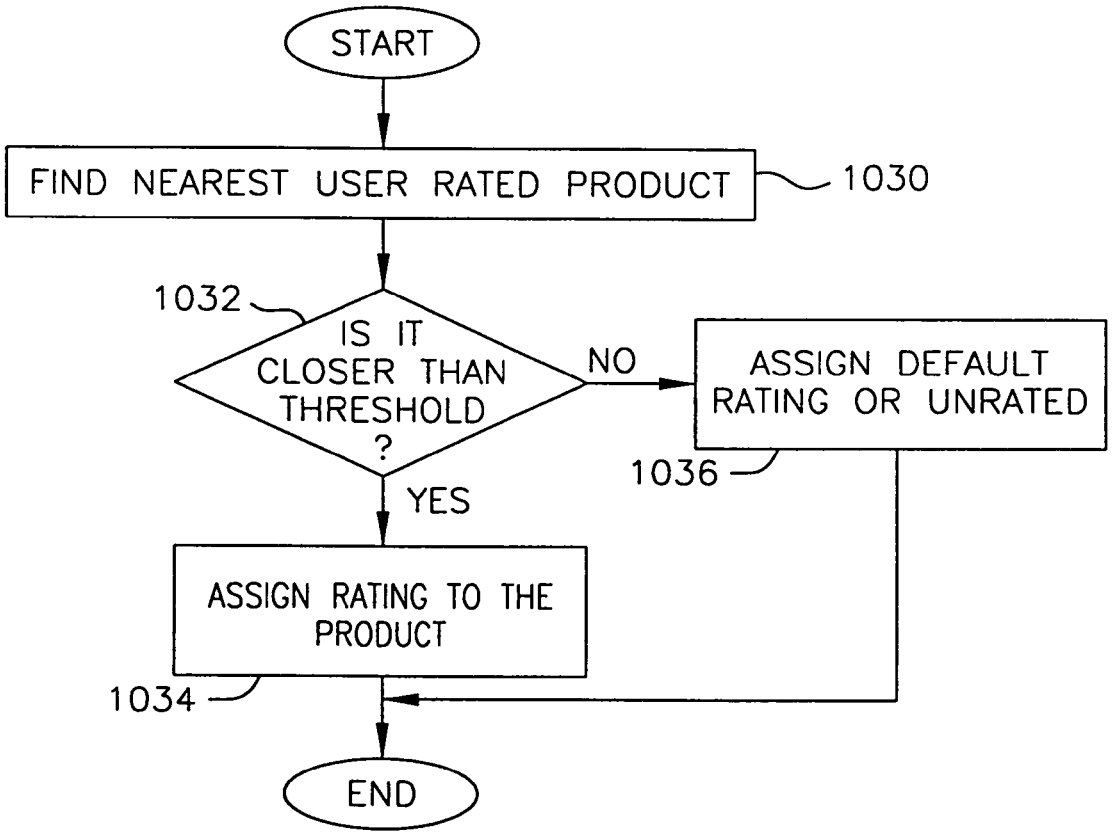
FIG. 33 is a process flow diagram for assigning a rating to a product based on a preference topography.

FIG. 33 is a process flow diagram of step 1020 of FIG. 32 for assigning a rating to a product in the recommendation database 32 based on the preference topography. The program starts, and in step 1030, finds a user-rated product that is nearest to the product to be rated. In this regard, the program calculates the vector distance from the product to be rated to each product rated by the user, and selects the user-rated product with the shortest distance. According to one embodiment of the invention, the vector distance is calculated according to the following formula:

$$\sqrt{S1(Y1-X1)^2+S2(Y2-X2)^2+\ldots+Sn(Yn-Xn)^2}$$

where Y1, Y2, . . . Yn are the values of the N variables corresponding to a user rated product, X1, X2, . . . Xn are the values of the N variables corresponding to the product to be rated, and S1, S2, . . . Sn are scaling coefficients. The scaling coefficients may depend mathematically on each Xn value, reflecting a non-linear response in the human processing of external stimulus.

In step 1032, the program inquires if the distance is closer than a pre-determined threshold distance. The threshold distance selected preferably depends on the user's preference topography. For instance, if the preference topography is densely populated with many product ratings, the threshold is preferably small.

If the distance is closer than the threshold distance, the program, in step 1034, assigns to the product the rating of the selected user-rated product. If the answer is NO, the program, in step 1036, assigns a default rating to the product or leaves the product unrated.

Figure 34:
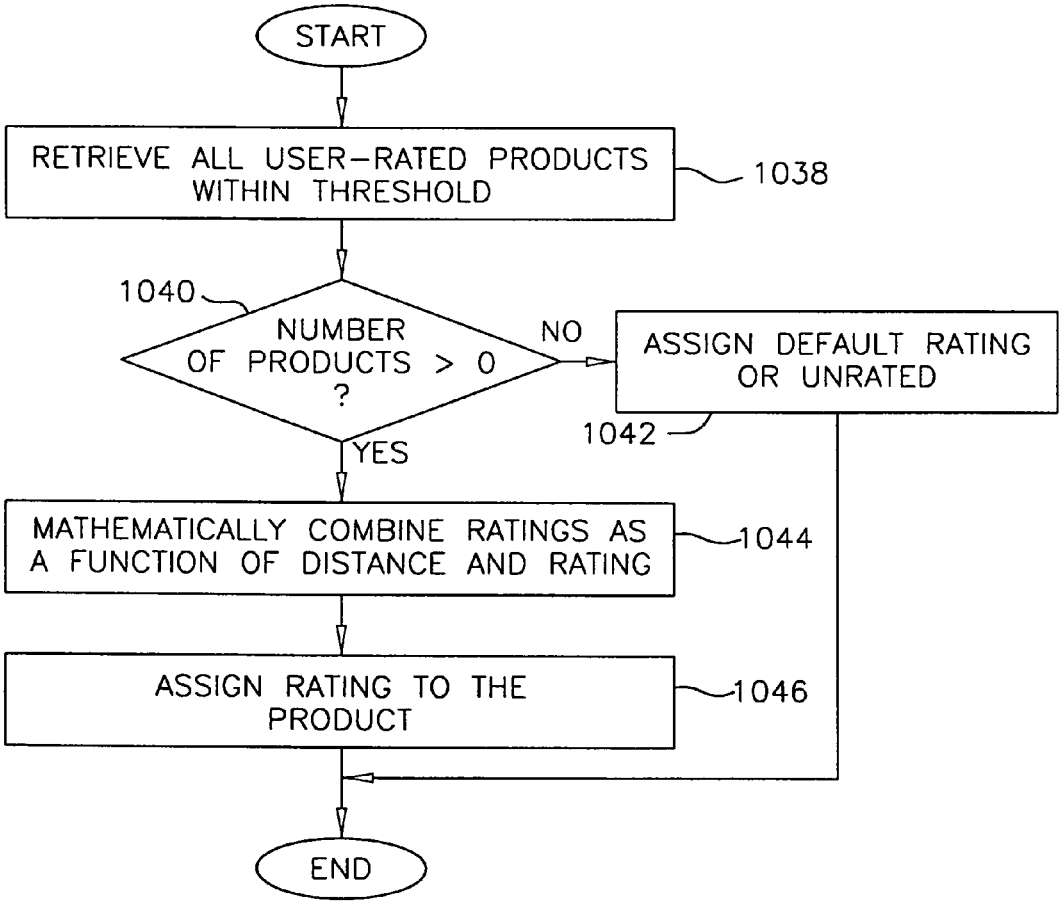
FIG. 34 is an alternative process flow diagram for assigning a rating to a product based on a preference topography.

FIG. 34 is an alternative process flow diagram of step 1020 of FIG. 32 for assigning a rating to a product in the recommendation database 32 based on the preference topography. The program begins, and in step 1038, retrieves all user-rated products within a predetermined threshold distance. The program inquires in step 1040 whether the number of products retrieved is greater than zero. If the answer is NO, the program either assigns a default rating to the product or leaves the product unrated. If the answer is YES, the program, in step 1044, mathematically combines the ratings of the retrieved products as function of the product distance and rating. Thus, if a product resides halfway between a product given a rating of three and a product given a rating of four, the product would preferably be given a rating of 3.5. In step 1046, the program assigns the calculated rating to the product.

If a recommendation is to be made to an aggregate group of users, the rating assigned to a product is a group rating based on the user ratings of the closest user-rated product. According to a first embodiment of the invention, the group rating is set to be the minimum of all such ratings. Thus, if at least one person in the group has given a low rating indicative of his or her dislike for the user-rated product, the current product being rated is also given the low rating and weeded out from being recommended to the group. According to a second embodiment of the invention, the group rating is set to be the average of all user ratings of the closest user-rated product. A person skilled in the art should appreciate, however, that other methods of selecting group ratings may be used, such as a combination of the first and second embodiments where the group rating is set to be the average of all user ratings unless two or more users dislike the user-rated product and have given it a low rating, in which case the group rating is set to be the lowest rating to prevent the product from being recommended to the group.

Figure 35:
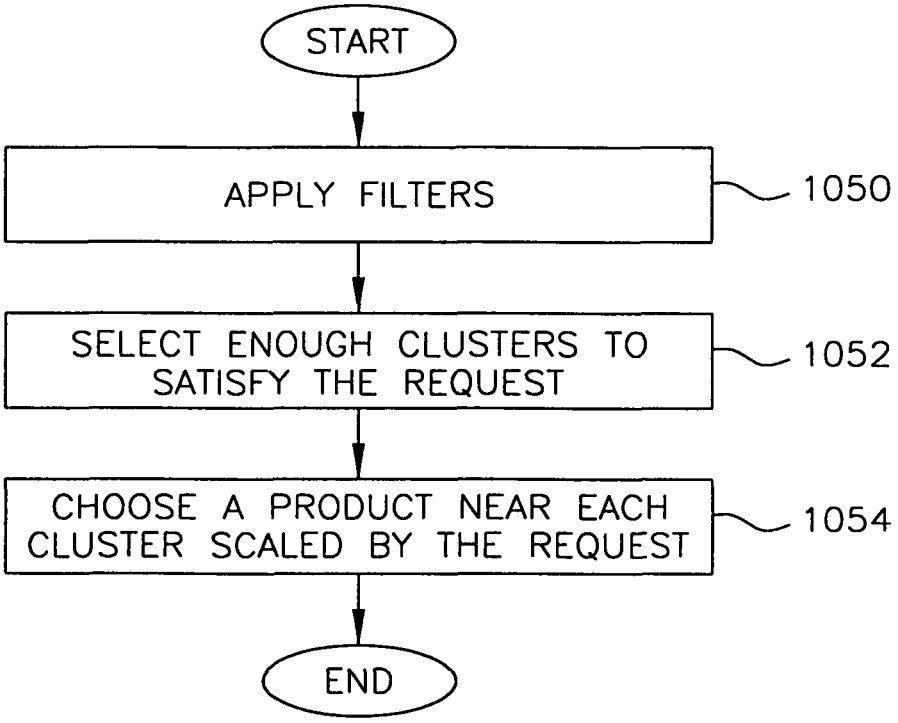
FIG. 35 is a flow diagram of a recommendation step of FIG. 31 according to an alternative embodiment of the invention.

FIG. 35 is a flow diagram of the recommendation step 1012 of FIG. 31 according to an alternative embodiment of the invention. According to this embodiment, the program identifies portions of the N-dimensions of the topography where the user preferences lie. These areas of positive association are referred to as positive preference clusters. In making a recommendation, the program selects products that lie within a user's positive preference cluster.

In this regard, the program starts and in step 1050, applies various filters for eliminating products that should not be included in the recommended choices. In step 1052, the program identifies enough positive clusters in the user's preference topography to satisfy the request. In step 1054; the program proceeds to choose a product near each positive cluster scaled by the request. Thus, if the request is for six choices, the program identifies six different positive clusters in the user's preference topography to the extent possible, and recommends one product near each cluster. If less clusters are identified than the amount of the request, the program reuses one or more clusters to satisfy the request. Thus, for example, if only three positive clusters are identified and the request is for six choices, two products are selected from each cluster to satisfy the request. Such an approach helps ensure that the recommended choices are as diverse as possible.

Figure 36:
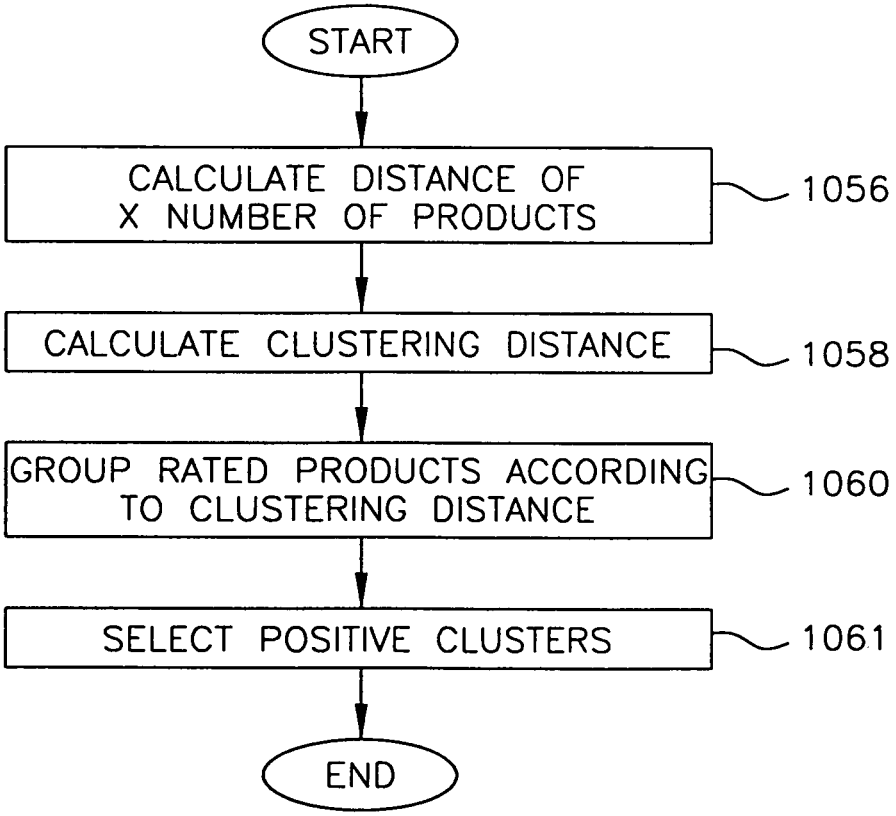
FIG. 36 is a process flow diagram for selecting positive preference clusters.

FIG. 36 is a process flow diagram of step 1052 described in terms of a software program for selecting positive preference clusters. The program starts, and in step 1056, randomly selects a predetermined number of products for calculating distances: between these products. The distance calculation provides information about the spread of the products in the user's preference topography. That is, the distance calculation is indicative of how different or how similar the products are in terms of their characteristics. In step 1058, the program calculates a clustering distance for determining the user-rated products that should be clustered together. According to one embodiment of the invention, the clustering distance is computed by taking an average of the computed distances and subtracting a predetermined percentage (e.g. 10%) from such an average. The selection of the predetermined percentage is preferably dependent on how densely the preference topography is populated with product ratings. In step 1060, the program groups all user-rated products according to the clustering distance. Specifically, if the distance between two user-rated products is less than the clustering distance, these products are similar in their characteristics and therefore belong to the same cluster. However, if the distance is greater than the clustering distance, these products are different from each other and should be put in separate clusters. In step 1061, the program selects the clusters whose weighted center has a rating above a certain threshold rating, and designates such clusters as the positive preference clusters. In an alternative embodiment, the program simply identifies the clusters that have one or more products whose user ratings are above a threshold rating; and designates these clusters as positive clusters.

According to one embodiment of the invention, the system also takes into account the areas of negative association in the user's preference topography in making a recommendation. These areas of negative association where the user has indicated a strong dislike of a portion of the N-dimensions are referred to as negative preference clusters. Products close to these negative clusters are preferably avoided and not recommended to the user. The algorithm of FIG. 36 for selecting positive clusters may also be applied for selecting the negative preference clusters, except for a variation in step 1061.

Figure 37:
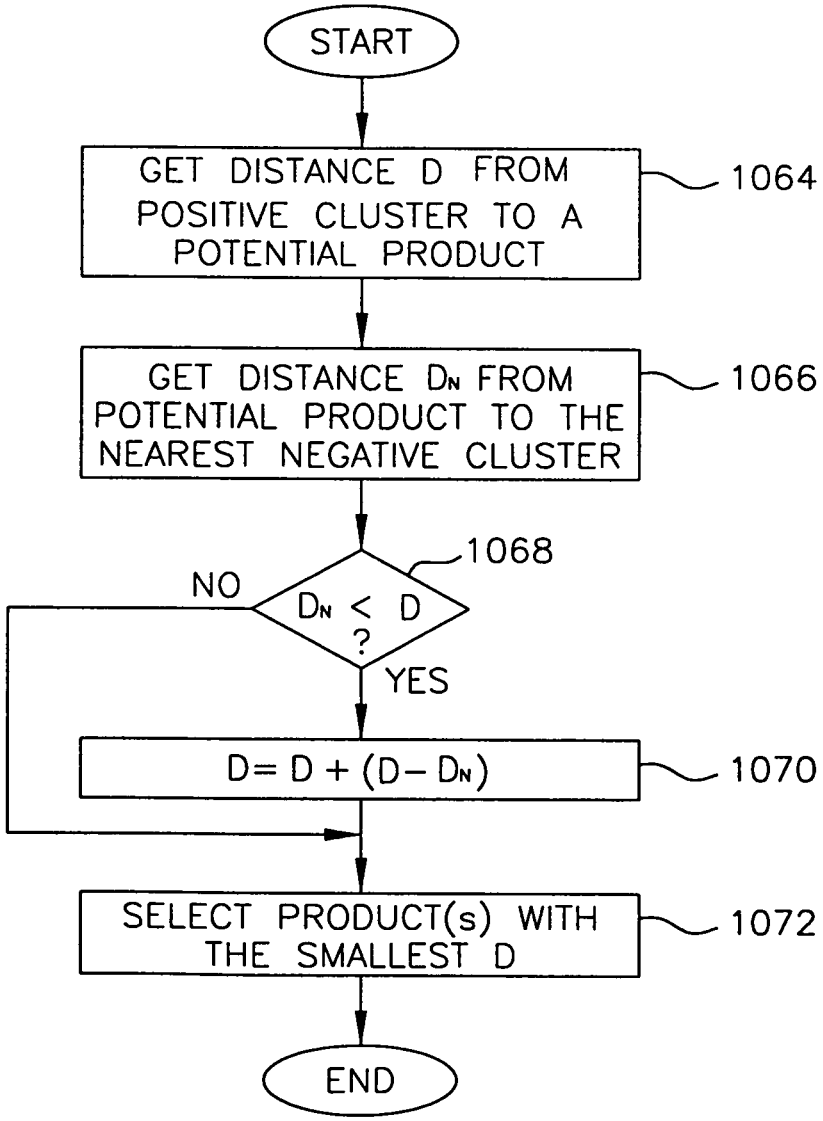
FIG. 37 is a process flow diagram for using positive and negative preference clusters for recommending a product to a user.

FIG. 37 is a process flow diagram of step 1054 described in terms of a software program for using the positive and negative preference clusters to recommend a product to the user. The program starts, and step 1064, the program calculates the distance from the positive cluster to a potential product to be recommended. In this regard, the program calculates the distance from each user-rated product in the positive cluster to the potential product to be recommended. The smallest distance is preferably deemed to be the distance to the positive cluster. Alternatively, the program calculates the weighted center of the cluster and the distance from the weighted center to the potential product is deemed to the distance to the positive cluster.

In step 1066, the program calculates a distance from the potential product to the nearest negative cluster. In step 1068, the program inquires whether this distance is less than the distance to the positive cluster. If the answer is YES, the program, in step 1070 increases the distance to the positive cluster by a difference between the distance to the positive cluster and the distance to the negative cluster. In this way, the program takes into account products similar to a potential product to be recommended that the user has not liked, in determining whether in fact this potential product is to be recommended.

In step 1072, the program selects a product(s) with the smallest distance to the positive cluster. This process of FIG. 37 is carried out with enough positive clusters to satisfy a recommendation request. In this way, recommended choices are as diverse as possible.

While the invention has been described with respect to particular illustrated embodiments, those skilled in the art and technology to which the invention pertains will have no difficulty devising variations which in no way depart from the invention. For instance, the exclusive and inclusive fields may be maintained as separate vectors. Furthermore, the method of automating the creation of recipe vectors may be extended to automate the creation of other product vectors. For example, in creating product vectors for musical pieces, analysis of the musical pieces may be performed via an automated DSP (digital signal processing) algorithm. This would allow the automatic detection of the kinds of instruments involved as well as other musical attributes necessary to create the product vectors. For a painting recommendation system, color and texture analysis may be correlated to attributes present in paintings to automatically create a product vector for a particular painting. Furthermore, the described system for recommending items may be extended to other types of knowledge-based selection systems where recommendations are made based on the knowledge of a user's preference. Accordingly, the present invention is not limited to the specific embodiments described above, but rather as defined by the scope of the appended claims and their equivalents.

The invention claimed is:

1. In an electronic shopping system including a computer device, a computer-implemented method for creating a shopping list for a user, the method comprising:

accessing a database storing objective descriptions of a plurality of food items, each objective description being represented via a vector including N numerical values quantifying N chemical components found in food, wherein N>0;

providing to the computer device user selection of a first food item;

associating the selected first food item with a user's food preference, wherein the associating includes retrieving from the database the vector for the first food item and associating the N numerical values quantifying the N chemical components in the vector of the first food item as N numerical values quantifying a user's preference for the N chemical components;

selecting a second food item from a plurality of food items based on the selection of the first food item, the selecting including:

retrieving from the database the vector for the second food item;

performing an N-dimensional distance computation between the N numerical values quantifying the user's preference for the N chemical components based on the user selection of the first food item, and the N numerical values quantifying the N chemical components in the vector of the second food item, and obtaining a single scalar value in response; and selecting the second food item based on the distance computation;

under control of the computer device, presenting to the user the second food item;

under control of the computer device, displaying one or more ingredients contained in the presented food item;

creating, under control of the computer device, an order request including the one or more ingredients contained in the presented food item;

automatically submitting the order request to a retailer over a data communications connection.

2. The method of claim 1 further comprising identifying a particular retailer and submitting the order request to the identified retailer.

3. The method of claim 1, wherein the fulfilling of the order request comprises automatically inserting the accepted ingredients into an electronic shopping cart.

4. The method of claim 1, wherein the fulfilling of the order request comprises delivering the accepted ingredients according to a pre-determined delivery time.

5. The method of claim 1 further comprising actuating a portion of a display screen for indicating the user acceptance of the presented order request.

6. The method of claim 1 further comprising excluding one or more of the ingredients from the order request.

7. The method of claim 6, wherein the excluding of the one or more of the ingredients is automatic based on prior purchase information.

8. The method of claim 1 further comprising:

receiving a user identification of a rating; and assigning the rating to the first food item.

9. The method of claim 1, wherein at least one of the N chemical components is copper.

10. The method of claim 1, wherein at least one of the N chemical components is manganese.

11. The method of claim 1, wherein at least one of the N chemical components is selenium.

12. The method of claim 1, wherein at least one of the N chemical components is thiamine.

13. The method of claim 1, wherein at least one of the N chemical components is niacin.

14. The method of claim 1, wherein at least one of the N chemical components is tryptophan.

15. The method of claim 1, wherein at least one of the N chemical components is one of threonine, isoleucine, leucine, lysine, methionine, cystine, phenylalanine, tyrosine, valine, arginine, histidine, and alanine.

16. The method of claim 1, wherein at least one of the N chemical components is aspartic acid.

17. The method of claim 1, wherein at least one of the N chemical components is glutamic acid.

18. The method of claim 1, wherein at least one of the N chemical components is glycine.

19. The method of claim 1, wherein at least one of the N chemical components is proline.

20. The method of claim 1, wherein at least one of the N chemical components is serine.

* * * * *